US008617778B2

(12) United States Patent
Iwamoto et al.

(10) Patent No.: US 8,617,778 B2
(45) Date of Patent: Dec. 31, 2013

(54) IMAGE BEARING MEMBER, IMAGE FORMING APPARATUS, AND PROCESS CARTRIDGE

(75) Inventors: Takafumi Iwamoto, Shizuoka-ken (JP); Naohiro Toda, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 267 days.

(21) Appl. No.: 12/979,986

(22) Filed: Dec. 28, 2010

(65) Prior Publication Data

US 2011/0159419 A1 Jun. 30, 2011

(30) Foreign Application Priority Data

Dec. 28, 2009 (JP) ..... 2009-297370
Dec. 28, 2009 (JP) ..... 2009-297541
Dec. 21, 2010 (JP) ..... 2010-284070

(51) Int. Cl.
*G03G 5/07* (2006.01)

(52) U.S. Cl.
USPC ..... 430/59.6; 430/58.7; 399/159

(58) Field of Classification Search
USPC ..... 430/58.7, 59.6; 399/159
See application file for complete search history.

(56) References Cited

U.S. PATENT DOCUMENTS

2004/0053149 A1 3/2004 Toda et al.
2006/0134540 A1 6/2006 Kondo et al.
2006/0240346 A1 10/2006 Toda et al.
2007/0042281 A1 2/2007 Orito et al.
2007/0059617 A1 3/2007 Toda et al.
2007/0059618 A1 3/2007 Kurimoto et al.
2009/0035672 A1* 2/2009 Yanagawa et al. ..... 430/33
2009/0180788 A1 7/2009 Tamoto et al.
2009/0185821 A1* 7/2009 Iwamoto et al. ..... 399/111

FOREIGN PATENT DOCUMENTS

JP 5-181299 7/1993
JP 2000-284514 10/2000

(Continued)

*Primary Examiner* — Peter Vajda
(74) *Attorney, Agent, or Firm* — Oblon, Spivak, McClelland, Maier & Neustadt, L.L.P.

(57) ABSTRACT

An image bearing member including an electroconductive substrate, a charge generation layer, a charge transport layer and, a cross-linked type charge transport layer, the cross-linked type charge transport layer having a structure unit deriving from a first component, a second component, and a third component, the first component containing a copolymer having a cyclic structure and/or a structure represented by a Chemical structure 1 as a repeating unit, Chemical structure 1 where Ra represents a hydrogen atom or methyl group and Rb represents a straight-chained saturated aliphatic hydrocarbon group having 8 to 34 carbon atoms, the second component containing at least one of a radical polymerizable monomer and a radical polymerizable oligomer without a charge transport structure, and the third component containing one or more kinds of radical polymerizable compounds having a charge transport structure.

9 Claims, 5 Drawing Sheets

(56) References Cited

FOREIGN PATENT DOCUMENTS

| | | |
|---|---|---|
| JP | 2000-284515 | 10/2000 |
| JP | 3164426 | 3/2001 |
| JP | 2001-106650 | 4/2001 |
| JP | 2001-125286 | 5/2001 |
| JP | 2001-166510 | 6/2001 |
| JP | 3194392 | 6/2001 |
| JP | 2001-194813 | 7/2001 |
| JP | 2001-324857 | 11/2001 |
| JP | 2002-6526 | 1/2002 |
| JP | 2002-82465 | 3/2002 |
| JP | 2002-139859 | 5/2002 |
| JP | 2003-98708 | 4/2003 |
| JP | 2003-302779 | 10/2003 |
| JP | 2004-83859 | 3/2004 |
| JP | 2004-302451 | 10/2004 |
| JP | 2005-55589 | 3/2005 |
| JP | 2005-99688 | 4/2005 |
| JP | 2007-178815 | 7/2007 |
| JP | 2007-182519 | 7/2007 |
| JP | 2007-279678 | 10/2007 |
| JP | 2008-139824 | 6/2008 |
| JP | 2008-233893 | 10/2008 |
| JP | 4214655 | 11/2008 |
| JP | 2009-13384 | 1/2009 |

* cited by examiner

IMAGE BEARING MEMBER, IMAGE FORMING APPARATUS, AND PROCESS CARTRIDGE

BACKGROUND OF THE INVENTION

1. Field of the Invention

The present invention relates to an image bearing member (also referred to as a photoreceptor or a photoconductor), and an image forming apparatus and process cartridge using the image bearing member.

2. Description of the Background Art

In recent years, organic photoconductors have come to be widely used as image bearing members. Organic photoconductors are advantageous over inorganic image bearing members in terms of ease of developing materials that respond to various kinds of irradiation light sources ranging from visible light to infrared light, selection of materials that are less burdensome on the environment, lower manufacturing costs, etc. By contrast, inorganic image bearing members are superior to organic photoconductors with regard to mechanical durability. In general, image bearing members having an excellent mechanical durability and a long working life are preferable, as is discussed below.

An image forming apparatus employing electrophotography generally includes an image bearing member, a charger that charges the image bearing member, a latent image formation device that forms a latent electrostatic image on the image bearing member with the charger, a development device that attaches toner to the latent electrostatic image on the image bearing member formed by the latent image formation device, a transfer device that transfers the attached toner to a transfer material, a cleaning device that removes residual toner remaining on the surface of the image bearing member, etc.

As such processes are repeated in image formation, the surface of the image bearing member is chemically and/or physically degraded, thereby accelerating abrasion of the organic photoconductor or forming scars thereon. Organic photoconductors are particularly susceptible to such degradation and soon come to produce degraded images. Therefore, mechanical durability is one of the most critical issues confronting development of successful organic photoconductors.

To improve the mechanical durability of organic photoconductors, a number of technologies involving use of a protective layer have been disclosed. In addition, a number of technologies involving improving mechanical durability by dispersing inorganic particulates in the protective layer have been disclosed as well.

For example, Japanese patent application publication no. 2002-139859 (JP-2002-139859-A) describes an image bearing member including an electroconductive substrate on which a photosensitive layer and a protective layer containing a filler are sequentially laminated in that order.

Furthermore, technologies involving increasing the hardness of the surface of the image bearing member are disclosed.

For example, JP-2001-125286-A and 2001-324857-A describe an image bearing member having a reinforced protective layer in order to prevent damage by magnetic particles inadvertently transferred to the image bearing member by a magnetic brush-type charger when the magnetic particles are strongly pressed against transfers and cleaning portions of the image bearing member. In addition, JP-2003-098708-A describes an image bearing member having an enhanced hardness to reduce abrasion of the surface of the image bearing member when a cleaning blade system is used.

As specific measures to enhance the surface hardness of the image bearing member described above, use of cross-linking materials such as thermocuring resins and UV curing resins is known. For example, JP-H05-181299-A, 2002-006526-A, and 2002-082465-A describe use of a thermocuring resin as the binder resin for the protective layer to improve mechanical durability and damage resistance. In addition, JP-2000-284514-A, 2000-284515-A, and 2001-194813-A describe use of siloxane resins combined with a charge transport group in the protective layer to improve mechanical durability and damage resistance.

Furthermore, Japanese patent no. 3194392 (JP-3194392-B) describe an image bearing member having a charge transport layer manufactured using a monomer having a C═C double bonding, a charge transport material having a C═C double bonding, and a binder resin to improve mechanical durability and damage resistance. Similarly, JP-2004-302451-A describes a method of forming a charge transport layer by curing a radical polymerizable monomer having three or more functional groups without a charge transport structure and a radical polymerizable compound having one radical polymerizable monomer with a charge transport structure.

Furthermore, JP-2005-99688-A describes a method of forming a protective layer by curing a radical polymerizable monomer having three or more functional groups without a charge transport structure and a radical polymerizable compound having a charge transport structure and dispersing fillers.

The image bearing members described above have succeeded in achieving a marked increase in mechanical durability. In particular, image bearing members having a protective layer formed of a curable resin like those described in JP-2004-302451-A, JP-2005-99688-A, and JP-2001-166510-A have excellent mechanical durability and damage resistance.

However, it is difficult to make an image bearing member having a long working life by improving just the mechanical durability alone. To further prolong the working life of an image bearing member, prevention of attachment of impurities to the image bearing member and improvement of toner transfer efficiency (toner transfer ratio) are necessary.

That is, even an image bearing member having excellent mechanical durability starts to produce abnormal images once it is used for an extended period of time, because attachment of paper dust and toner additives causes such abnormal images. More specifically, the portions of the image bearing member to which such paper dust and toner additives attach are not properly charged or irradiated, resulting in production of abnormal images.

Since an image bearing member having an inferior mechanical durability is easily abraded, production of abnormal images is consequently limited. However, it is difficult for such an image bearing member to have a long working life.

As for the matter of toner transfer efficiency, as the toner transfer ratio increases, by definition wasteful toner consumption decreases, which is of course desirable in its own right. Moreover, excessive residual toner remaining on the image bearing member after transfer is an added burden on the cleaning device. Consequently, the cleaning effect does not last for a long time, meaning that the life span of a process cartridge is unnecessarily shortened. Thus, it is highly preferable to increase the toner transfer ratio.

Since prevention of attachment of impurities to the image bearing member and improvement of toner transfer ratio have similar characteristics in most cases, both characteristics are referred to as the releasability of the image bearing member. Use of an uppermost surface layer having a low energy is suitable to improve the mechanical durability and impart good releasability.

Such an uppermost surface layer can be obtained by applying a material for reducing the surface energy to the surface of an image bearing member (referred to as external addition) or causing such a material to contain in the layer (referred to as internal addition).

A specific example of external addition is a mechanism of applying zinc stearate, etc. to the surface of the image bearing member. Because of this mechanism, good releasability can be imparted to the surface of the image bearing member. However, material applied to the surface for reducing the surface energy is degraded by repeated discharging, which may cause production of abnormal images. In addition, providing such an application mechanism results in a large-sized image formation portion, thereby imposing restrictions on layout design. Furthermore, the cost of the image formation portion increases.

The internal addition system is also suitable to improve releasability. However, since the surface of the image bearing member is constantly abraded to make the material appear on the surface, these gains in releasability are achieved at the expense of the mechanical durability.

Thus, a good combination of mechanical durability and releasability is difficult to achieve.

JP-2007-178815-A describes an image bearing member using a fluorine-substituted polysiloxane resin for the surface layer to impart a high releasability to the surface of the image bearing member. However, the siloxane bonding is known to cause polarization and form hydrogen-bonding. Therefore, the force of attachment between the polysiloxane resin and toner may increase in a high-humidity environment, with the result that releasability easily deteriorates.

In addition, JP-2002-6526-A describes an image bearing member having a protective layer that contains lubricant particulates. Likewise, JP-2008-139824-A describes an image bearing member having a surface protective layer formed of a cured fluorine-containing curable composition containing a (meth)acrylate having a fluorinated alkyl group and a photopolymerization initiator. Furthermore, JP-2008-233893 describes an image bearing member having a cross-linked type protective layer formed by curing a fluorine-based UV curable hard coating agent and a radical polymerizable compound having one functional group with a charge transport structure and containing lubricative particulates.

Use of a fluorine-based material is suitable to reduce the force of attachment between the image bearing member and toner. In particular, a cross-linked type charge transport layer containing such a fluorine-based material does provide a good combination of mechanical durability and reduction of force of attachment between an image bearing member and toner. However, a considerable amount of fluorine material is required to sufficiently reduce the force of attachment, and since such a fluorine-containing material does not have a charge transport property, addition of a large amount of the fluorine material may lead to an increase of the voltage at a bright portion as well as a tendency for layer strength to decrease.

In addition, JP-2003-302779-A describes an image bearing member having a surface layer that contains a compound having seven or more carbon atoms with a polymerizable functional group and an aliphatic acid carbon cyclic structure, a binder resin, and a charge transport material. However, although this surface layer is suitable for improving releasability, it has inferior mechanical durability since the resin and the binder resin are not cross-linked. Therefore, this image bearing member does not prolong the working life of the image bearing member. Furthermore, since the layer contains a large amount of polymer, charges are easily blocked where a large amount of polymer is present, which tends to cause a rise in the voltage. It is therefore highly possible that the image quality deteriorates.

JP-H05-216249-A and JP-2005-55589 describe an image bearing member having a cross-linked type charge transport layer formed of a copolymer formed by a radical polymerizable monomer and a radical polymerizable charge transport material. Although this image bearing member has improved abrasion resistance, it has significantly inferior releasability. Therefore, impurities easily adhere to the surface, adversely impacting the life span of the image bearing member.

JP-2001-272802 describes an image bearing member having a photosensitive layer that contains a wax having a long chain alkyl group to have a good combination of the mechanical durability and the releasability. This image bearing member has good releasability at the initial stage but mechanical durability is insufficient.

JP-2001-166510-A describes an image bearing member having a surface layer manufactured by cross-linking a fluorine-containing compound (which is a material for reducing surface energy), a silicon-based compound, and a charge transport material to reduce the surface energy. Although providing good releasability, the cross-linked layer having such a structure has a high permeability to gas, so that the cross-linked layer is easily damaged by gas produced by the charger. It is therefore highly possible that image quality deteriorates once the image bearing member is used for an extended period of time.

Thus, as is clear from the foregoing description, there is a trade-off between mechanical durability and releasability. Therefore, designing an image bearing members striking a poor balance between the two has been inevitable up to now.

SUMMARY OF THE INVENTION

For these reasons, the present inventors recognize that a need exists for an image bearing member that have a good combination of the mechanical durability and the releasing property and stably produces quality images although it is repetitively used for an extended period of time and an image forming apparatus and the process cartridge using the image bearing member.

Accordingly, an object of the present invention is to provide an image bearing member that has a good combination of the mechanical durability and the releasing property and stably produces quality images although it is repetitively used for an extended period of time and an image forming apparatus and the process cartridge using the image bearing member.

Briefly this object and other objects of the present invention as hereinafter described will become more readily apparent and can be attained, either individually or in combination thereof, by an image bearing member including an electroconductive substrate, a charge generation layer provided overlying the electroconductive substrate, a charge transport layer provided overlying the charge generation layer, and a cross-linked type charge transport layer provided overlying the charge transport layer, the cross-linked type charge transport layer including a structure unit deriving from a first component, a second component, and a third component, the first component containing a copolymer having at least one of a cyclic structure and a structure represented by a Chemical structure 1 as a repeating unit, Chemical structure 1

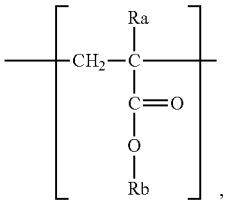

where Ra represents a hydrogen atom or methyl group and Rb represents a straight-chained saturated aliphatic hydrocarbon group having 8 to 34 carbon atoms, the second component containing at least one of a radical polymerizable monomer and a radical polymerizable oligomer without a charge transport structure, and the third component containing one or more kinds of radical polymerizable compounds having a charge transport structure.

It is preferred that, in the image bearing member described above, the cyclic structure is linked together by bonds of carbon atoms and has at least six carbon atoms.

It is still further preferred that, in the image bearing member described above, the cyclic structure is at least one of an adamantane ring, a norbornane ring, and a cyclohexyl ring.

It is still further preferred that the image bearing member described above contains from 30% to 90% by molar conversion of the at least one of the cyclic structure and the structure represented by the Chemical structure 1 in the copolymer of the first component.

It is still further preferred that, in the image bearing member described above, the charge transport layer includes a distyryl benzene derivative represented by a Chemical structure 2

It is still further preferred that, in the image bearing member described above, the cross-linked type charge transport layer includes at least one type of filler particulates.

As another aspect of the present invention, an image forming apparatus is provided which includes the image bearing member described above that bears a latent electrostatic image, a charging device that charges the image bearing member, an irradiator that irradiates the image bearing member to form the latent electrostatic image thereon, a development device that develops the latent electrostatic image with a development agent containing toner to obtain a visualized image, a transfer device that transfers the visualized image to a recording medium, and a cleaning device that cleans the surface of the image bearing member.

As another aspect of the present invention, process cartridge detachably attachable to an image forming apparatus is provided which includes the image bearing member described above that bears a latent electrostatic image, and at least one of a charging device that charges the image bearing member, an irradiator that irradiates the image bearing member to form the latent electrostatic image thereon, a development device that develops the latent electrostatic image with a development agent comprising toner to obtain a visualized image, a transfer device that transfers the visualized image to a recording medium, and a cleaning device that cleans the surface of the image bearing member.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

(1)

Chemical structure 2

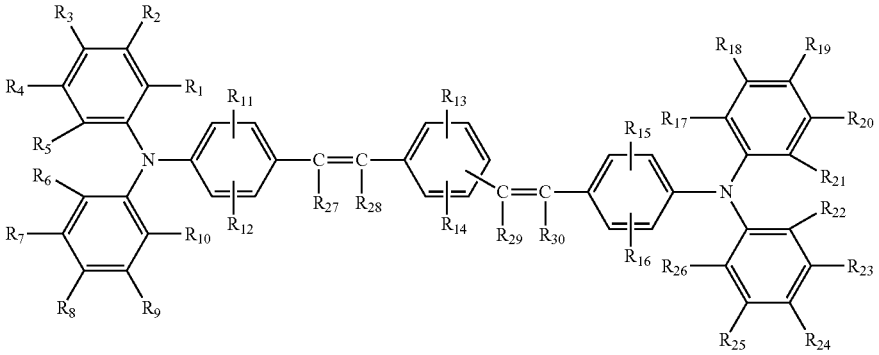

where $R_1$ to $R_{30}$ independently represent a hydrogen atom, an alkyl group having one to four carbon atoms, an alkoxy group having one to four carbon atoms, an aryl group substituted by an alkyl group having one to four carbon atoms or an alkoxy group having one to four carbon atoms, a non-substituted aryl group, and a benzyl group substituted by an alkyl group having one to four carbon atoms or an alkoxy group having one to four carbon atoms.

Figure 2:
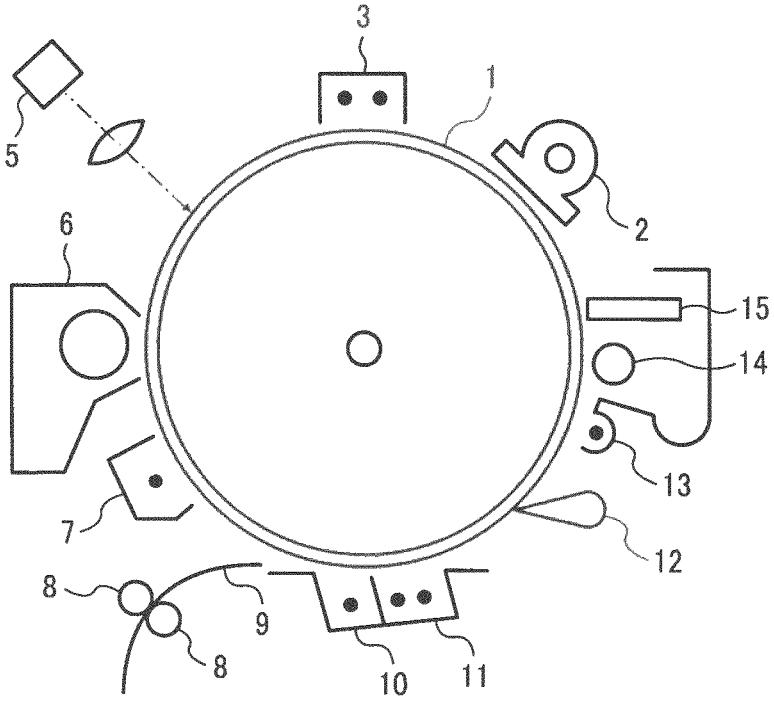
Figure 3:
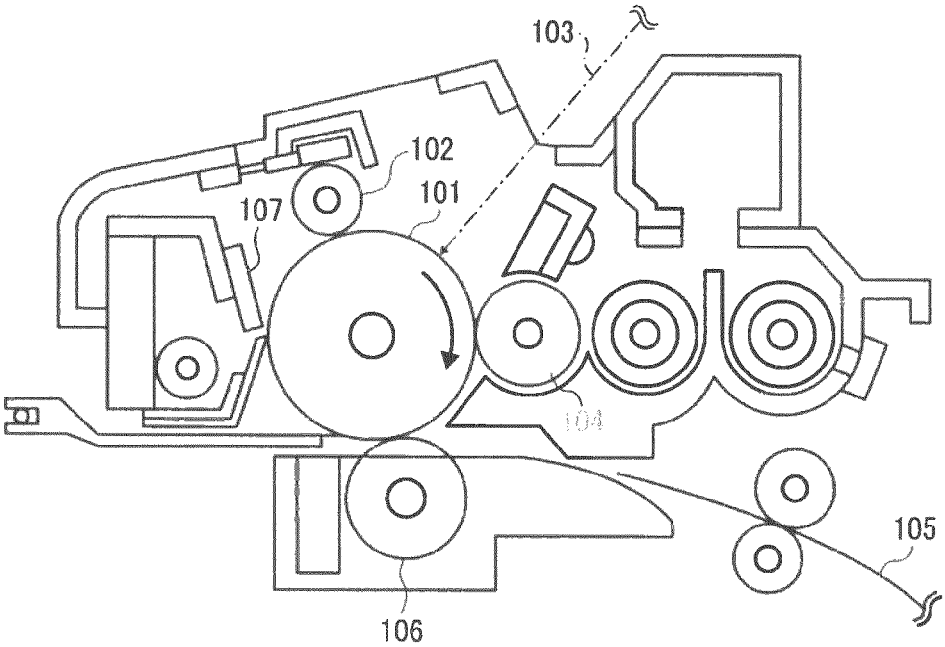
Figure 4:
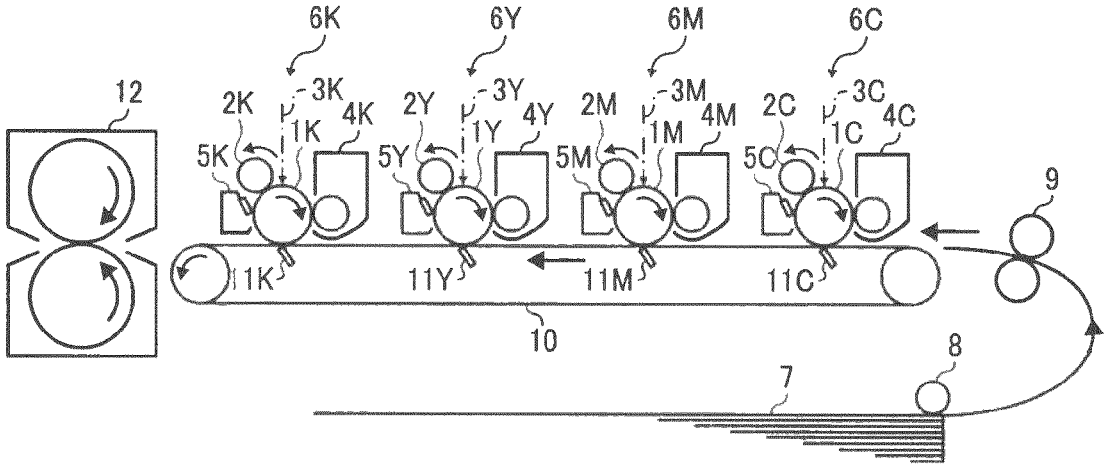
Figure 5:
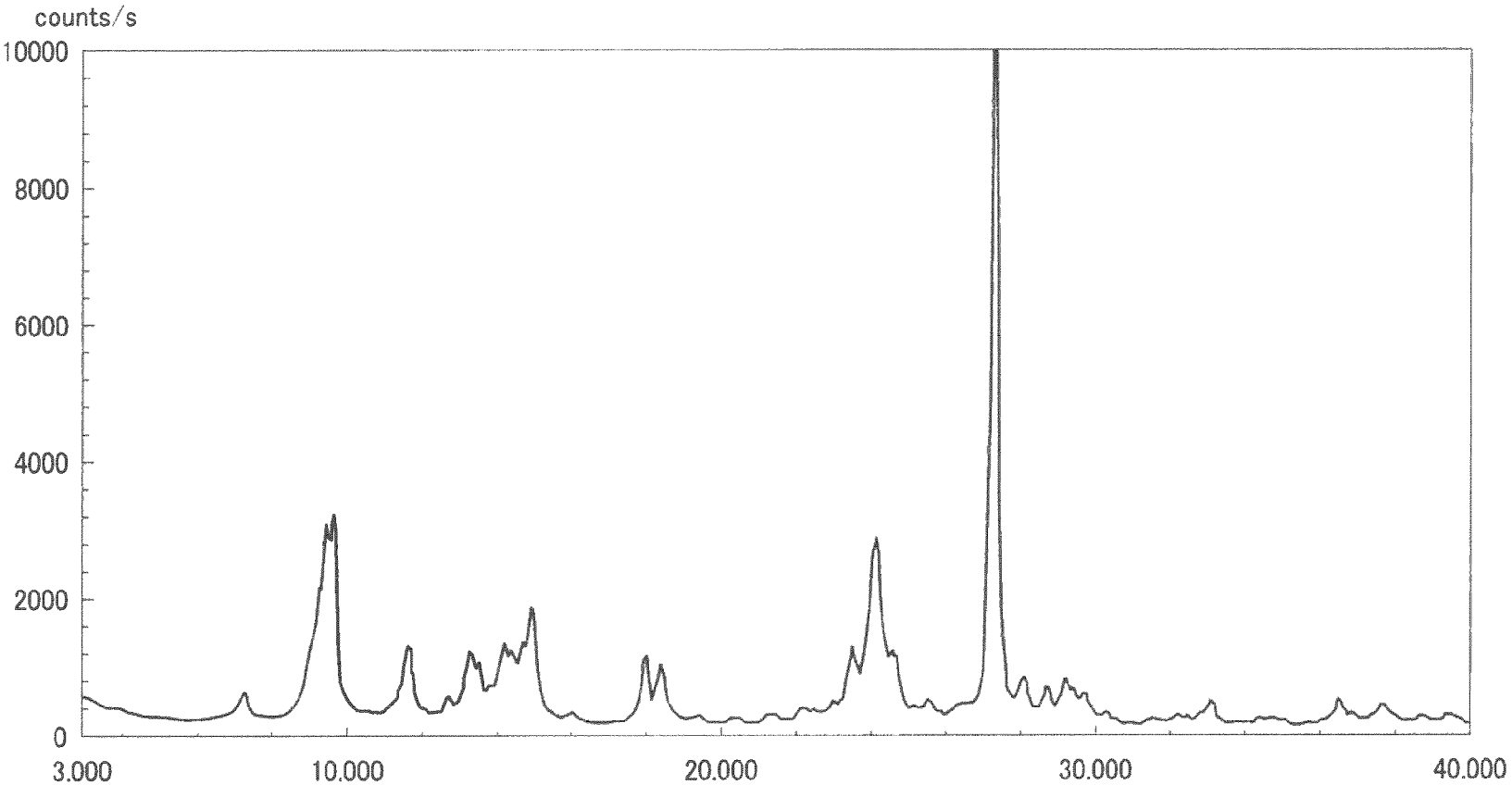
Figure 6A:
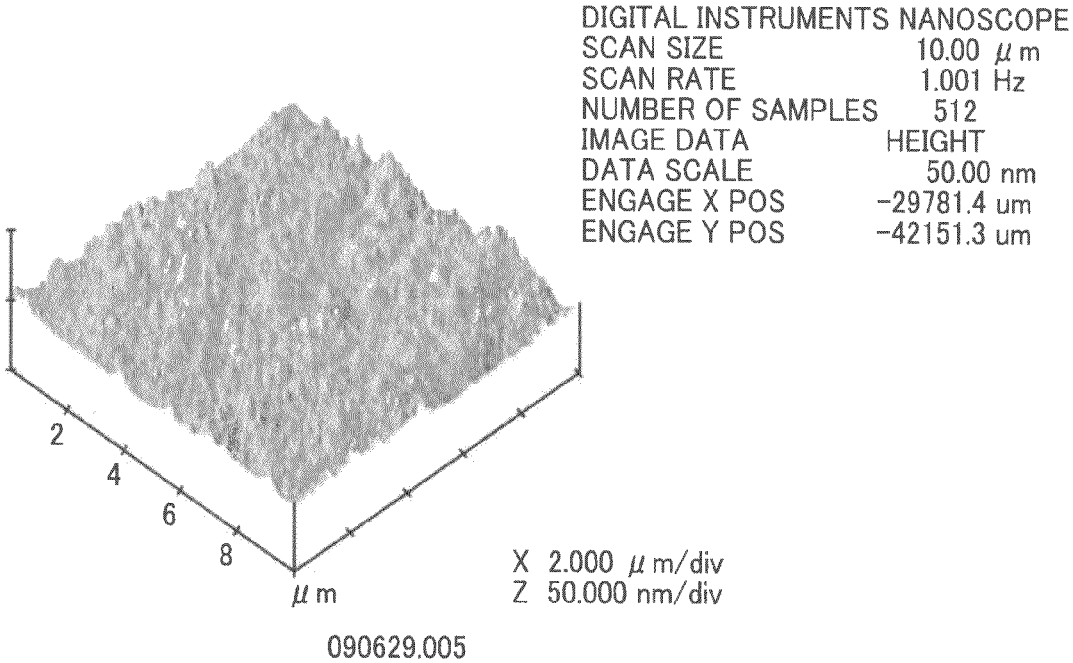
Figure 6B:
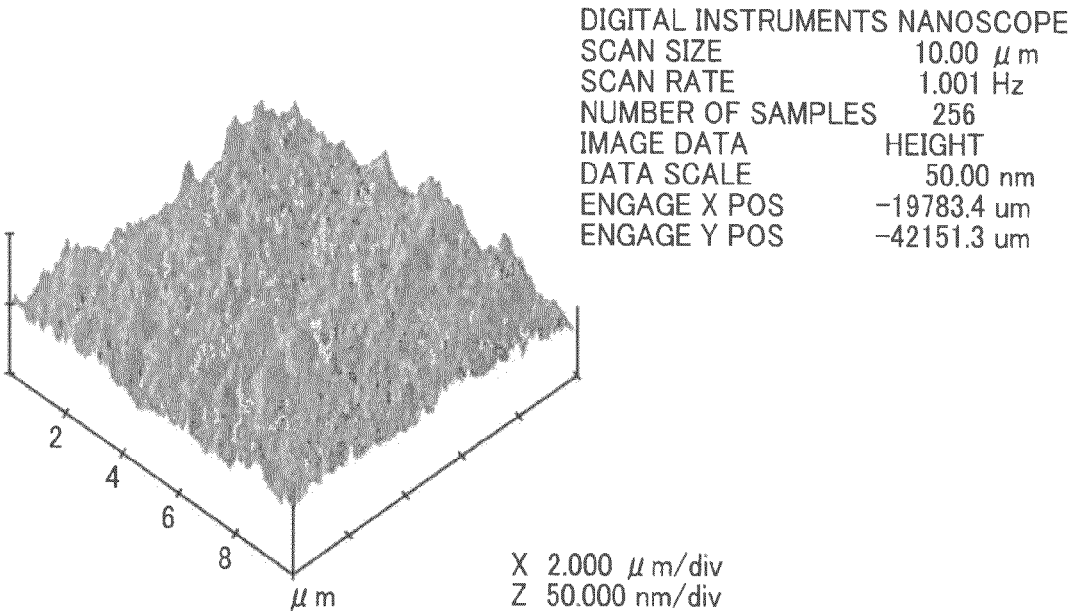
Figure 7A:
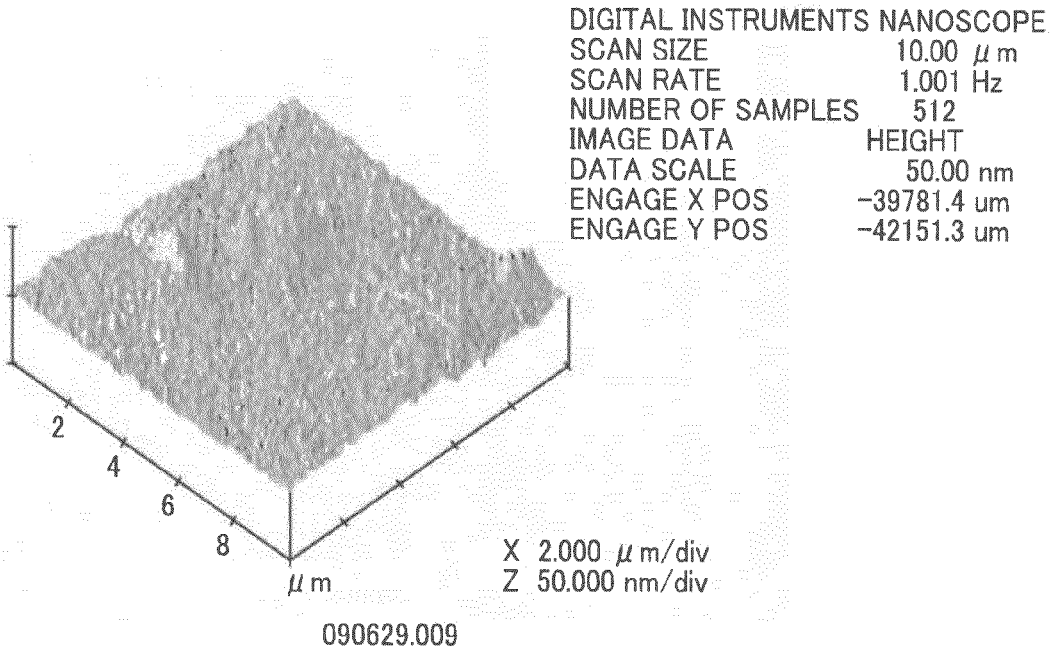
Figure 7B:
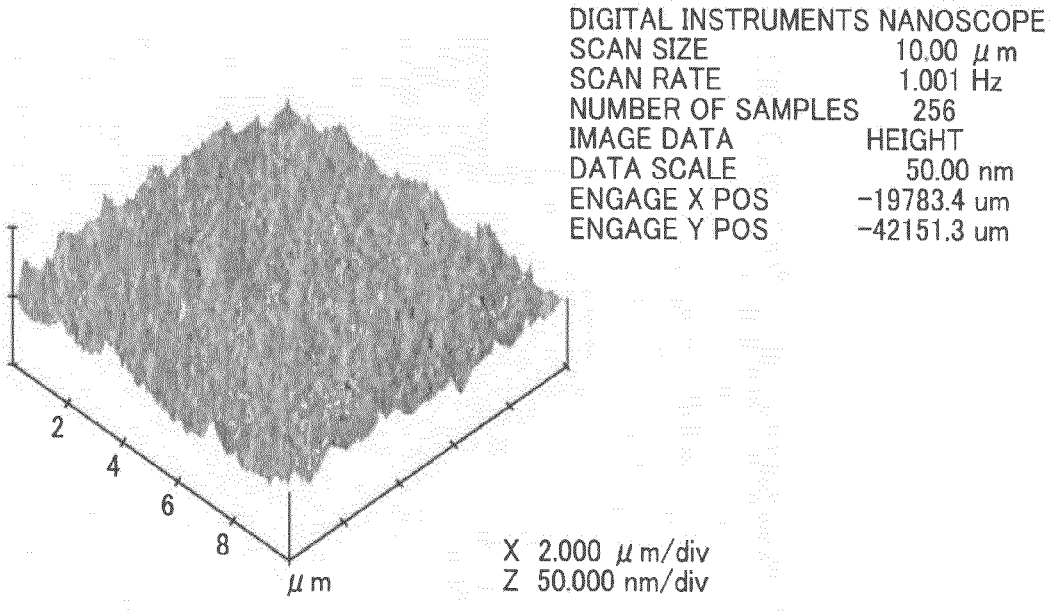

FIG. 2 is a schematic diagram illustrating an example of the image forming apparatus of the present disclosure;

FIG. 3 is a schematic diagram illustrating an example of the process cartridge of the present disclosure;

FIG. 4 is a schematic diagram illustrating an example of an apparatus including multiple image formation elements in the present disclosure;

FIG. 5 is an X-ray diffraction spectrum diagram of the charge generation material for use in Examples described later with an Y axis representing a count number per second (cps: counter per second) and an X axis representing an angle (2θ);

FIG. 6A and FIG. 6B are SPM images of an example of the image bearing member for use in the present disclosure with a scan size along the X axis of 10 μm, and a data scale along the Y axis of 50 nm; and FIG. 7A and FIG. 7B are SPM images of another example of the image bearing member for use in the present disclosure with a scan size along the X axis of 10 μm, and a data scale along the Y axis of 50 nm

DETAILED DESCRIPTION OF THE PRESENT DISCLOSURE

The reason why the image bearing member of the present disclosure has a good combination of the mechanical durability and the releasing property is described below.

The cross-linked type charge transport layer in the present disclosure including a structure unit deriving from a first component of a copolymer having a cyclic structure and/or structure represented by the chemical structure 1 as a repeating unit, a second component of one or more kinds of radical polymerizable compounds without a charge transport structure selected from a group consisting of monomers or oligomers, and a third component of one or more kinds of radical polymerizable compounds having a charge transport structure.

Among these, the lubricity of the cross-linked type charge transport layer ascribable to the straight-chained saturated aliphatic hydrocarbon group represented by the chemical structure 1 contributes to improvement of the releasing property.

In addition, the copolymer of the first component is of less solubility in comparison with the other components.

Therefore, the copolymer component is exposed to the layer surface when dried or irradiated with light so that the layer surface has minute sea-island structure.

This sea-island structure imparts the releasing property to the layer surface.

That is, this lubricity is a result of the combination of the minute roughness of the layer surface caused by layer separation and the lubricity ascribable to the hydrocarbon group aligned on the surface having minute surface roughness.

In addition, since the layer is cross-linked, the layer has an excellent mechanical durability. The surface layer of the image bearing member described in JOP-2003-302779-A has a copolymer containing a cyclic structure and is layer-separated but not cross-linked. This is where the difference between the image bearing member of the present disclosure and the image bearing member in JOP-2003-302779-A lies.

In addition, different from the image bearing member described in JOP-H05-216249 and JOP-2005-55589, the image bearing member of the present disclosure has a cyclic structure in the copolymer, thereby drastically increasing the releasing property of the surface layer.

In addition, different from the image bearing member described in JOP-2005-55589, the image bearing member of the present disclosure has no polarized group in the polymer.

Therefore, the resistance of the surface layer does not decrease so that image flow and deterioration of the charging property hardly occur.

In the structure unit represented by the Chemical structure 1, Rb preferably has 8 to 34 carbon atoms.

A structure unit that has seven or less carbon atoms has a short carbon chain, which tends to have an adverse impact on the lubricity. To the contrary, in a structure unit that has 35 or more carbon atoms, the hydrocarbon groups tends to be hardly aligned, thereby preventing good demonstration of lubricity. In terms of demonstration of the lubricity, the number of carbon atoms is more preferably from 15 to 30.

In addition, when the first component is a copolymer and a cyclic structure is contained in the repeating unit, the releasing property is improved. This relates to the fact that the layer separation of the copolymer is easily conducted.

To separate the layers better to improve the releasing property, the cyclic structure is preferably at least one of adamantane ring, norbornane ring, and cyclohexyl ring.

In addition, the copolymerization ratio of the structure represented by the chemical structure 1 in the copolymer described above is preferably from 30 to 90% by molar conversion. In this range, a favorable layer separation state is obtained in terms of improvement of the releasing agent.

In the present disclosure, the copolymer ratio represents a value by molar conversion for the amount of monomer constituting the copolymer.

The cross-linked charge transport layer of the present disclosure is of a good resistance to NOx gas or ozone gas produced by a charger that charges the image bearing member.

This is thought to be because the permeation to gas decreases since the hydrocarbon groups are present with a high density. Therefore, the degree of degradation of the charging also decreases. In addition, since the permeation to gas is low, the image quality is stable even when a distyrylbene delivative represented by a chemical structure 2 is used, which is advantageous in the charge transport property but disadvantageous in reactivity with NOx gas or ozone gas.

In addition, use of a cross-linked charge transport layer containing a filler improves the mechanical strength of the layer in the present disclosure. This is thought to be because the filler is firmly fixed in the cross-linked layer. In addition, such fillers cause uniform layer separation. This mechanism is unknown but the fillers present around the surface possibly form cores of the layer separation.

Embodiments of the image forming apparatus containing the image bearing member of the present disclosure are described with reference to the accompanying drawings.

Structure of Image Bearing Member

Figure 1:
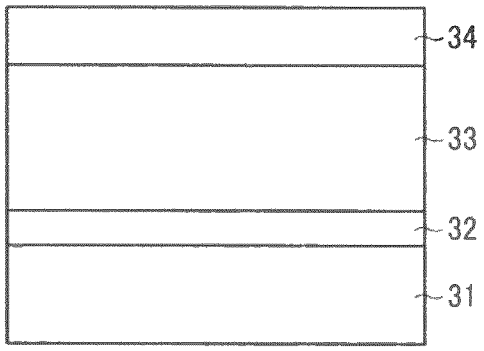
FIG. 1 is a cross section illustrating a structure example of the image bearing member of the present disclosure.

The image bearing member of the present disclosure is of a laminate structure in which at least a charge generation layer 32, a charge transport layer 33, and a cross-linked charge transport layer 34 are laminated on an electroconductive substrate 31 in that order as illustrated in FIG. 1.

Electroconductive Substrate

The electroconductive substrate 301 can be formed by using material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable.

In addition, an endless nickel belt and an endless stainless belt described in JOP-S52-36016-A can be used as the electroconductive substrate. An electroconductive substrate formed by applying to the substrate mentioned above a liquid application in which electroconductive powder is dispersed in a suitable binder resin can be used as the electroconductive substrate for use in the present disclosure. Specific examples of such electroconductive powders include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the electroconductive substrate in the present disclosure. The heat contraction tube is formed of a material such as polyvinyl chloride, polypropylene, polyester, polystyrene, polyvinylidene chloride, polyethylene, chloride rubber, and polytetrafluoroethylene-based fluorine resin and the electroconductive powder mentioned above contained in the material.

Photosensitive Layer

The photosensitive layer formed of the charge generation layer and the charge transport layer is described next.

Charge Generation Layer

The charge generation layer is a layer mainly formed of a charge generation material having a charge generation function and an optional binder resin.

The charge generation layer is a layer mainly formed of a charge generation material. Any known charge generation material can be used for the charge generation layer.

Specific examples thereof include, but are not limited to, azo pigments such as monoazo pigments, disazo pigments, asymmetry disazo pigments, trisazo pigments, azo pigments having a carbazole skeleton (refer to JOP-S53-95033-A), azo pigments having a distyryl benzene skeleton (refer to JOP-S53-13344-A5), azo pigments having a triphenylamine skeleton (refer to JOP-S53-132347-A), azo pigments having a diphenylamine skeleton, azo pigments having a dibenzothiophene skeleton (refer to JOP-S54-21728-A), azo pigments having a fluorenone skeleton (refer to JOP-S54-22834-A), azo pigments having an oxadiazole skeleton (refer to JOP-S54-12742-A), azo pigments having a bis-stilbene skeleton (refer to JOP-S54-17733-A), azo pigments having a distyryloxadiazole skeleton (refer to JOP-S54-2129-A), azo pigments having a distylylcarbazole skeleton (refer to JOP-S54-14967-A); azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments, and phthalocyanine based pigments such as metal phthalocyanine represented by the following chemical formula (11), and metal free phthalocyanine.

These charge generation materials can be used alone or in combination.

Among these charge generation materials, metal phthalocyanine pigments, and azo pigments which will be described later are preferable.

A specific example of the metal phthalocyanine pigments is metal phthalocyanine represented by the following chemical structure 3. These charge generation materials may be used alone or in combination.

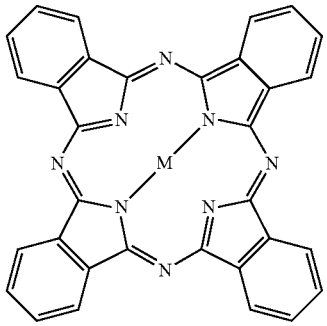

M (center metal) of the chemical structure 3 represents a metal element. Specific example of M (center metal) include, but are not limited to, H, Li, Be, Na, Mg, Al, Si, K, Ca, Sc. Ti,V. Cr, Mn, Fe, Co, Ni, Cu, Zn, ga, Ge, Y, Zr, Nb, Mo, Tc, Ru, Rh, Pd, Ag, Cd, In, Sn, Sb, Ba, Hf, ta, W, Re, Os, Ir, Pt, Au, Hg, TI, La, Ce, Pr, Nd, Pm, Sm, Eu, Gd, Tb, Dy, Ho, Er, Tm, Yb, Lu, Th, Pa, U, Np, and Am or two or elements of oxides thereof, fluorides thereof, hydroxides thereof, and bromide thereof.

Any metal phthalocyanine-based charge generation material having at least a basic skeleton structure of the general chemical structure 3 is suitable in the present disclosure. Also, a material having a dimer, a trimer, or a higher structure having a polymer structure is suitably used.

In addition, the basic skeleton may have various kinds of substitution groups. Among these phthalocyanines, titanyl phthalocyanine including TiO as the center metal, chrologallium phthalocyanine, hydroxygallium phthalocyanine are particularly preferable in terms of the characteristics of an image bearing member. In addition, these phthalocyanines are known to have various kinds of crystal types, For example, titanylphthalocyanine has α, β, γ, m, Y, etc., and copper phthalocyanine has α, β, γ, etc. The characteristics of the metal phthalocyanines having the same center metal vary depending on the crystal type. The characteristics of the image bearing member using the phthalocyanine pigments having various kinds of crystal types are reported to change accordingly (refer to Denshi Shashin Gakkaishi. Vol. 29, issue 4 published in 1990). For this reason, the selection of the phthalocyanine crystal type of the metal phthalocyanine is extremely important in terms of the characteristics of the image bearing member.

Among these phthalocyanine pigments, the titanyl phtalocyanine crystal having an X-ray (Cu-Kα: wavelength of 1.542 Å) diffraction spectrum such that the main peak is observed at a Bragg (2θ) angle of 27.2±0.2° has particularly high sensitivity and is suitably used in the present disclosure in terms of high speed image formation.

Furthermore, among these, the phthalocyanine crystal having an X-ray diffraction spectrum such that the main peak is observed at a Bragg (2θ) angle of 27.2±0.2° with main peaks at 9.4±0.2°, 9.6±0.2°, and 24.0±0.2°, the peak on the lowest angle is observed at 7.3° with no peaks between 7.3° and 9.4° and no peak at 26.3° is extremely suitable as the charge generation material for use in the present disclosure because it has a great charge generation ratio and excellent electrostatic characteristics and hardly causes background fouling, etc. These charge generation materials may be used alone or in combination.

Small sized charge generation material is more effective in some cases. Particularly with regard to the phthalocyanine pigments, the average particle size is preferably 0.25 μm or less and more preferably 0.2 μm or less. The method of manufacturing the charg generation material is described below.

The particle size of the charge generation material contained in the photosensitive layer is controlled by a method of dispersing the charge generation material followed by removing coarse particles having a particle size larger than 0.25 μm. The average particle size represents the volume average particle diameter and is obtained by an ultra-centrifugal particle size distribution analyzer (CAPA-700, manufactured by Horiba, Ltd.) Median diameter, which corresponds to 50% of the cumulative distribution, is calculated as the volume average particle diameter.

However, this method involves a problem that a minute quantity of coarse particles are not detected in some cases. Thus, to be more correct, it is preferable to obtain the size by directly observing the charge generation material powder, or liquid dispersion with an electron microscope.

Next, the method of removing coarse particles after dispersion of the charge generation material is described.

That is, in the method, a liquid dispersion in which particles are caused to be as fine as possible is filtered with a suitable filter. The liquid dispersion is manufactured by a typical method in which a charge generaThe liquid dispersion is manufactured by a typical method in which a charge generation material and an optional binder resin are dispersed in a suitable solvent using a ball mill, an attritor, a sand mill, a bead mill, or ultrasonic.

The binder resin is selected based on the electrostatic characteristics of an image bearing member and the solvent is selected based on the wettability to a pigment and the dispersion property thereof.

This method is effective in that the coarse particles remaining in a minute quantity which are not observed by naked eyes (or detected by particle size measurement) are removed and the obtained particle size distribution is sharp. To be specific, the liquid dispersion prepared as described above is filtered by a filter having an effective pore diameter of 5 μm or less and preferably 3 μm or less. According to this method, a liquid dispersion containing only a charge generation material having a small particle size (0.25 μm or less and preferably 0.2 μm or less) is prepared, thereby improving the electrostatic characteristics such as sensitivity and chargeability of an image bearing member and sustaining the effect.

When the particle size of the liquid dispersion to be filtered is too large or the particle size distribution thereof is too wide, the loss by the filtration tends to be great, which leads to clogging, thereby making filtration impossible. Therefore, the liquid dispersion is preferably dispersed before filtration until the average particle size of 0.3 μm or less with a standard deviation of 0.2 μm or less is obtained. When the average particle size is too large, the loss by the filtration tends to be great. When the standard deviation is too large, the filtration time tends to be extremely long.

The charge generation material mentioned above has en extremely strong intermolecular hydrogen binding force, which is characteristic to a charge generation material having a high sensitivity. Therefore, the particles of the dispersed pigment particles have an extremely strong mutual action therebetween. As a result, the charge generation material particles dispersed by a dispersion device are highly likely to re-agglomerate by dilution, etc. Therefore, as described above, such agglomerated substance can be removed after the dispersion with a filter having a specific size or less. At this point, since the liquid dispersion is in thixotropic, particles having a size smaller than the effective pore diameter of the filter are also removed. Alternatively, the liquid having a structure viscosity is filtered to have a state close to Newtonian. Thus, removal of coarse particles of the charge generation material leads to improvement of effectiveness of the embodiments of the present disclosure.

In addition, among the azo pigments, the azo pigments represented by the chemical structure 4 are preferably used.

Particularly, asymmetry disazo pigment which has Cp1 different from Cp2 has an excellent carrier generation efficiency and thus is preferably used as the charge generation material for use in the present disclosure.

Chemical structure 4

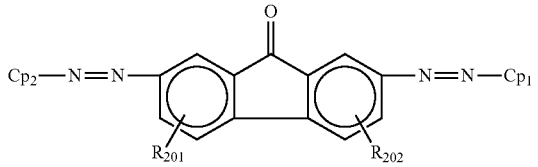

In Chemical structure 4, $Cp_1$ and $Cp_2$ represent coupler remaining groups. $R_{201}$ and $R_{202}$ independently represent hydrogen atom, a halogen atom, an alkyl group, an alkoxy group, and cyano group. $Cp_1$ and $Cp_2$ are represented by Chemical structure 5.

Chemical structure 5

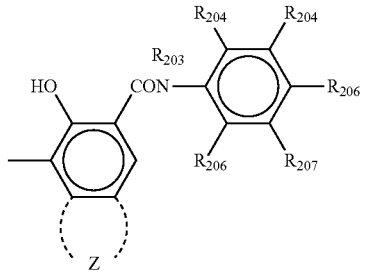

In Chemical structure 5, $R_{203}$ represents hydrogen atom, an alkyl group such as methyl group and ethyl group, and an aryl group such as phenyl group. $R_{204}$, $R_{205}$, $R_{206}$, $R_{207}$, and $R_{208}$ independently represent hydrogen atom, nitro group, cyano group, a halogen atom such as fluorine, chlorine, bromine and iodine, halogenized alkyl group such as trifluoromethyl group, an alkyl group such as methyl group and ethyl group, an alkoxy group such as methoxy group, and ethoxy group, dialkyl amino group, and hydroxyl group. Z represents a substituted or non-substituted carbon cyclic aromatic group or atom groups constituting a substituted or non-substituted heterocyclic aromatic group.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, polyacrylamides, polyvinyl benzale, polyester, phenoxy resin, copolymer of vinylchloride and vinyl acetate, polyvinyl acetate, polyphenylene oxide, polyvinylpyridine, cellulose based resin, casein, polyvinyl alcohol, and polyvinyl pyrolidone. These binder resins may be used alone or may be used as a mixture of two or more. The content of the binder resin is from 0 to 500 parts by weight and preferably from 10 to 300 parts by weight based on 100 parts by weight of the charge generation material. The optional binder resin can be added before or after dispersion of the charge generation material.

Specific examples of the solvents include, but are not limited to, known organic solvents such as isopropanol, acetone, methylethylketone, cyclohexanone, tetrahydrofuran, dioxane, ethylcellosolve, ethyl acetate, methylacetate, dichloromethane, dichloroethane, monochlorobenzene, cyclohexane, toluene, xylene, and ligroin. Among these, ketone based solvents, ester based solvents, and ether based solvents are preferably used. These can be used alone or as a mixture of two or more.

Liquid application of the charge generation layer is prepared by dispersing a charge generation material with an optional binder resin in a solvent with a known dispersion method such as a ball mill, an attritor, a sand mill, a bead mill, or unitrasonic. The optional binder resin can be added before or after dispersion of the charge generation material.

The liquid application of the charge generation layer is mainly formed of a charge generation material, a solvent, and a binder resin and may also contain additives such as a sensitizer, a dispersion agent, a surface active agent, and silicone oil. A charge transport material, which is described later, can be added to the charge generation layer. The addition amount of the binder resin is from 0 to 500 parts by weight and preferably from 10 to 300 parts by weight based on 100 parts by weight of the charge generation material.

The charge generation layer is formed by applying the liquid application mentioned above to an electroconductive substrate, an undercoating layer, etc. followed by drying.

Known methods such as a dip coating method, a spray coating method, a bead coating method, a nozzle coating method, a spinner coating method, and a ring coating method can be used as the application method.

The charge generation layer has a thickness of from about 0.01 to about 5 μm and more preferably from 0.1 to 2 μm.

The liquid application is heated and dried in an oven, etc. after application. The drying temperature of the charge generation layer is preferably from 50 to 160° C., and more preferably from 80 to 140° C. The drying temperature of the charge generation layer is preferably from 50 to 160° C., and more preferably from 80 to 140° C.

Charge Transport Layer

The charge transport layer assumes a charge transport function and is mainly formed of a charge transport material and a binder resin.

Although the charge transport layer of the present disclosure contains a positive hole transport material as the charge transport material, an electron transport material can be also contained, if desired. Specific examples of each are as follows: The charge transport materials represent positive hole transport materials and electron transport materials.

Specific examples of such electron transport material include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, diphenoquinone derivatives, and naphthalene tetracarboxylic acid diimide derivatives. These charge transport materials can be used alone or in combination.

Specific examples of the positive hole transport materials include, but are not limited to, poly(N-vinylvarbazole) and derivatives thereof, poly(γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, stilbene derivatives, α-phenyl stilbene derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, disstilbene derivatives, enamine derivatives and other known materials. Among these positive hole transport materials, materials having a tri-aryl amine structure are suitable for charge-transfer. These positive hole transport materials may be used alone or in combination.

Among the charge transport materials contained in the charge transport layer, distyryl compounds are suitable. Distyryl compounds represent materials having two styryl groups. These materials are of a large pi-conjugation and a high mobility so that transfer of charges easily occurs. As a result, in comparison with a charge transport material having a similar ion potential, distyryl materials are considered to be suitable to prevent a rise in the voltage in a bright portion. Furthermore, among these distyryl compounds, distyryl benzene derivatives represented by the following Chemical structure 2.

Chemical structure 2

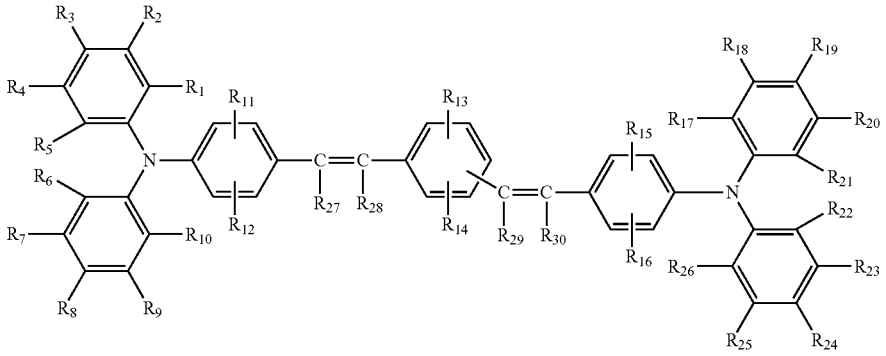

In the Chemical structure 2, $R_1$ to $R_{30}$ independently represent hydrogene atom, an alkyl group having one to four carbon atoms, an alkoxy group having one to four carbon atoms, an aryl group substituted by an alkyl group having one to four carbon atoms or an alkoxy group having one to four carbon atoms, a non-substituted aryl group, and a benzyl group substituted by an alkyl group having one to four carbon atoms or an alkoxy group having one to four carbon atoms.

Distyryl benzene derivatives represented by Chemical structure 2 are characteristic in that they contains multiple triaryl amine structures having a high charge transport function and pi-conjugation via the aromatic ring groups situated in the center of the chemical structure is high.

In addition, since distyryl benzene derivatives represented by Chemical structure 2 have a large molecular skeleton and the triaryl amine structures are distantly positioned, charges are easily transferred.

Distryl benzene derivatives for use in the present disclosure can be synthesized by the methods described in JP-2552695-B.

Specific examples of distryl compounds are as follows. However, the present disclosure is not limited thereto No.1

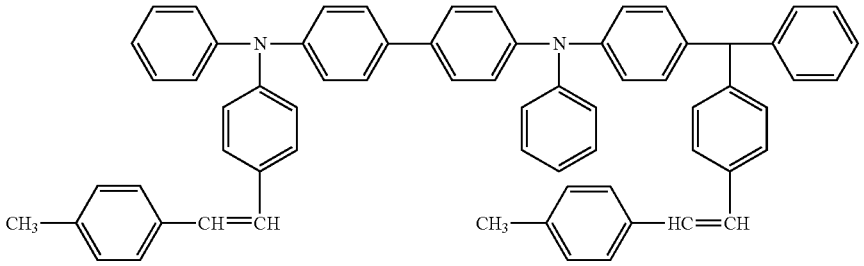

No.2

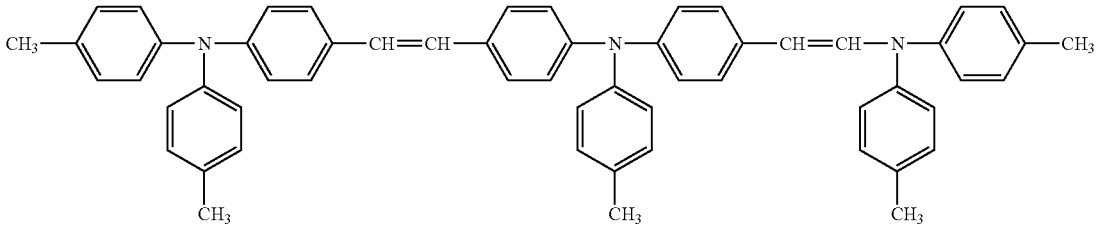

No.3

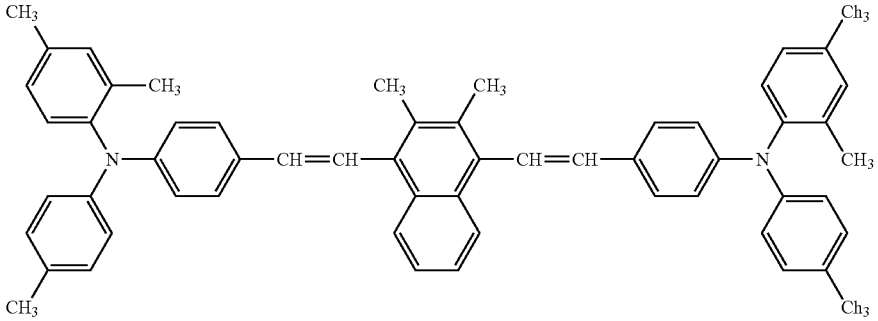

No.4

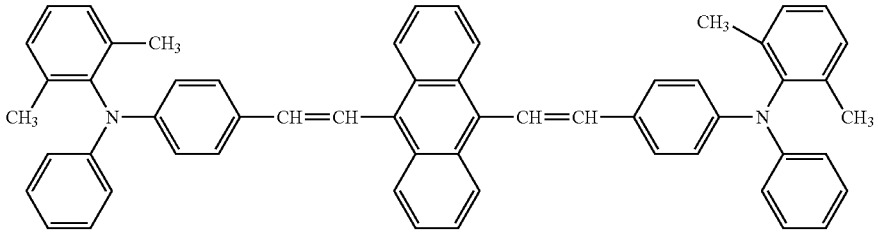

No.5

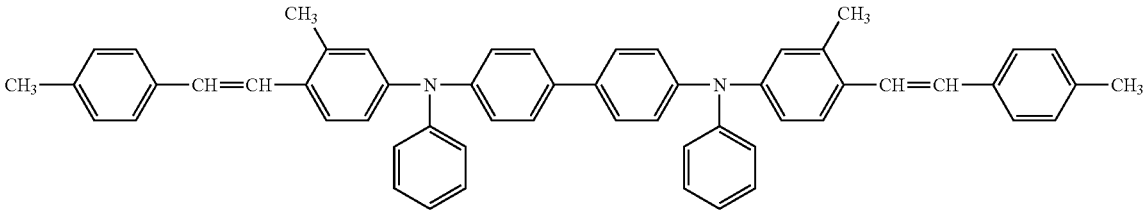

-continued
No.6
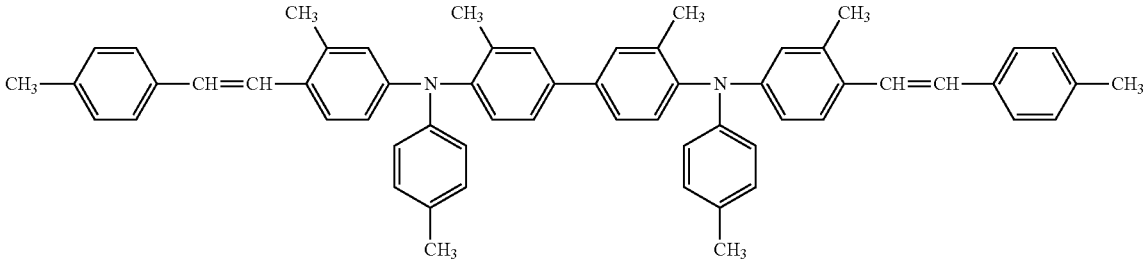
No.7
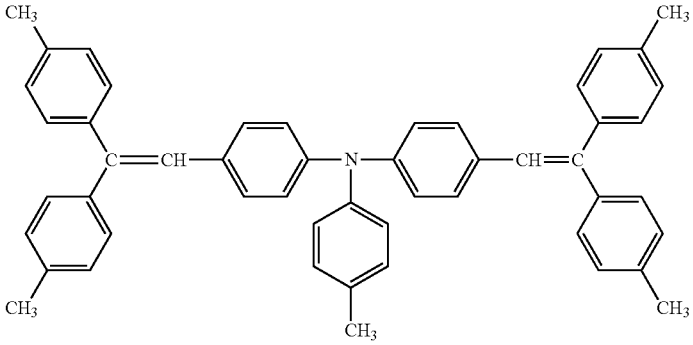
No.8
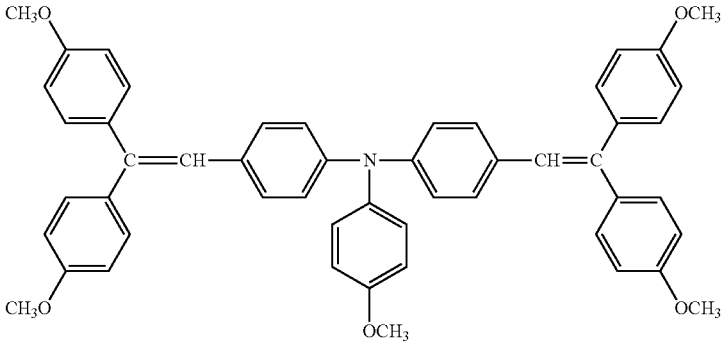
Specific examples of distryl benzene derivatives represented by the Chemical structure 2 are as follows. However, the present disclosure is not limited thereto
No.1
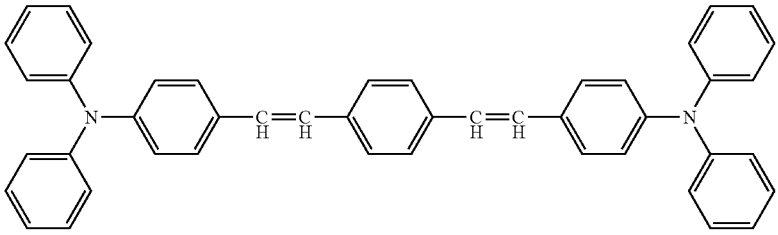

-continued
No.2
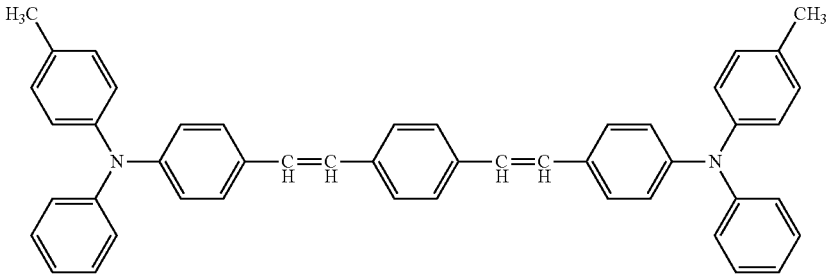
No.3
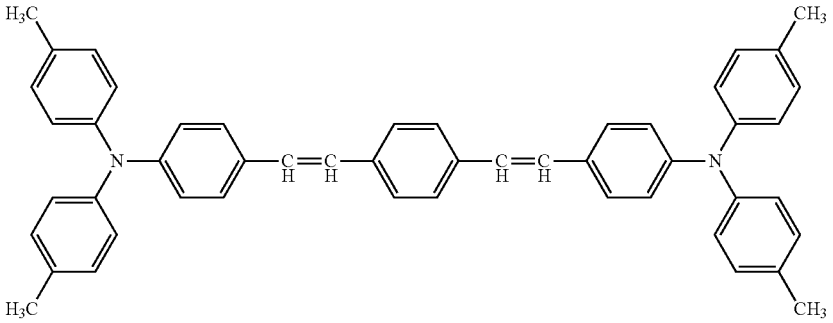
No.4
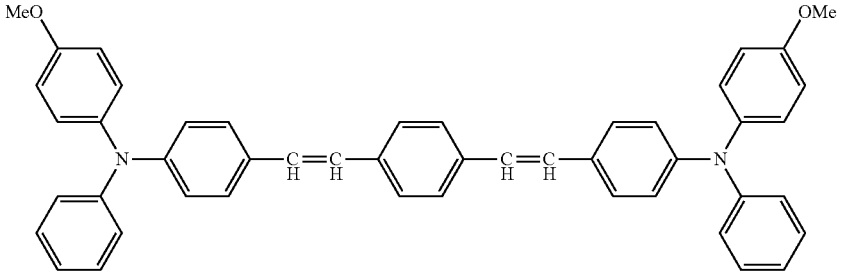
No.5
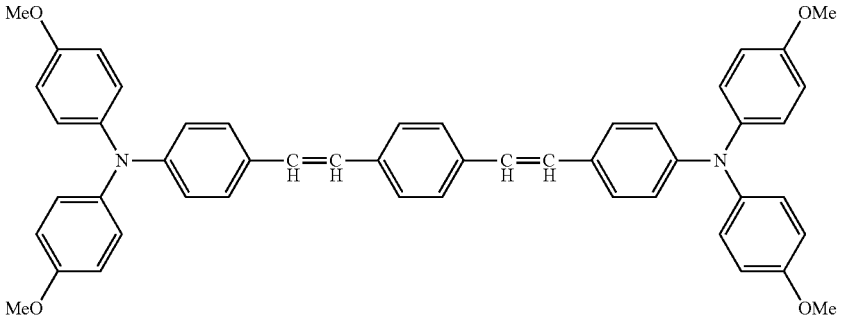
No.6
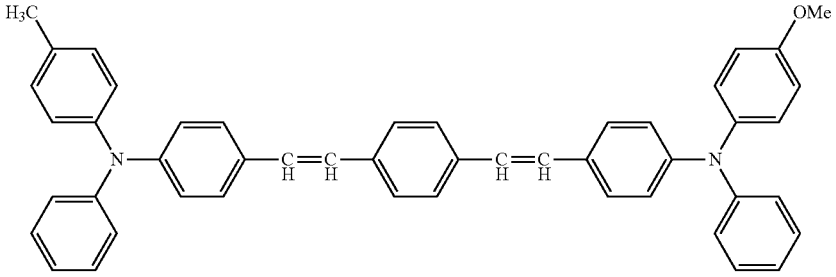

-continued
No.7
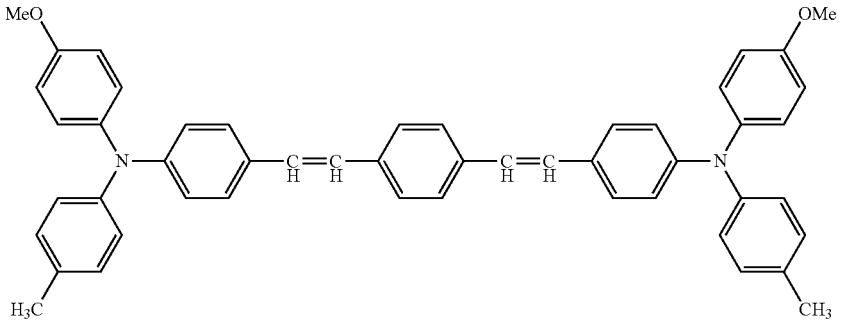
No.8
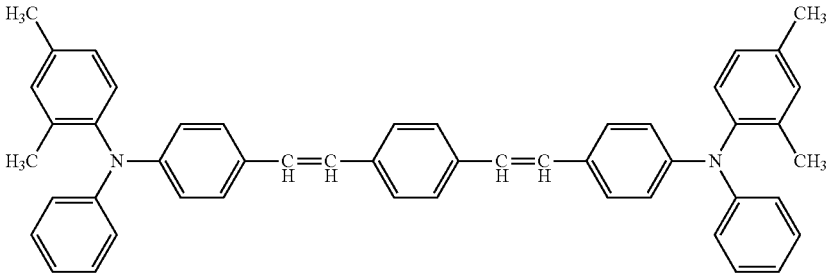
No.9
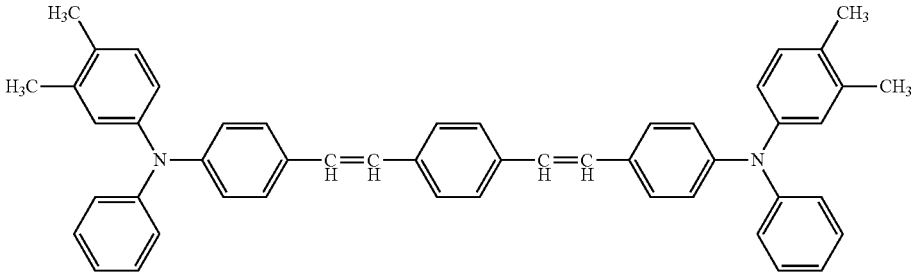
No.10
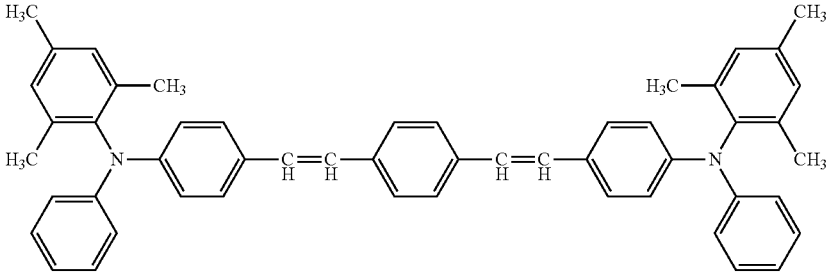
No.11
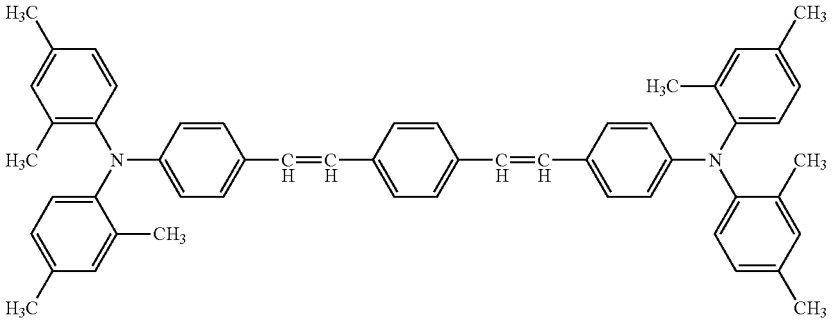

-continued
No.12
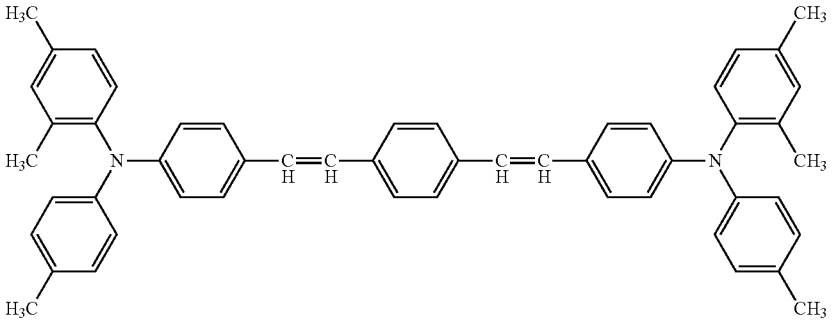
No.13
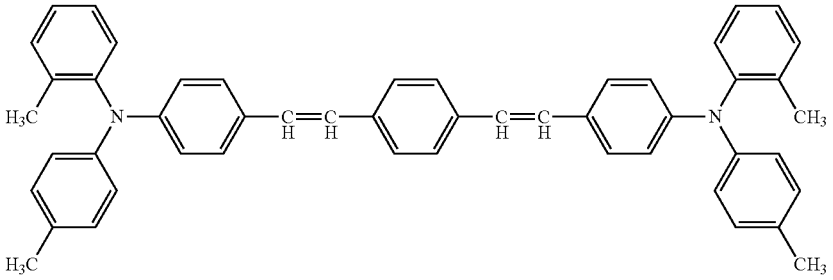
No.14
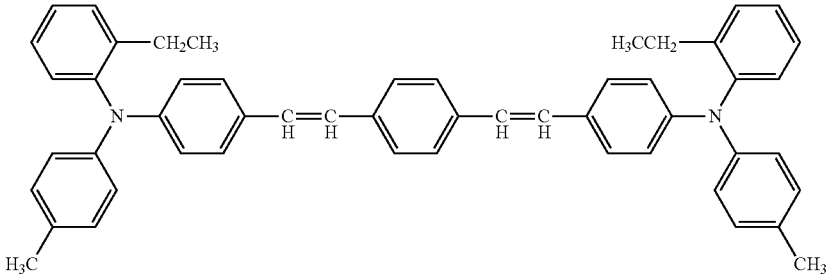
No.15
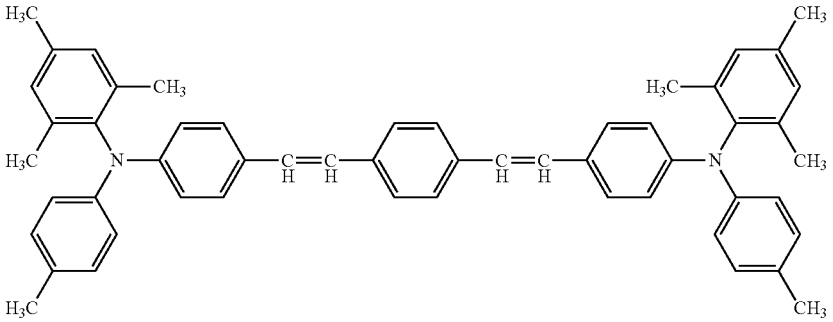
No.16
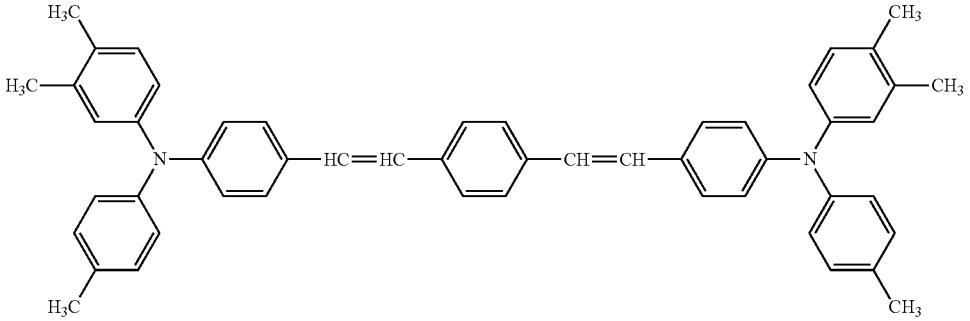

-continued
No.17
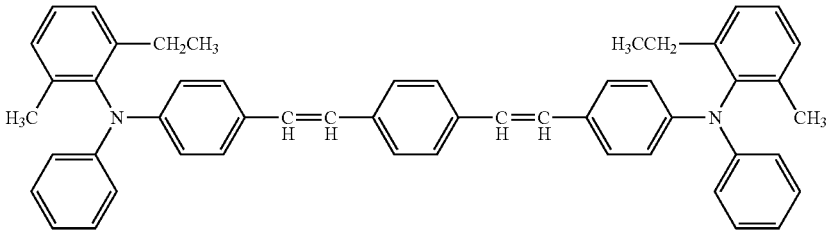
No.18
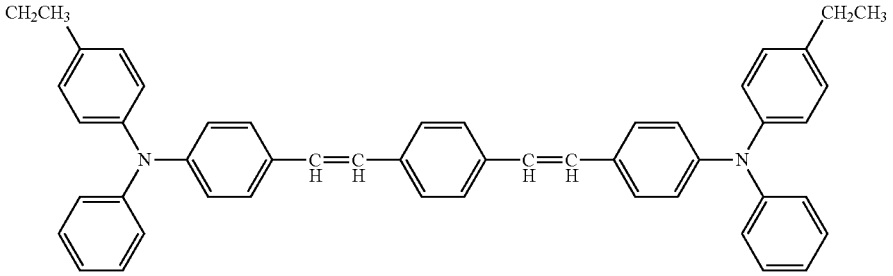
No.19
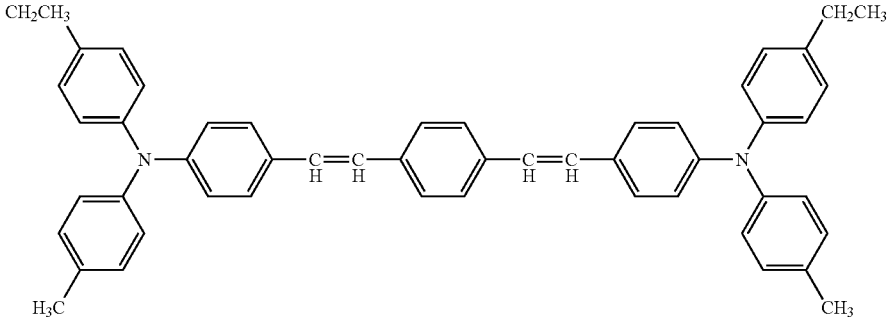
No.20
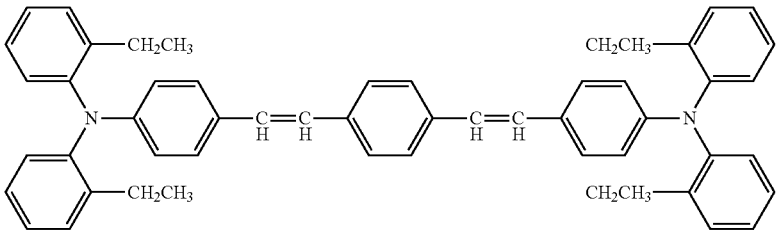
No.21
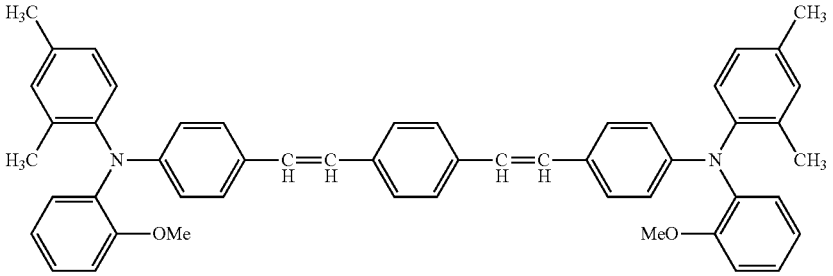

-continued
No.22
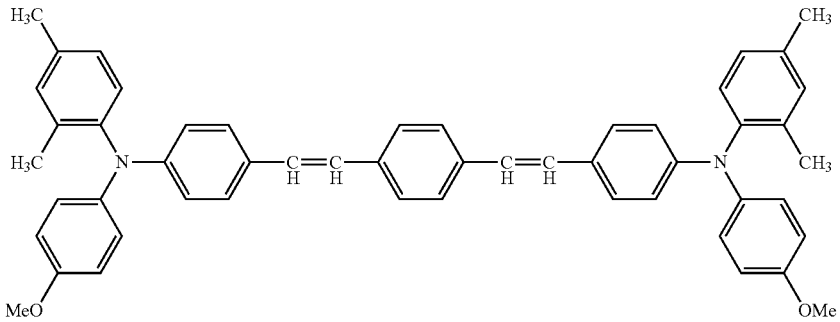
No.23
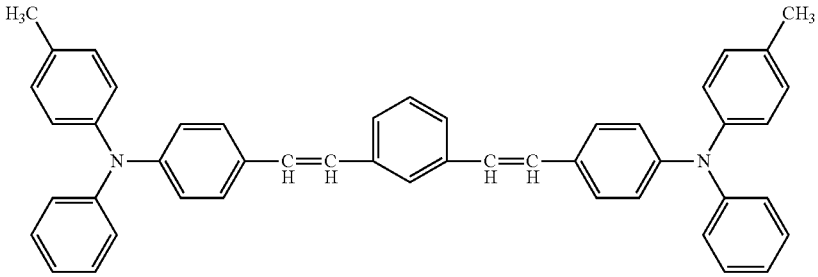
No.24
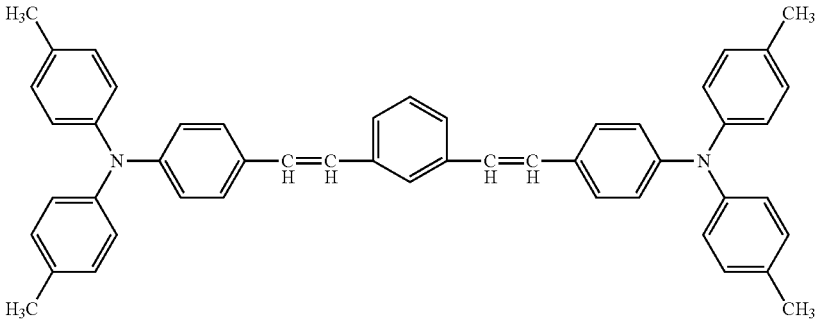
No.25
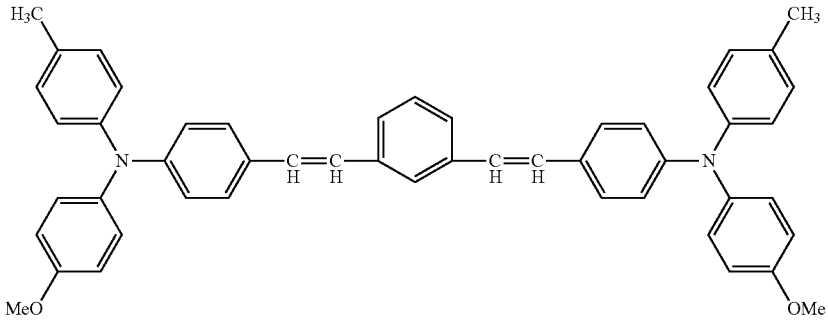
No.26
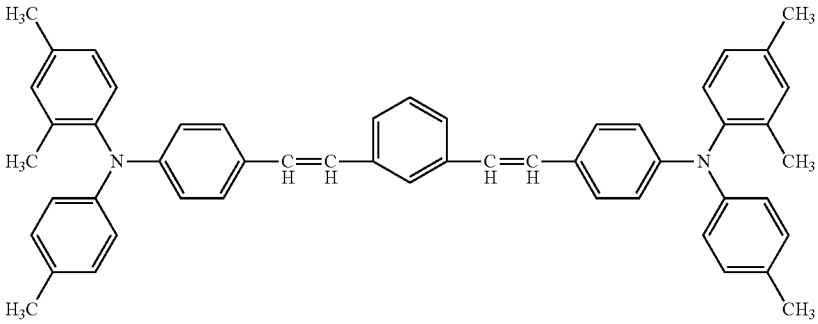

-continued
No.27
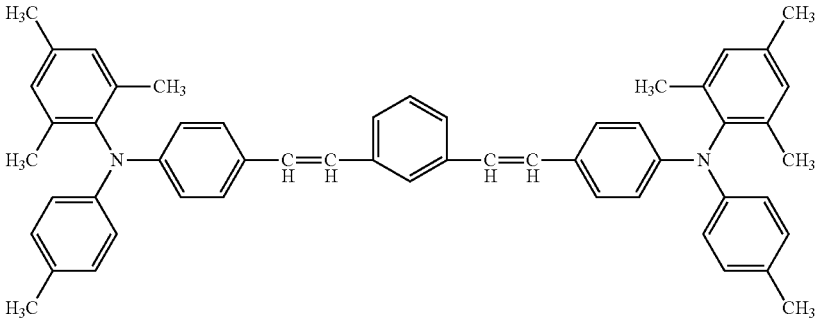
No.28
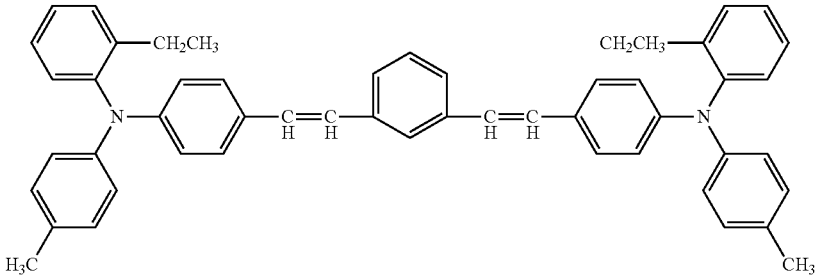
No.29
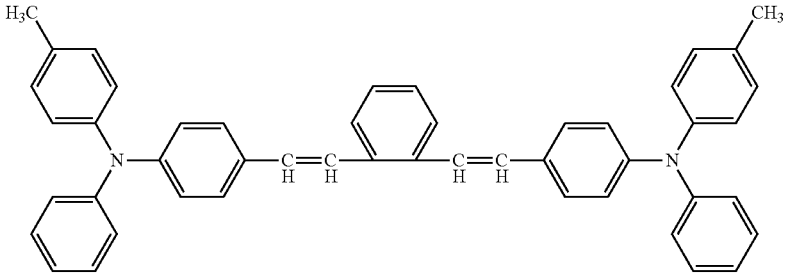
No.30
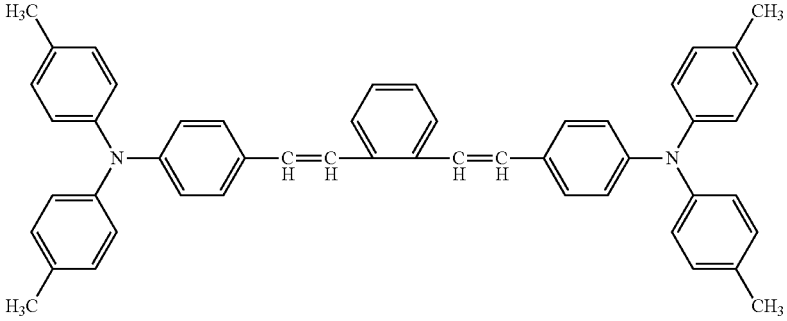
No.31
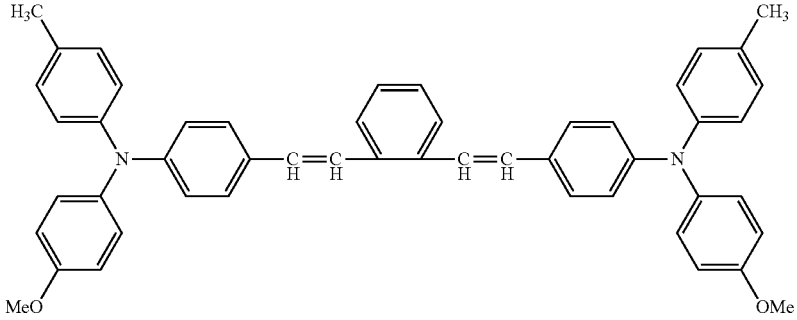

-continued
No.32
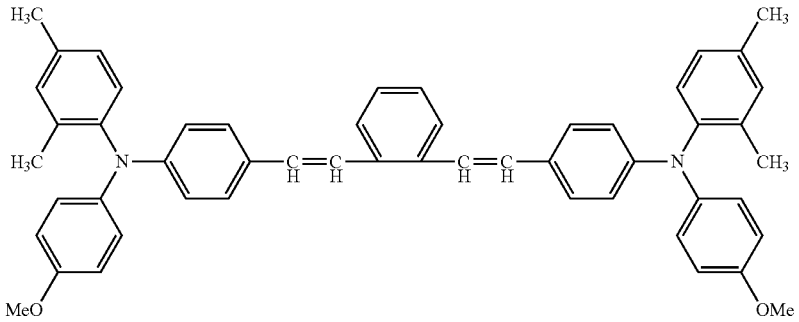
No.33
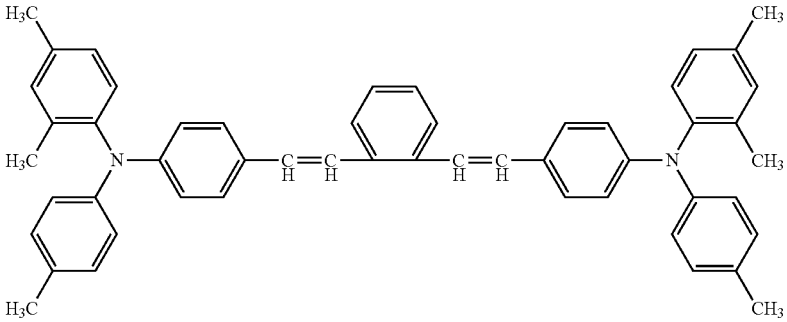
No.34
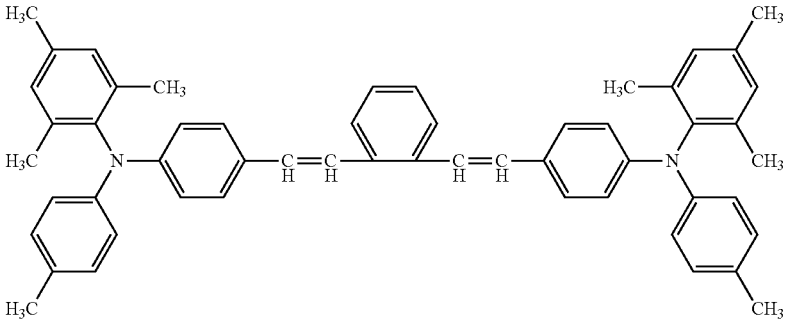
No.35
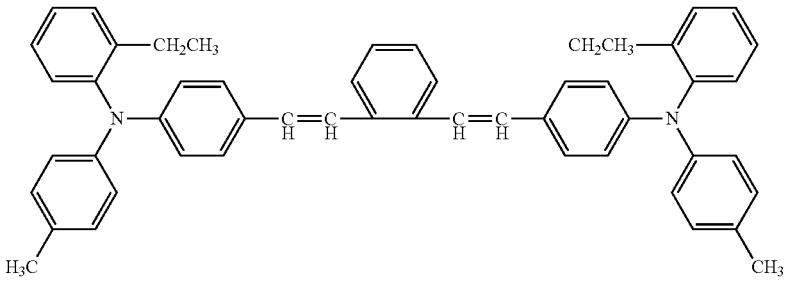
No.36
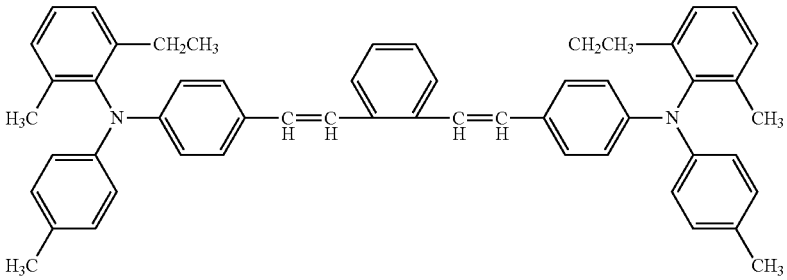

-continued
No.37
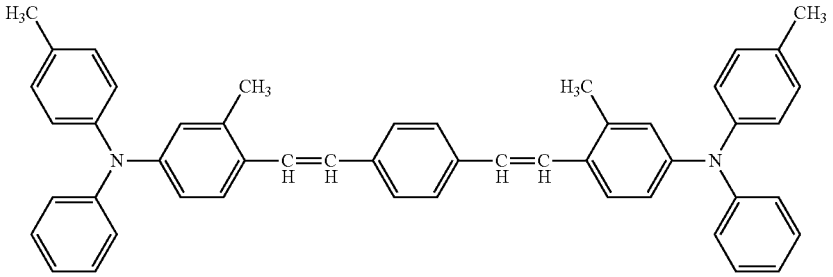
No.38
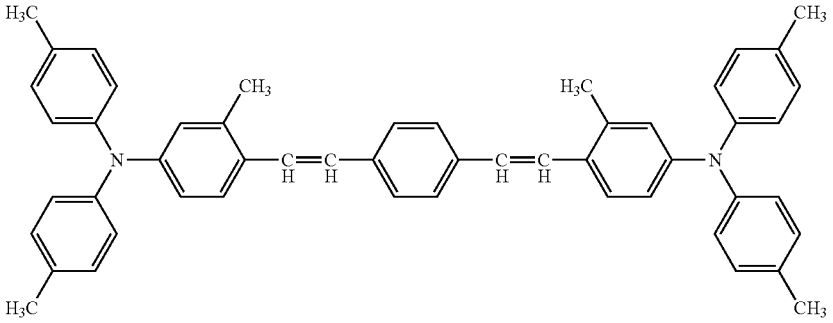
No.39
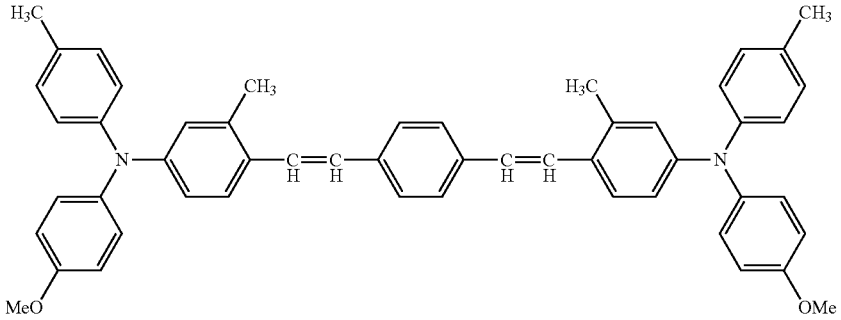
No.40
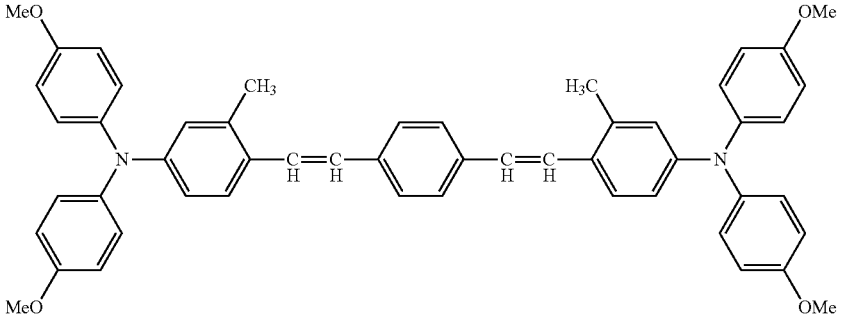
No.41
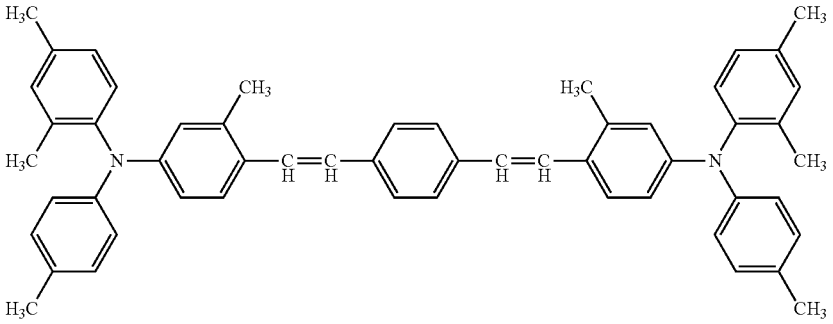

-continued
No.42
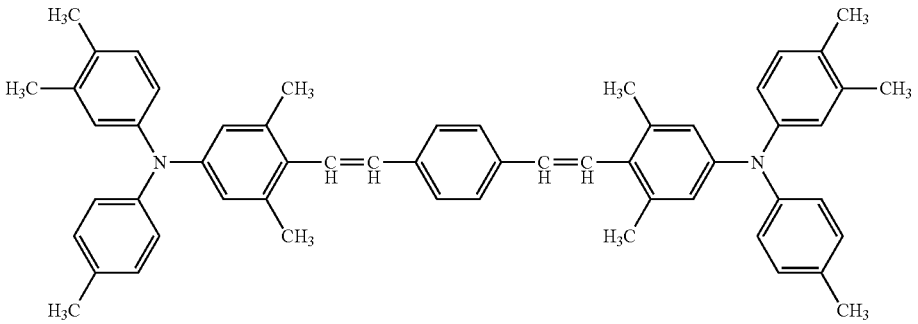
No.43
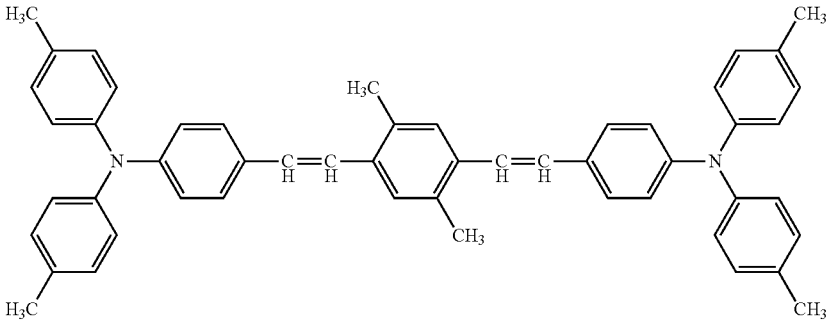
No.44
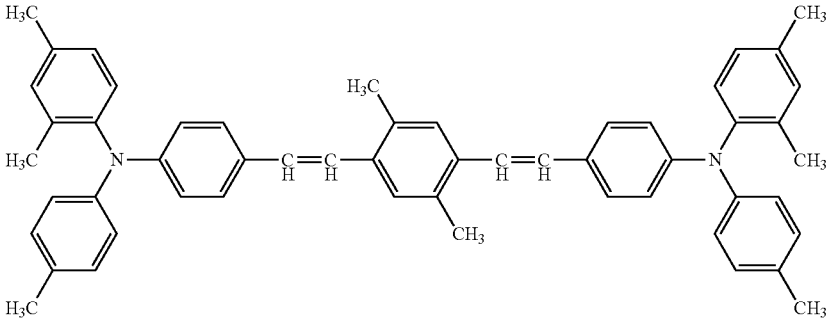
No.45
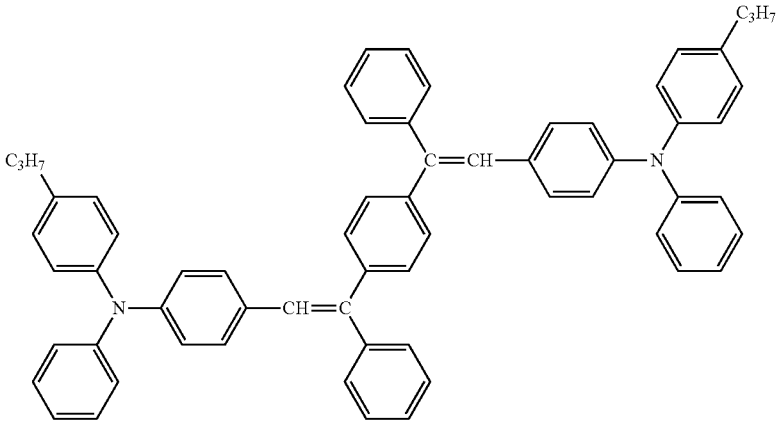

-continued
No.46
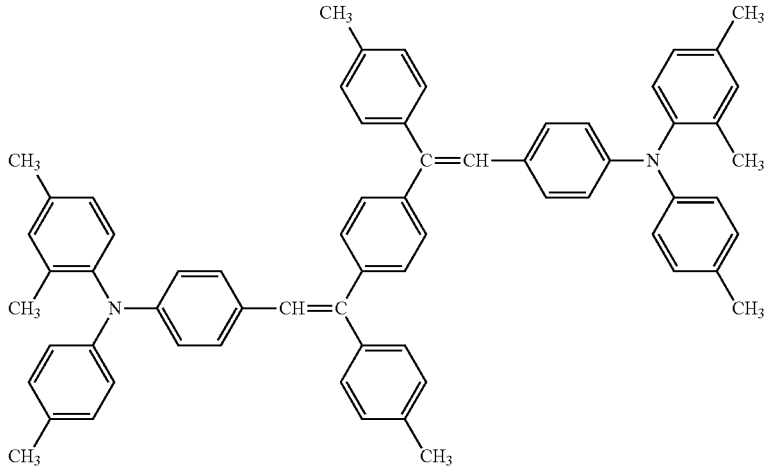
No.47
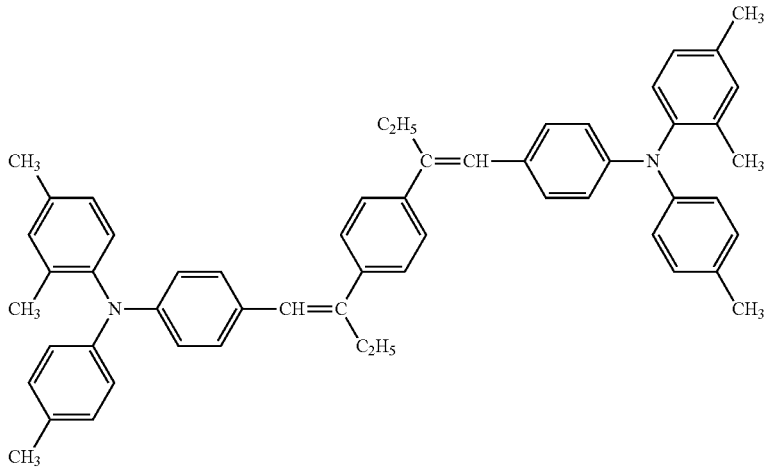
No.48
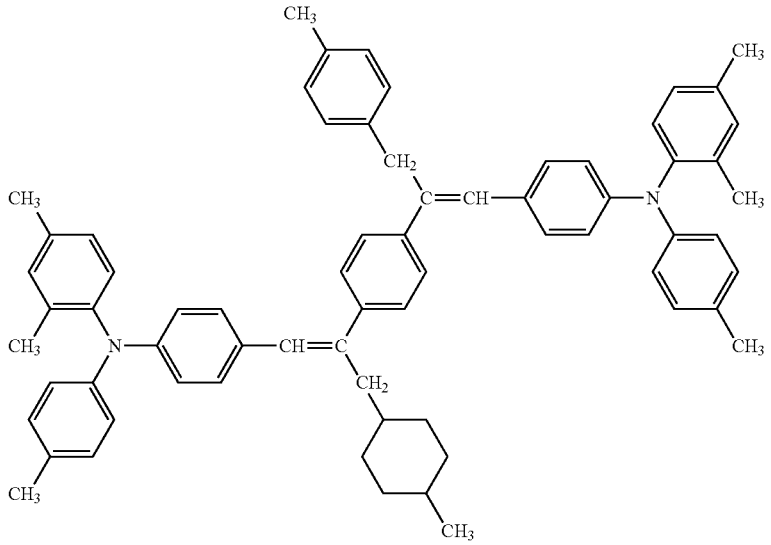

-continued
No.49
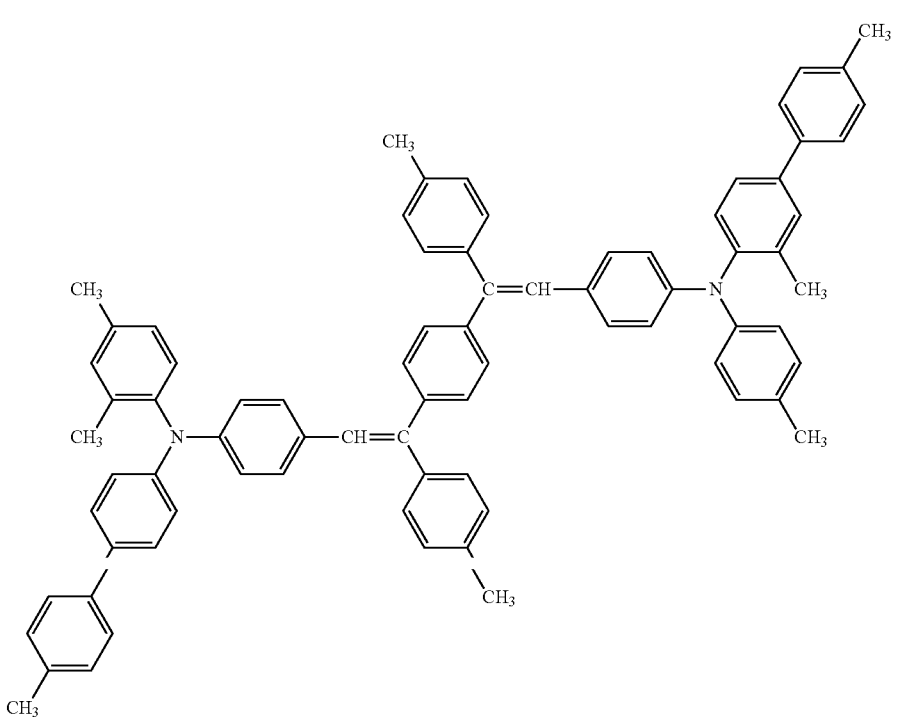
No.50
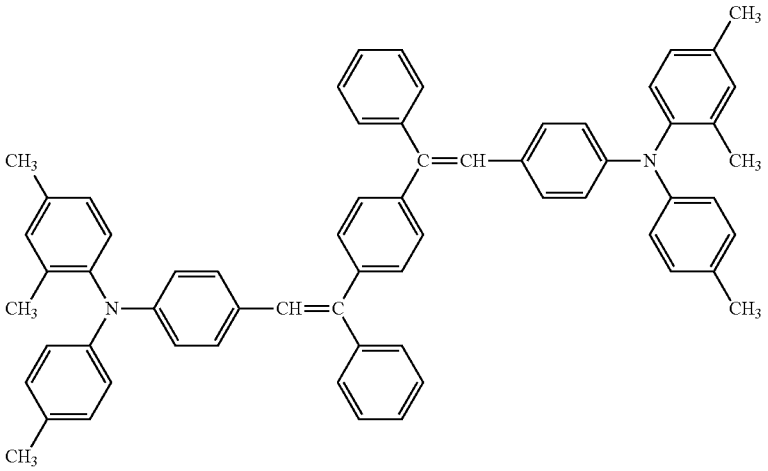
No.51
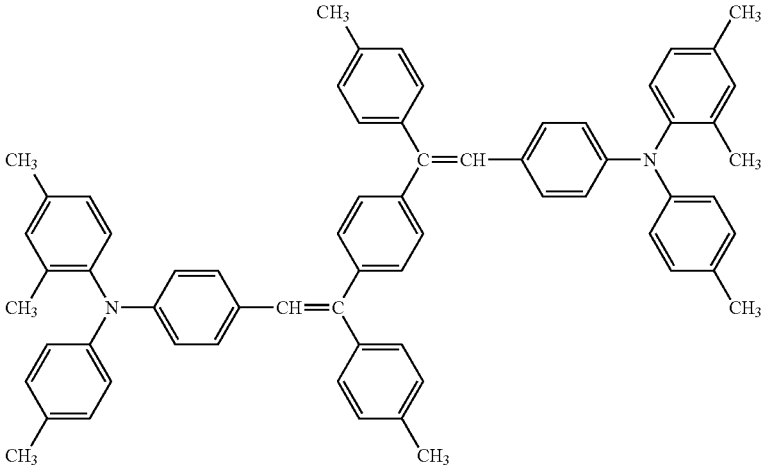

-continued

No.52

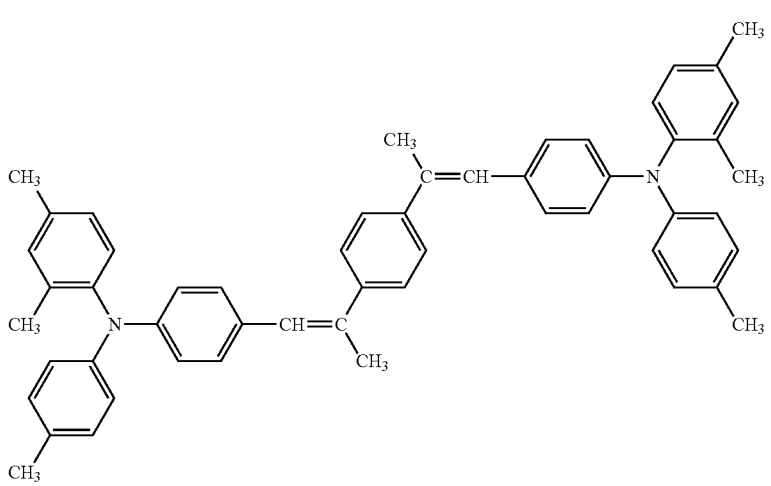

Specific examples of the binder resins contained in the charge transport layer include, but are not limited to, thermoplastic resins, or thermosetting resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

The content of the charge transport material contained in the transport layer is from 20 to 300 parts by weight and preferably from 40 to 150 parts by weight based on 100 parts by weight of the binder resin.

Specific examples of the solvent for use in the liquid application for the charge transport layer include, but are not limited to, tetrahydrofuran, dioxane, toluene, dichloromethane, monochlorobenzene, dichloroethane, cyclohexanone, methylethylketone, and acetone. These solvents can be used alone or in combination.

In addition, a plasticizing agent and/or a leveling agent can be added, if desired. Specific examples of the plasticizing agent for use in the charge transport layer include known resins such as dibutyl phthalate and dioctyl phthalate. The addition amount of the plasticizing agent is preferably from 0 to 30 parts by weight based on 100 parts by weight of the binder resin. Specific examples of the leveling agent for use in the charge transport layer include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1 part by weight based on 100 parts by weight of the binder resin.

The thickness of the charge transport layer is preferably 30 μm or less and more preferably 25 μm or less in terms of the resolution and responsiveness. Although depending on the property (charging voltage in particular) of the system, the lower limit is preferably 5 μm or more.

Other Additives

Furthermore, in the present disclosure, an anti-oxidizing agent can be added to each layer, i.e., the cross-linked charge transport layer, the charge generation layer, the charge transport layer, the undercoating layer, and ther layers such as an intermediate layer to improve the stability of the image quality.

Specific examples of the anti-oxidizing agent include, but are not limited to, the following:

Phenol Compounds 2,6-di-t-butyl-p-cresol, butylated hydroxyanisol, 2,6-di-t-butyl-4-ethylphenol, stearyl-p-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Sulfur Compounds dilauryl-3,3-thiodipropionate, distearyl-3,3'-thiodipropionate, and ditetradecyle-3,3□ f-thiodipropionate.

Organic Phosphorous Compounds triphenyl phosphine, tri(nonylphenyl)phosphine, tri(dinonylphenyl)phosphine, tricresyl phosphine, and tri(2,4-dibutylphenoxy)phosphine.

These compounds are known as anti-oxidants for rubber, plastic, and oils and marketed products thereof can easily be obtained.

The addition amount of the anti-oxidizing agent is preferably from 0.01 to 10 parts by weight based on the total weight of the layer to which the anti-oxidizing agent is added.

Cross-Linked Type Charge Transport Layer

The photosensitive layer and the cross-linked type charge transport layer may contain the aryl methane compounds represented by chemical formulae 2 to 5 described in JOP-2007-27968-A, the compound represented by chemical formula 2 described in JOP-2007-272192-A in particular, and the compounds represented by chemical formula 2 and 3 described in JOP-2007-272191-A. Theses compounds are suitable because they have an anti-oxidizing function and a charge transport function.

Next, the material forming the cross linked type charge transport layer for use in the present disclosure is described. Since the cross-linked type charge transport layer transports charges while maintaining the abrasion resistance, the layer is formed of a radical polymerizable monomer having no charge transport structure or a radical polymerizable oligomer having no charge transport structure, a radical polymerizable compound having a charge transport structure, and a copolymer having a cyclic structure and/or a structure represented by Chemical structure 1 as the repeating unit. More preferably, the cyclic structure of the copolymer is formed of a saturation bonding between carbon atoms and the number of carbon atoms forming the cyclic structure is at least six.

In addition, it is suitable to form a cured material of a radical polymerizable monomer having no charge transport structure and/or a radical polymerizable oligomer having no charge transport structure, and a radical polymerizable compound having a charge transport structure.

Thereby, the layer separation structure becomes more solid. "Oligomer" in this specification represents a polymer having a repeating unit while the repeating number of the representing unit is from 2 to 10.

The cross-linked charge transport layer is cured and excellent in mechanical durability. In addition, the cross-linked charge transport layer has an excellent releasing property. This mechanism is not clear but the thinkable reason why this layer has an excellent releasing property is that the copolymer is layer-separated and thus the surface has a fine sea-island structure. Due to this structure, the contact area between the surface and toner and/or foreign objects decreases, thereby reducing the force of attachment.

Furthermore, the copolymer having the structure represented by the chemical structure 1 has lubricity ascribable to the long chain hydrocarbon group, thereby improving the releasing property of the surface.

Curing generally represents reaction in which three-dimensional network structure is formed by intermolecular reaction of a compound having a small molecular weight with multiple functional groups or an intermolecular bonding (ex. covalent bonding) caused by applying energies such as heat, light, electron beams, etc. to a polymer.

Radical polymerizable compound having no charge transport structure is a kind of curable resins. Specific examples of such curable resins include, but are not limited to, thermocuring resins polymerized by heat, optical curable resins polymerized by light such as ultraviolet and optical light, electron beam curable resins polymerized by electron beam, etc. Optionally, curing agents, catalysts and polymerization initiators are used together in combination.

Reactive compounds such as monomers or oligomers that include a functional group that causes polymerization reaction are used to cure the curable resin specified above. A specific example of these functional groups is acryloyloxy group and/or methacryloyloxy group. In addition, in the curing reaction, as the number of functional groups contained in one molecule of a reactive monomer increases, the obtained three dimensional network structure is solid and firm. Therefore, containing three or more functional groups in one molecule is preferable.

Therefore, the curing density is high, thereby improving the hardness, elasticity, uniformity, and smoothness of the surface layer, which leads to improvement of the durability of the surface of an image bearing member and the image quality.

In the present disclosure, as described above, a three dimensional developed network is formed on an electroconductive substrate by curing reaction between a polymerizable compound having a charge transport structure and a polymerizable monomer or oligomer having no charge transport structure. The surface can be more hardened by preliminarily admixing a curing agent, a catalyst, and a polymerization initiator, which is particularly suitable in the present disclosure. Therefore, the cross-linked type charge transport layer has an increased abrasion resistance and non-reactive functional groups hardly remain, which leads to prevention of deterioration of the electrostatic characteristics and improvement of the abrasion resistance. In addition, since the reaction proceeds uniformly, cracking and distortion tends to hardly occur.

The radical polymerizable compound having no charge transport structure represents a monomer or oligomer having a radical polymerizable functional group without a positive hole transfer structure such as triaryl amine, hydrazone, pyrazoline, or carbazole, or an electron transport structure such as condensed polycyclic quinone, diphenoquinone or an electron suction aromatic ring having a cyano group or a nitro group. The radical polymerizable functional group represents any radical polymerizable functional group which has a carbon-carbon double bond. For example, 1-substituted ethylene functional groups and 1,1-substituted ethylene functional groups are suitably used as the radical polymerizable functional groups.

(1) 1-Substituted Ethylene Functional Group

A specific example of 1-substituted ethylene functional groups is the functional group represented by the following chemical formula 1.

$$CH_2{=}CH{-}X_1{-} \qquad \text{Chemical formula 1}$$

In the chemical formula 1, $X_1$ represents an arylene group such as a substituted or non-substituted phenylene group, and a naphthylene group, a substituted or non-substituted alkenylene group, —CO—, —COO—, —$CONR_{78}$) (where $R_{78}$ represents hydrogen, an alkyl group such as methyl group and ethyl group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

(2) 1,1-Substituted Ethylene Functional Group

A specific example of 1,1-substituted ethylene functional groups is the functional group represented by the following chemical formula 2.

$$CH_2{=}CY{-}X_2{-} \qquad \text{Chemical formula 2}$$

In the chemical formula 2, Y represents a substituted or non-substituted alkyl group, a substituted or non-substituted aralkyl group, an aryl group such as a substituted or non-substituted phenyl group and naphtylene group, a halogen atom, cyano group, nitro group, an alokoxy group such as methoxy group and ethoxy group, —$COOR_{79}$ ($R_{79}$ represents hydrogen atom, an alkyl group such as a substituted or non-substituted methyl group and ethyl group, an aralkyl group such as a substituted or non-substituted benzyl group, naphthylmethyl group, and phenethyl group, an aryl group such as substituted or non-substituted phenyl group and naphtyl group or —$CONR_{80}R_{81}$ ($R_{80}$ and $R_{81}$ independently represent a hydrogen atom, an alkyl group such as a substituted or non-substituted methyl group and ethyl group, an aralkyl group such as a substituted or non-substituted benzyl group, naphthyl methyl group, and phenethyl group, or an aryl group such as substituted or non-substituted phenyl group and naphtyl group). $X_2$ represents a single bond, the same substitution group as $X_1$ in the Chemical formula 1, or an alkylene group. At least one of Y and $X_2$ is an oxycarbonyl group, cyano group, an alkenylene group, and an aromatic ring. Specific examples of these functional groups include, but are not limited to, α-acryloyloxy chloride group, methacryloyloxy group, α-cyanoethylene group, α-cyanoacryloyloxy group, α-cyanophneylene group and methacryloyl amino group.

Specific examples of substitution groups further substituted to the substitution groups of $X_1$, $X_2$ and Y include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these polymerizable functional groups, acryloyloxy group and methacryloyloxy group are particularly preferable.

With regard to the number of the functional groups of the radical polymerizable monomer or oligomer having no charge transport structure, the greater, the better. Particularly, a polymerizable compound having 3 or more functional groups is preferable. When a radical polymerziable monomer or oligomer having three or more functional groups is cured, a three dimensional network structure is developed and thus a layer having an high hardness and a high elasticity with an extremely high density is obtained. In addition, the resultant layer demonstrates a high abrasion resistance and damage resistance. However, since a great number of bondings are instantly formed in the curing reaction depending on the curing condition and materials, volume contraction or internal stress may occur, which leads to cracking or peeling-off of the layer. If this is the case, a radical polymerizable compound having one or two functional groups or a mixture thereof is used to deal with the problems such cracking or peeling-off.

Next, the radical polymerizable monomer or oligomer having no charge transport structure with three or more functional groups suitable to improve the abrasion resistance is described.

A compound having at least three acryloyloxy groups is obtained by conducting ester reaction or ester conversion reaction using, for example, a compound having at least three hydroxyl groups therein and an acrylic acid (salt), a halide acrylate, and an ester of acrylate. A compound having at least three methacryloyloxy groups is obtained in the same manner.

In addition, the radical polymerizable functional groups in a monomer having at least three radical polymerizable functional groups can be the same or different from each other.

The radical polymerizable monomer having no charge transport structure include the following compounds, but are not limited thereto.

Specific examples of the radical polymerizable monomer having no charge transport structure include, but are not limited to, trimethylol propane triacrylate (TMPTA), trimethylol propane trimethacrylate, HPA-modified trimethylol propane triacrylate, EO-modified trimethylol propane triacrylate, PO-modified trimethylol propane triacrylate, caprolactone-modified trimethylol propane triacrylate, ECH-modified trimethylol propane triacrylate, HPA-modified trimethylol propane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanulate, alkyl-modified dipenta erythritol tetraacrylate, alkyl-modified dipenta erythritol triacrylate, dimethyl propane tetraacrylate (DTMPTA), pentaerythritol ethoxy tetraacrylate, DO-modified triacrylate phosphate, 2,2,5,5-tetrahydroxymethyl cyclopentanone tetraacrylate, 2-ethylhexyl acrylate, 2-hydroxyethyl acrylate, 2-hydroxy propyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxy triethylene glycol acrylate, phenoxytetraethylene glycol acrylate, cetyl acrylate, isostaryl acrylate, stearyl acrylate, styrene monomer, 1,3-butane diol diacrylate, 1,4-butane diol diacrylate, 1,4-butane diol dimethacrylate, 1,6-hexane diol diacrylate, 1,6-hexane diol dimethacrylate, diethylene glycol diacrylate, neopentyl glycol diacrylate, EO-modified bisphenol A diacrylate, EO-modified bisphenol F diacrylate, and neopentyl glycol diacrylate. Among these, trimethylol propane triacrylate (TMPTA), HPA-modified trimethylol propane triacrylate, EO-modified trimethylol propane triacrylate, PO-modified trimethylol propane triacrylate, and ECH-modified trimethylol propane triacrylate are preferable. Ethyleneoxy modified, propyleneoxy modifified, epichloridone modified, and alkylene modified are represented by EO-modified, PO-modified, ECH-modified, and HPA-modified, respectively.

Specific examples of the radical polymerizable oligomers include, but are not limited to, an epoxy acrylate based oligomer, a urethane acrylate based oligomer, and a polyester acrylate based oligomer. These can be used alone or in combination.

In addition, the radical polymerizable monomer or oligomer having three or more functional groups without having a charge transport structure for use in the present disclosure preferably has a ratio (molecular weight/the number of functional groups) of the molecular weight to the number of functional groups in the monomer not greater than 250 to form a dense cross linking bonding in a cross-linked type charge transport structure. Furthermore, when the ratio (molecular weight/the number of functional groups) is too large, the cross-linked type charge transport layer formed of such a monomer is soft and thus the abrasion resistance of the cross-linked type charge transport layer tends to deteriorate. Therefore, among the monomers specified above, usage of a monomer having an extremely long modified (e.g., EO, PO, or caprolactone modified) group is not suitable.

The radical polymerizable monomer or oligomer having three or more functional groups without having a charge transport structure is suitable to improve the hardness of the layer. Also, a radical polymerizable monomer or oligomer having one or two functional groups without having a charge transport structure can be suitably used and is extremely suitable depending on materials. Any known radical polymerizable monomers and oligomers can be used.

Specific examples of such radical polymerizable monomers having one functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymerizable monomer having two functional groups include, but are not limited to, 1,3-butane diol diacrylate, 1,4-butane diol diacrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of the other monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; and a vinyl monomer, an acrylate, or a methacrylate having a polysiloxane group having 20 to 70 siloxane repeating units such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl described in unexamined published Japanese patent applications nos. JP-H05-60503-A and JP-H06-45770-A.

Specific examples of the radical polymerizable oligomers include, but are not limited to, an epoxy acrylate based oligomer, a urethane acrylate based oligomer, and a polyester acrylate based oligomer.

In addition, the ratio of the total of the first component (=the copolymer having a cyclic structure or the copolymer having the structure represented by the chemical structure 1 as a repeating unit) and the second component (=the radical polymerizable monomer and/or oligomer having no charge transport structure is from 20 to 80% by weight and preferably from 30 to 70% by weight based on the total weight of the cross-linked type charge transport layer. When the total content of the first component and the second component is too small, the density of three-dimensional cross-linking bonding in a cross-linked type charge transport layer tends to be low. Therefore, the abrasion resistance thereof is not drastically improved in comparison with a case in which a typical thermal plastic binder resin is used. A total content of the first component and the second component that is too large means that the content of charge transport compound decreases, which may cause degradation of the electric characteristics. Desired electrostatic characteristics and abrasion resistance vary depending on the process used. Therefore, it is difficult to jump to any conclusion about the thickness of the cross-linked type charge transport layer of the image bearing member for use in the present disclosure but considering the balance of both, the range of from 30 to 70% by weight is most preferable.

In addition, the mass ratio of the first component is preferably from 0.1 to 10% based on the total content of the first component, the second component, and the third component. When the mass ratio is too small, the releasing property tends to slightly deteriorate. This is thought to be because the layer separation becomes insufficient so that fine concave-convex structure is hardly formed. In addition, when the mass ratio is too large, the residual voltage tends to slightly increase. This is thought to be because the charge transport property slightly deteriorates.

Next, the polymer having the structure represented by the Chemical structure 1 contained in the cross-linked type charge transport layer for use in the present disclosure is described.

(1)

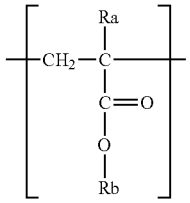

In the Chemical structure 1, Ra represents hydrogen atom or methyl group. Rb represents a straight-chained saturated aliphatic hydrocarbon group having 8 to 34 carbon atoms.

Raw materials are polymerized by a known method to manufacture the structure represented by the Chemical structure 1. A specific example of the raw material is a radical polymerizable compound obtained by esterification of acrylic acid or methacrylic acid and a long-chained saturated aliphatic first alcohol having 8 to 34 carbon atoms.

The kind of the alcohol can be suitably determined depending on the hydrocarbon group portion of a target structure. A saturated higher alcohol having 8 to 34 carbon atoms is suitably used. Specific examples thereof include, but are not limited to, straight-chained aliphatic monovalent alcohol having 8 to 34 carbon atoms such as 1-octanol, 1-nonanol, 1-decanol, 1-undecanol, 1-dodecanol, 1-tridecanol, 1-tetradecanol, 1-pentadecanol, 1-hexadecanol, 1-heptadecanol, 1-octadecanol, 1-nonadecanol, 1-ocpsanol. 1-henicosanol, 1-docosanol, 1-tricosanol, 1-tetracosanol, 1-hexacosanol, 1-octacosanol, 1-triacontanol, 1-dotriacontanol, and 1-tetratriacontanol. Reaction of acrylic acid or methacrylic acid and alcohol proceeds by dehydrated esterification reaction. Water is produced during this estrification reaction. It is preferable to conduct the reaction while removing the by-product of water.

When acrylic acid or methacrylic acid reacts with alcohol, a catalyst and a polymerization inhibitor can be suitably used.

Specific examples of the catalyst include, but are not limited to, sulfuric acid, paratoluene sulfonate, benzene sulfonate, xylene sulfonate, and methane sulfonate. These can be used alone or in combination. Among these, paratoluene sulfonate is preferable. The content of the catalyst is from 0.001 to 0.1 mol and preferably from 0.01 to 0.05 mol based on 1 mol of alcohol.

Specific examples of the polymerization inhibitor include, but are not limited to, phenol-based compounds such as hydroquinone (hydroquinone monomethyl ether), 2,6-di-t-butyl-4-methylphenol, 4,4'-butylidene-bis(3-methyl-6-t-butylphenol), 2,2-methylene-bis(4-methyl-6-t-butylphenol), 2,2'-methylene-bis(4-ethyl-6-t-butylphenol), 2,4'-thio-bis[3-methyl-6-t-butylphenol), 3-(4'-hydroxy-3',5'-di-t-butylphenyl)propionic acid-n-octadecyl, 1,3,5-tris(3',5'-di-t-butyl-4-hydroxybenzyl)isocyanurate, 1,1,3-tris(2-methyl-4-hydroxy-5-t-butylphenyl)butane, butylidene (methylbutylphenol), tetrabis[methylene-3-(3'-5'-di-t-butyl-4'-hydroxyphenyl)propionate]methane, 3,6-dioxaoctamethylene-bis[3-(3-t-butyl-4-hydroxy-5-methylphenyl)propionate}, 1,3,5-trimethyl-2,4,6-tris(3,5-di-t-butyl-4-hydroxybenzyl)benzene; N-oxyl compounds such as 4-hydroxy-2,2,6,6-tetramethyl piperidine-N-oxyl, and 4-benzoyloxy-2,2,6,6-tetramethyl piperidine-N-oxyl; Copper compounds such as cuprous chloride; amino compounds such as phenothiadine, 4-hydroxy-2,2,6,6-tetramethyl piperidine, and 4-benzoyloxy-2,2,6,6-tetramethyl piperidine; and hydroxyamines such as 1,4-dihydroxy-2,2,6,6-tetramethyl piperidine, and 1-hydroxy-4-benzoyloxy-2,2,6,6-tetramethyl piperidine. These can be used alone or in combination.

Among the polymerization inhibitors, methoquinone and phenol-based compounds are preferable and methoquinone and 2,6-di-t-butyl-4-methylphenol are more preferable.

The content of the polymerization inhibitor is from 10 to 10,000 ppm and preferably from 50 to 1,000 ppm based on the mass of alcohol in terms of preventing polymerization of produced (meth)acrylate sufficiently and inhibition of polymerization of (meth)acrylate caused by a large amount of remaining anti-oxidizer.

In addition, use of an organic solvent is suitable to react an acrylic acid or a methacrylic acid with an alcohol. When acrylic acid or methacrylic acid reacts with alcohol, a catalyst and a polymerization inhibitor can be suitably used.

Organic solvents that hardly produce peroxides are preferable. Specific examples of such organic solvents include, but are not limited to, aliphatic hydrocrarbons such as n-pentane, i-pentane, n-hexane, 2-methyl pentane, n-heptane, i-heptane, n-octane, and i-octane, alicyclic hydrcarbons such as cyclohexane, methylcyclohexane, and ethylcyclohexane, and armatic hydrocarbons such as benzene, toluene, and xylene. Among these, cyclohexane is particularly preferable.

Although the content of the organic solvent depends on the kind thereof and thus it is not possible to jump to any conclusion, it is from 5 to 200 parts by weight and preferably from 20 to 100 parts by weight based on 100 parts by weight of alcohol in terms of efficiently removing water and alkyl alcohol produced during esterification reaction or ester exchange reaction out of the system.

To react an acrylic acid or a methacrylic acid with an alcohol in the presence of a catalyst and an anti-oxidizing agent, for example, a mixture of acrylic acid or methacrylic acid, alcohol, a catalyst, an anti-oxidizing agent, and an organic solvent is heated. The heating temperature is from 50 to 150° C. and preferably from 70 to 120° C. There is no specific limit to the selection of the air in the reaction system of acrylic acid or methacrylic acid with alcohol. For example, atmosphere is suitable. In the reaction of acrylic acid or methacrylic acid with alcohol, the content of peroxides in the alcohol is 20 ppm or less and preferably 10 ppm or less in terms of restricting the polymerization of produced (meth) acrylate.

To manufacture the compound having the structure represented by Chemical structure 1, an acryl monomer in the market is suitably used.

Specific examples of such acryl monomers include, but are not limited to, cetyl acrylate, octyl acrylate, stearyl acrylate, myristyl acrylate, lauryl acrylate, acryl methacrylate (LIGHT ESTERs, L-5, 7, and 8, manufactured by KYOEISHA CHEMICAL Co., LTD.), alkylmethacrylate (Blenmer PAM, DSMA, and XMA-70, manufactured by NOF Corporation), cetyl methacrylate, decyl methacrylate, lauryl methacrylate, stearyl methacrylate, and behenyl acrylate.

The content of the structure represented by Chemical structure 1 in the polymer is preferably from 30 to 90% by molar conversion. When the first component contains the copolymer having a cyclic structure, the content of the radical polymerizable compound having such a cyclic structure is preferably from 30 to 90% by molar conversion.

The copolymer having a cyclic structure contained in the first component is described next.

The copolymer having a cyclic structure in the present disclosure is manufactured by reacting a radical polymerizable monomer, a polymerization initiator, and a solvent at a high temperature. The radical polymerizable monomer preferably contains an acryloyl group and/or methacryloyl group. In addition, the copolymer is preferably of a long-chained structure in terms of the releasing property. Therefore, the material of the copolymer preferably has one or two functional groups.

Photopolymerization initiators and thermalpolymerization initiators are usable as the polymerization initiator. In addition, a compound having an acceleration effect on photopolymerization can be used alone or in combination with the photopolymerization initiator. Specific examples thereof are the same as those for the cross-linked type charge transport layer, which are specified later. With regard to the solvent used during synthesis of the copolymer, specific examples thereof are the same as those for the liquid application for the cross-linked type charge transport layer, which are specified later.

Although the copolymer of the first component in the present disclosure optionally has no functional groups, it is preferable to have a functional group reactive with the second component and be taken in the cross-linking structure. If the first component and the second component have functional groups reactive with each other, the surface form is easily sustained, thereby improving the mechanical durability and maintaining the high releasing property. In the present disclosure, the first component preferably has a radical polymerizable functional group reactive with the one or more kinds of radical polymerizable compounds without a charge transport structure selected from a group consisting of monomers or oligomers and both preferably have acryloyl group and/or methacryloyl group.

The number of the repeating units of the copolymer described above for use in the present disclosure is preferably from 2 to 10 in terms of having a good releasing property.

When the number of the repeating unit is outside this range, it tends to be difficult to control the layer separation state, resulting in insufficient releasing property. In addition, the number of the repeatign units having a cyclic structure is preferably from 1 to 5.

When the number of the repeating unit is none or above this range, it tends to be difficult to control the layer separation state, resulting in insufficient releasing property.

When a copolymer is formed of at least two repeating units for use in the present disclosure and at least one of the at least two repeating units contains at least one cyclic structure, the copolymer may have a functional group having an unsaturated double bond.

The unsaturated double bond represents a bond having a radical polymerizable functional group. The radical polymerizable functional group represents any radical polymerizable functional group which has a carbon-carbon double bond. When a radical polymerizable functional group is contained, it cross-links with at least one of the second component (=a radical polymerizable monomer or oligomer having no charge transport structure) and the third component (=radical polymerizable compound having a charge transport structure) so that the layer structure becomes more solid, thereby improving the abrasion resistance. Among these unsaturated polymerizable functional groups, acryloyloxy group and methacryloyloxy group are particularly preferable.

Any cyclic compound having a radical polymerizable functional group can be used as the material for the copolymer and a compound that forms a cyclic structure during polymerization reaction is also suitably used. Preferably, the cyclic structure of the copolymer is formed by carbon atom bonding and the number of carbon atoms forming the cyclic structure is at least six. More preferable cyclic structures are adamantane ring, norbornane ring, and cyclohexyl ring.

The cyclic structure that is formed by carbon atom bonding and in which the number of carbon atoms forming the cyclic structure is at least six is excellent in the releasing property. In addition, among these, the cyclic structure having adamantane ring, norbornane ring, and cyclohexyl ring have excellent abrasion resistance and releasing property.

Specific examples of the materials for the copolymer for use in the present disclosure include, but are not limited to, the following.

No. 1

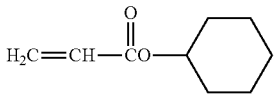

No. 2

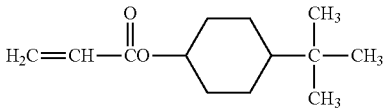

No. 3

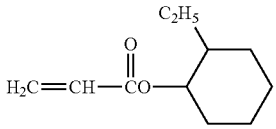

No. 4

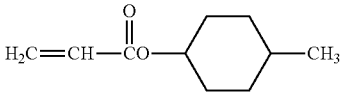

No. 5

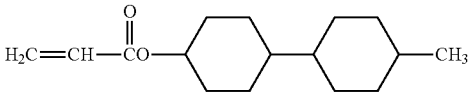

No. 6

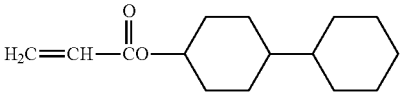

No. 7

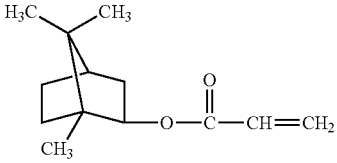

No. 8

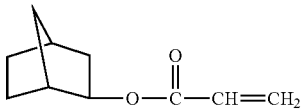

No. 9

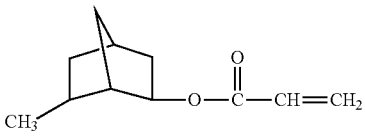

No. 10

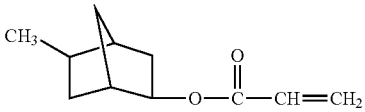

-continued

No. 11

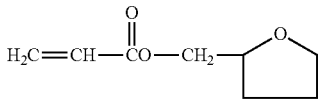

No. 12

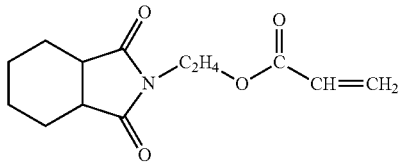

No. 13

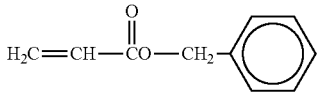

No. 14

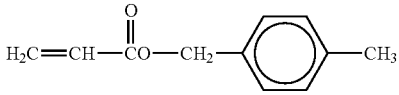

No. 15

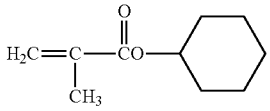

No. 16

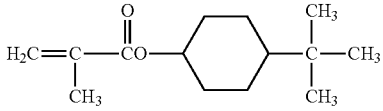

No. 17

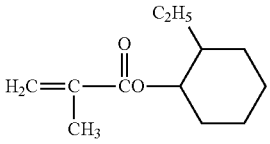

No. 18

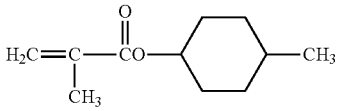

No. 19

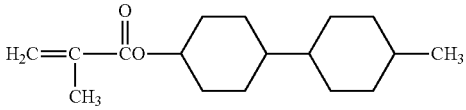

No. 20

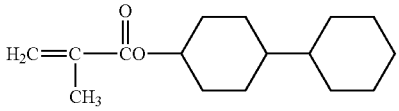

No. 21

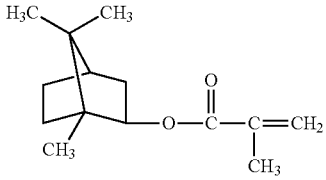

-continued
No. 22
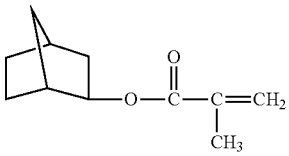
No. 23
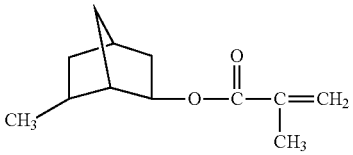
No. 24
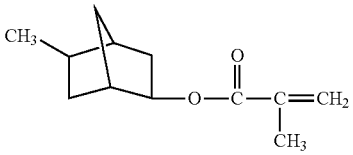
No. 25
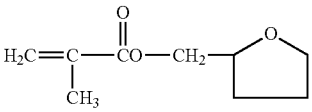
No. 26
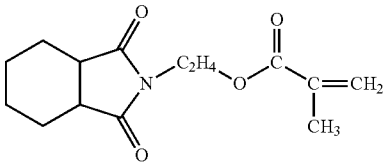
No. 27
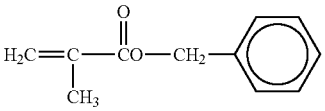
No. 28
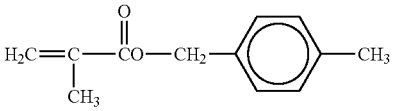
No. 29
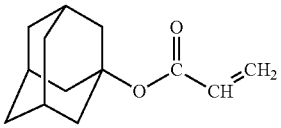
-continued
No. 30
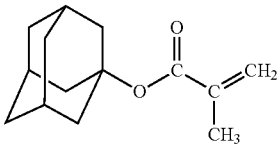
No. 31
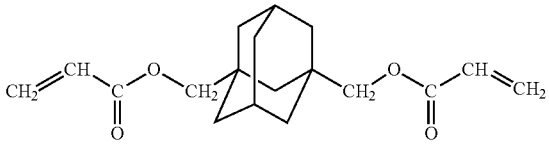
No. 32
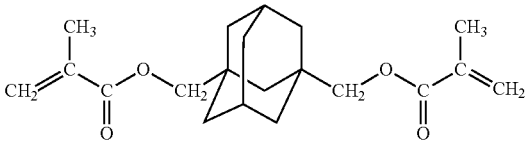
No. 33
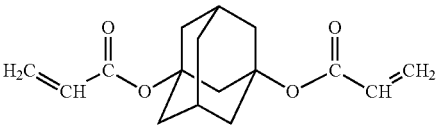
No. 34
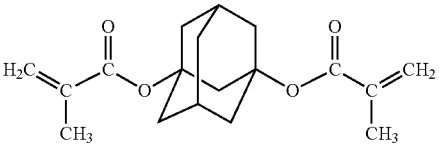
No. 35
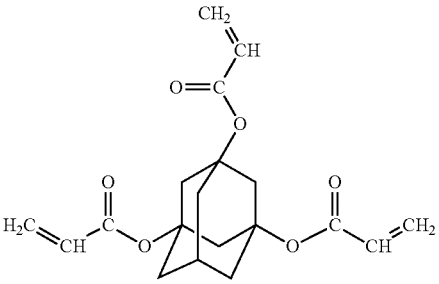
No. 36
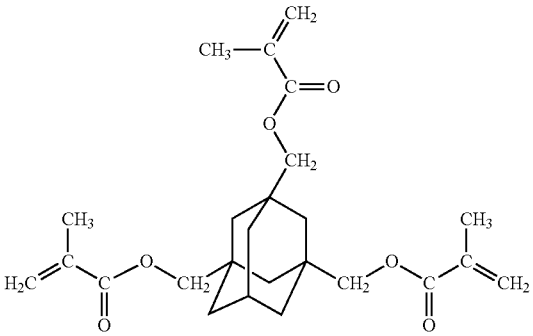

The radical polymerizable monomers described above are also usable as the material for the copolymer.

As the radical polymerizable monomers, the radical polymerizable monomers having no charge transport structure specified above can be used.

Among these, the radical polymerizable monomers having one functional group are preferable in terms of the releasing property. Although the mechanism is not clear, a copolymer material containing methacrylic acid in addition to the radical polymerizable monomer having a cyclic structure and the radical polymerizable monomer having no cyclic structure is suitable to improve the releasing property. This material is considered to promote the layer separation, which contributes to formation of minute concavo-convex surface.

The content of the cyclic compound is preferably from 30 to 90% by molar conversion. When the copolymerization ratio is too small, the releasing property tends to deteriorate. This is thought to be because the layer separation becomes insufficient so that a smooth surface is easily formed. to impart a good releasing property, a cooplymerizatoin that is 30% or more in molar ratio is suitable. When the copolymerization ratio is too large, the mechanical strength of the layer tends to deteriorate. To strike a good balance between the mechanical strength of the layer and the releasing property, the copolymerization ratio is more preferably from 50 to 90%. The weight average molecular weight of the copolymer is preferably from 2,000 to 100,000. The layer separation is thought to easily proceed within this range.

The weight average molecular weight can be measured by a known method such as gel permeation chromatography (GPC). Depending on the target subject, a column stationary phase using a hydrocarbon of C18 is preferable.

Radical Polymerizable Compound Having Charge Transport Structure

The radical polymerizable compound having a charge transport structure for use in the present disclosure represents a compound having a radical polymerizable functional group and a positive hole structure such as triaryl amine, hydrazone, pyrazoline, or carbazole or an electron transport structure having an electron absorbing aromatic ring such as condensed polycyclic quinone, diphenoquinone, a cyano group, or a nitro group. The radical polymerizable functional group represents any radical polymerizable functional group which has a carbon-carbon double bond.

The radical polymerizable compound having a charge transport structure for use in the cross-linked type charge transport layer for use in the present disclosure can be used irrespective of the number of functional groups. However, a radical polymerizable compound that has one functional group is preferable in terms of the stability of the electrostatic characteristics and the layer quality.

A polymerizable compound having a charge transport structure having two functional groups is advantageous in terms of the cross-linking density because multiple bonds are used to fix the compound in the cross-linking structure. However, the charge transport structure is extremely bulky, which increases distortion in the cross-linked type charge transport layer structure and thus internal stress in the layer. In addition, the structure of the intermediary body (cation radical) during charge transport is not stabilized. This leads to deterioration of the sensitivity due to the charge trap and a rise of the residual voltage. This tendency is markedly notable in the case of a polymerizable compound having a charge transport structure having three or more functional groups.

Any material that can impart the charge transport function can be used to form the charge transport structure of the radical polymerizable compound having a charge transport structure. Among these, triaryl amine structure is preferable.

This is thought to be because the triaryl amine structure has many hopping sites and pi-conjugation is extended. In addition, radical cation triaryl amine is easily conjugated. According to these reasons, triaryl amine structure has an excellent charge transport function. Among these, use of a compound having the structure represented by the following chemical formula I or II suitably maintains the electric characteristics such as sensitivity and residual voltage good.

Chemical formula I

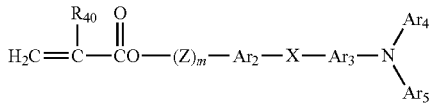

Chemical formula II

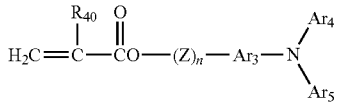

In the Chemical formulae I and II, $R_{40}$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_{41}$, wherein $R_{41}$ represents hydrogen atom, a substituted or non-substituted alkyl group, a substituted or non-substituted aralkyl group or a substituted or non-substituted aryl group, a halogenated carbonyl group or $CONR_{42}R_{43}$, wherein $R_{42}$ and $R_{43}$ independently represent hydrogen atom, a halogen atom, a substituted or non-substituted alkyl group, a substituted or non-substituted aralkyl group or a substituted or non-substituted aryl group, $Ar_2$ and $Ar_3$ independently represent an arylene group.

$Ar_4$ and $Ar_5$ independently represent a substituted or non-substituted aryl group. X represents a single bond, a substituted or non-substituted alkylene group, a substituted or non-substituted cycloalkylene group, a substituted or non-substituted alkylene ether group, oxygen atom, sulfur atom, or vinylene group. Z represents an alkylene group, an alkylene ether group or an alkyleneoxy carbonyl group. m and n represent an integer of from 0 to 3.

Specific examples of the substitution groups in the Chemical formulae I and II include, but are not limited to, the following.

In the Chemical formulae 2 and 3, among the substitution groups of $R_{40}$, specific examples of the alkyl groups thereof include, but are not limited to, methyl group, ethyl group, propyl group, and butyl group. Specific examples of the aryl groups of $R_{40}$ include, but are not limited to, phenyl group and naphtyl group. Specific examples of the aralkyl groups of $R_{40}$ include, but are nor limited to, benzyl group, phenthyl group, naphtyl methyl group. The alkoxy group of $R_{40}$ include, but are nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_{40}$, hydrogen atom and methyl group are particularly preferable.

$Ar_4$ and $Ar_5$ represent a substituted or non-substituted aryl group.

Specific examples thereof include, but are not limited to, condensed polycyclic hydrocarbon groups, non-condensed ring hydrocarbon groups and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group. Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene. Specific examples of the heterocyclic groups include, but are not limited to, a single-valent group such as carbazol, dibenzofuran, dibenzothiophene, oxadiazole, and thiadiazole.

The aryl groups represented by $Ar_4$ and $Ar_5$ can have a substitution group. Specific examples thereof are as follows:

(1) Halogen atom, cyano group, and nitro group;

(2) an alkyl group;

Preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_{82}$ );

In the formula (—$OR_{82}$), $R_{82}$ represents the alkyl group defined in (2).

Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) an aryloxy group;

The aryl group thereof is, for example, phenyl group and naphtyl group. These can contain an alkoxy group having 1 to 4 carbon atoms, an alkyl group having a 1 to 4 carbon atoms, or a halogen atom as a substitution group. Specific examples include, but are not limited to, phenoxy group, 1-naphtyloxy group, 2-naphtyloxy group, 4-methoxyphenoxy group, and 4-methylphenoxy group;

(5) An alkyl mercapto group or an aryl mercapto group;

Specific examples thereof include, but are not limited to, methylthio group, ethylthio group, phenylthio group, and p-methylphenylthio group;

(6) A substitution group represented by Chemical formula III

Chemical formula III

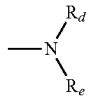

In Chemical formula III, $R_d$ and $R_e$ independently represent a hydrogen atom, the alkyl group defined in (2), or an aryl group. Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group. $R_d$ and $R_e$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) an alkylene dioxy group or an alkylene dithio such as methylene dioxy group and methylene dithio group; and (8) A substituted or non-substituted styryl group, a substituted or non-substituted β-phenyl styryl group, diphenyl aminophenyl group, ditolyl aminophenyl group, etc.

The arylene groups represented by $Ar_2$ and $Ar_3$ are divalent groups derived from the aryl group represented by $Ar_4$ and $Ar_5$ mentioned above.

X represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkyl group having 1 to 12, more preferably 1 to 8 and furthermore preferably from 1 to 4 carbon atoms is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are note limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxy-ethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms. Specific examples thereof include, but are not limited to, cyclohexylidene group, cyclohexylene group, and 3,3-dimethyl cyclohexylidene group.

Specific examples of the substituted or non-substituted alkylene ether group include, but are not limited to, alkylene oxy groups such as ethyleneoxy group, and propyleneoxy group, alkylene dioxy group derived from ethylene glycol and propylene glycol, and di-or poly(oxyalkylene)oxy group derived from diethylene glycol, tetraethylene glycol, and tripropylene glycol. In addition, the alkylene group of the alkylene ethere group may have a substitution group such as hydroxyl group, methyl group, and ethyl group.

Specific examples of vinylene group include, but are not limited to, the following substitution groups.

Chemical formula IV

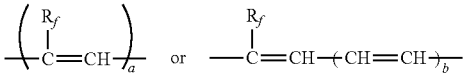

In the chemical formula IV, $R_f$ represents hydrogen or an alkyl group (the same as the alkylene groups defined in (2)) and an aryl group (the same as the aryl group represented by $Ar_4$, and $Ar_5$), and "a" represents 1 or 2 and "b" denotes an integer of from 1 to 3.

Z represents a substituted or non-substituted alkylene group, a substituted or non-substituted alkylene ether group. or an alkyleneoxy carbonyl group.

Specific examples of the substituted or non-substituted alkylene group are the same as the alkylene group specified for X.

Specific examples of the substituted or non-substituted alkylene ether group are the same as the alkylene ether group specified for X.

A specific example of the alkyleneoxy carbonyl group is caprolactone modified group.

The compound represented by the following chemical formula V is a further suitably preferred radical polymerizable compound having one functional group with a charge transport structure.

In Chemical formula V, "o", "p", "q" represent 0 or 1, $R_a$ represents hydrogen atom or methyl group, $R_b$ and $R_c$ are not hydrogen atom but independently represent an alkyl group having 1 to 6 carbon atoms. "s" and "t" represent an integer of from 0 to 3. Za represents a single bond, methylene group, ethylene group, —$CH_2CH_2O$—, —$CHCH_3CH_2O$—, or —$C_6H_5CH_2CH_2$—.

Among the compounds represented by the chemical formula 10 illustrated above, the compounds having methyl group or ethyl group as a substitution group of Rb and Rc are particularly preferable.

The radical polymerizable compound (monomer) having a functional group with a charge transport structure for use in the present invention represented by the chemical formulae I, II, or V in particular, is polymerized in a manner that both sides of the carbon-carbon double bond are open. Therefore, the polymerizable compound does not constitute an end of the structure but is set in a chained polymer. The polymerizable compound having a functional group is present in a main chain of a polymer in which cross-linking is formed by polymerization with a radical polymerizable monomer having no charge transport structure or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the cross-linked type charge transport layer having such a structure which is used for an image bearing member is deduced to have an internal molecular structure with relatively few disconnections in the charge transport route.

Specific examples of the radical polymerizable compound having a charge transport structure include, but are not limited to, the following.

Chemical formula V

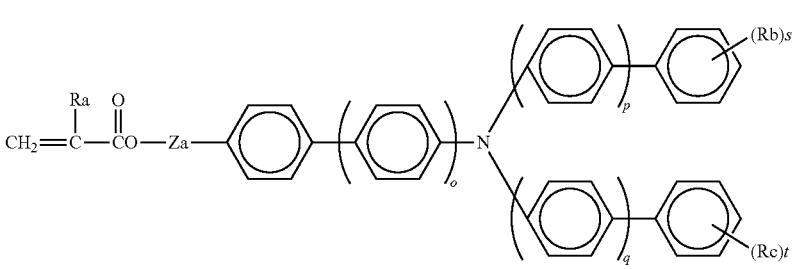

No.1
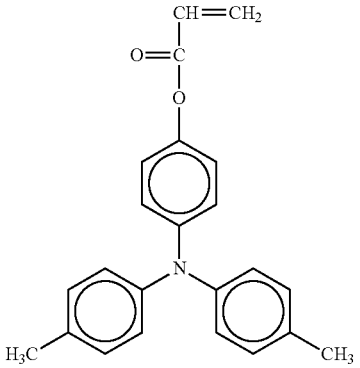
No.2
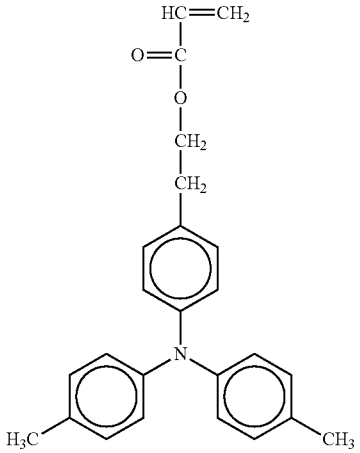
No.3
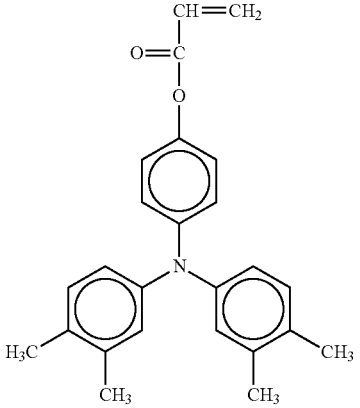
No.4
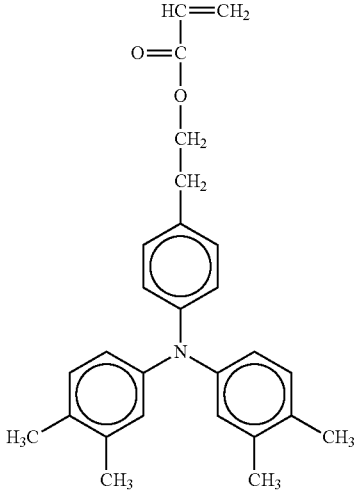
No.5
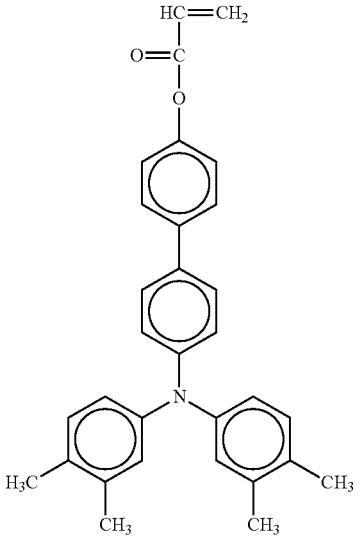
No.6
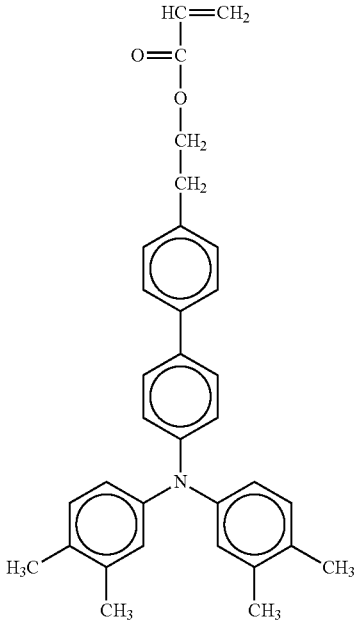

-continued
No.7
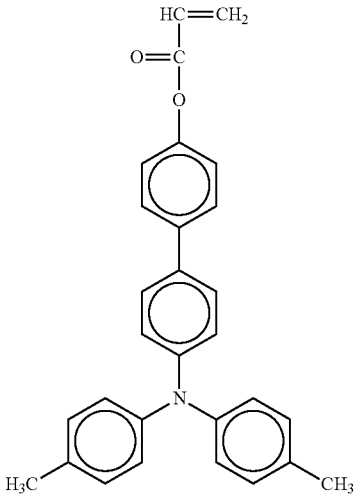
No.8
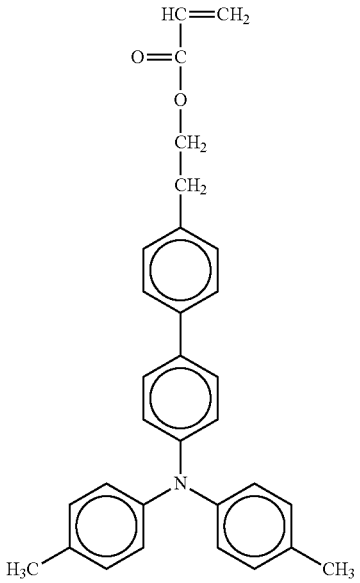
No.9
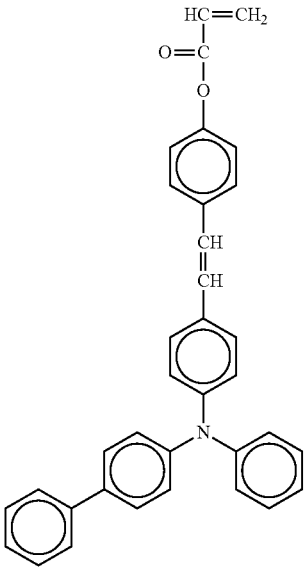
No.10
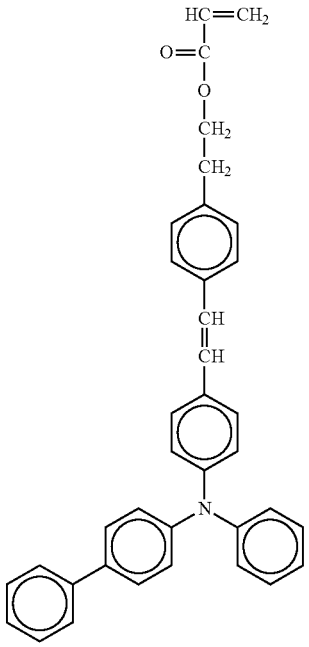

-continued
No.11
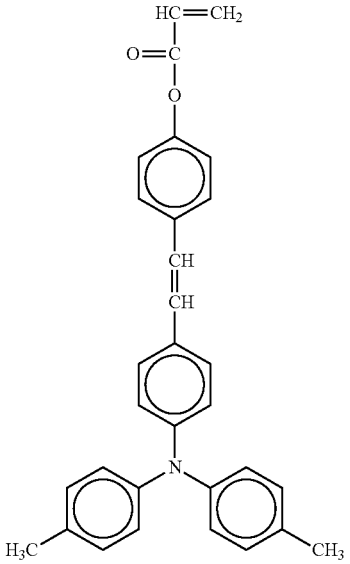
No.12
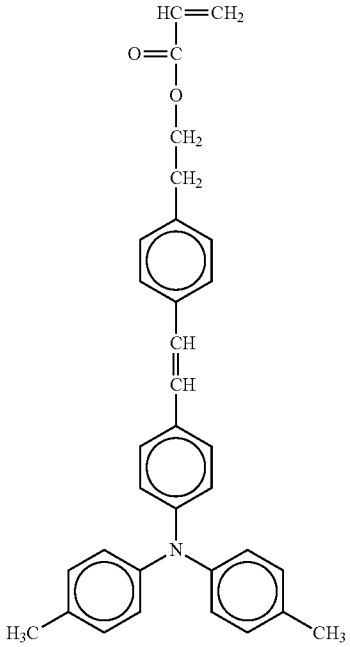
No.13
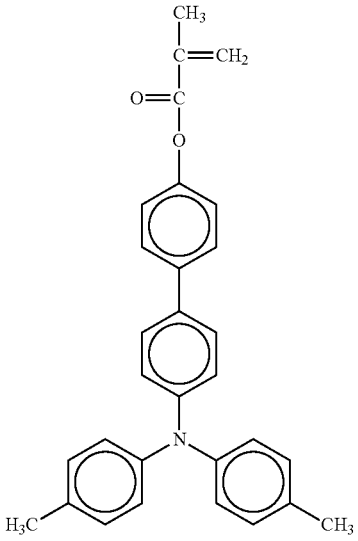
No.14
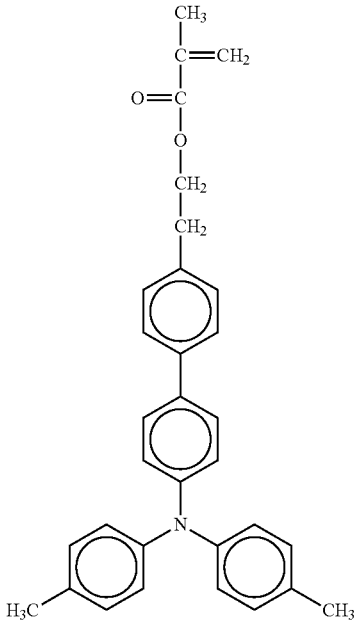

-continued
No.15
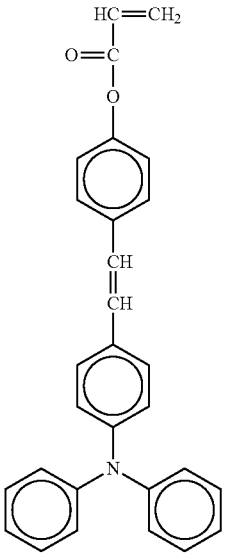
No.16
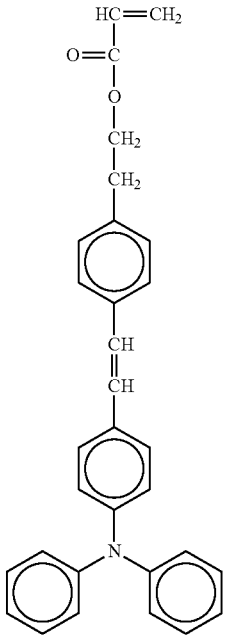
No.17
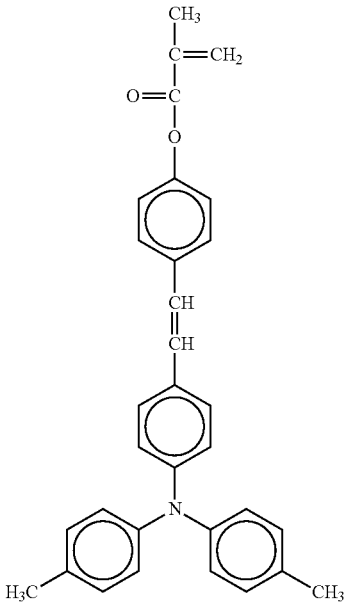
No.18
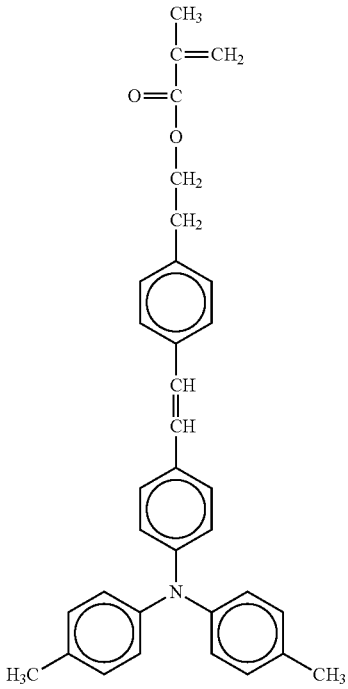

-continued
No.19
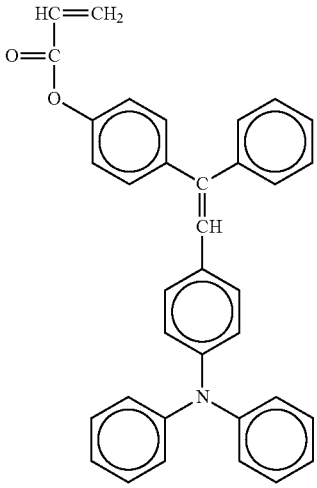
No.20
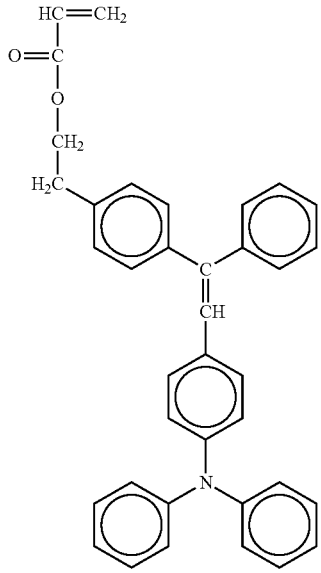
No.21
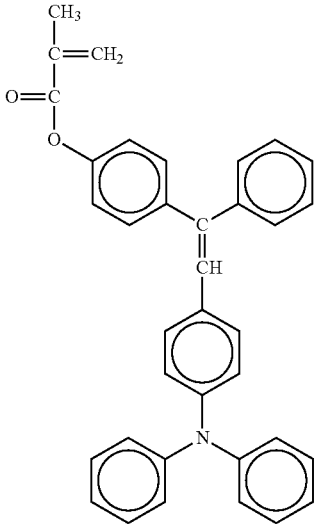
No.22
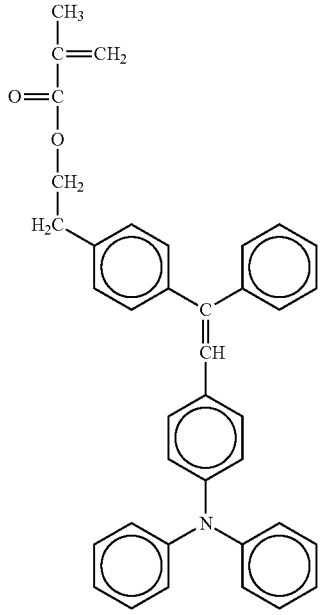

-continued
No.23
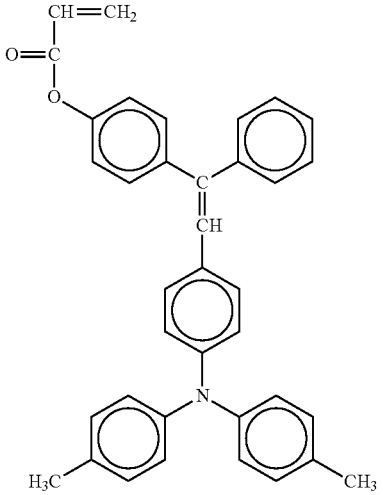
No.24
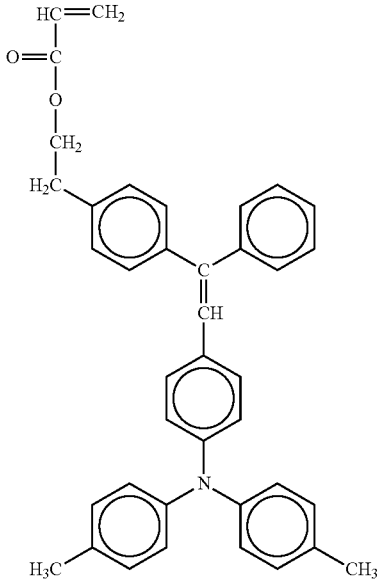
No. 25
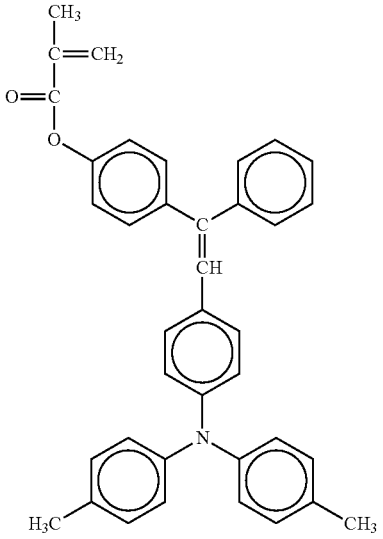
No.26
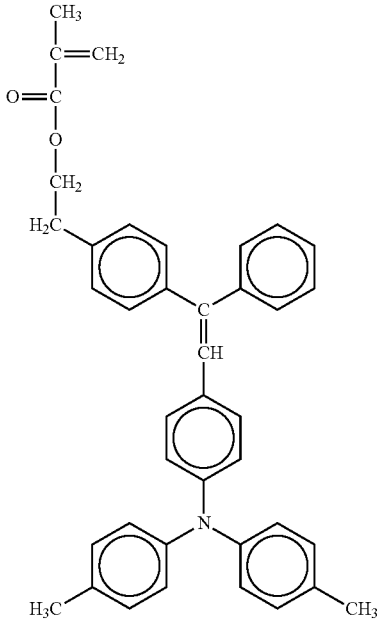
No.27
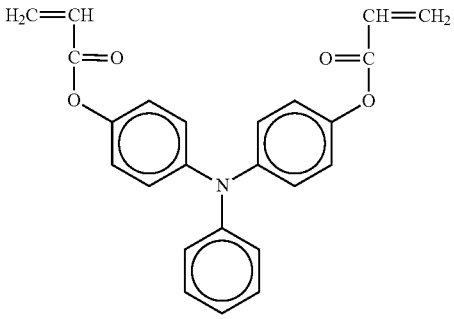
No.28
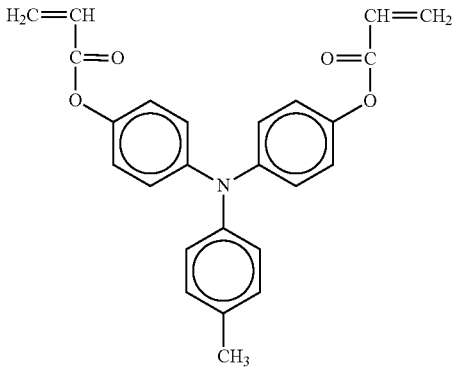

-continued
No.29
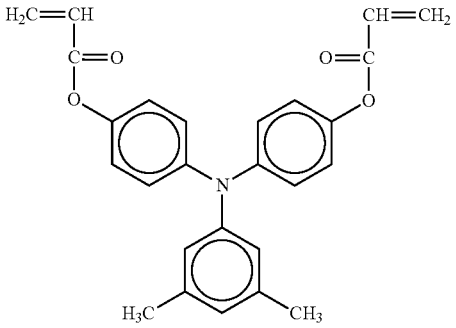
No.30
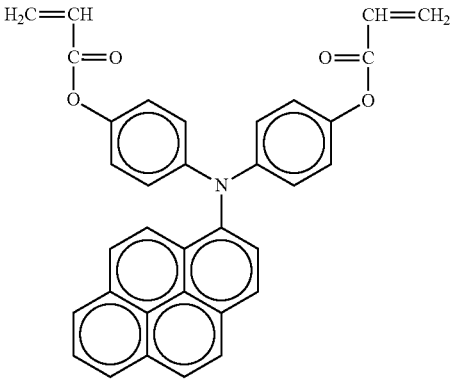
No.31
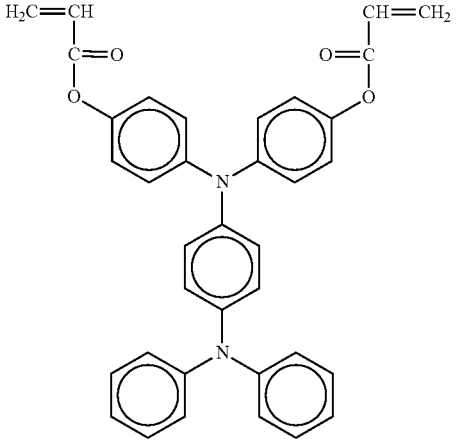
No.32
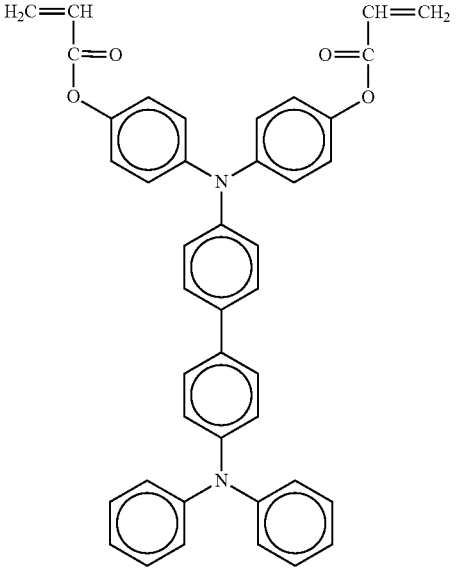
No.33
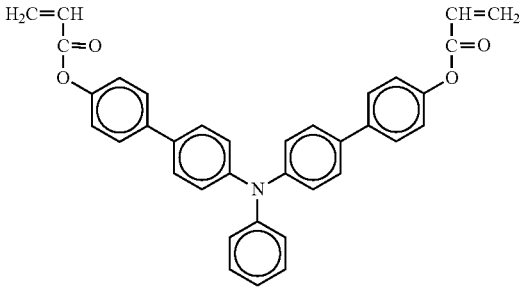
No.34
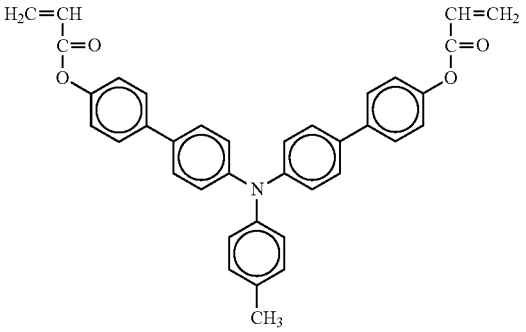

-continued
No.35
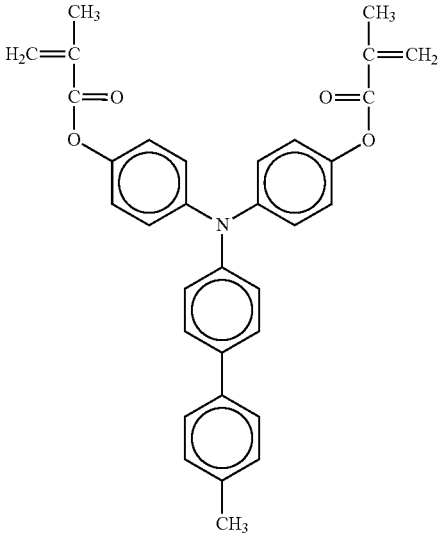
No.36
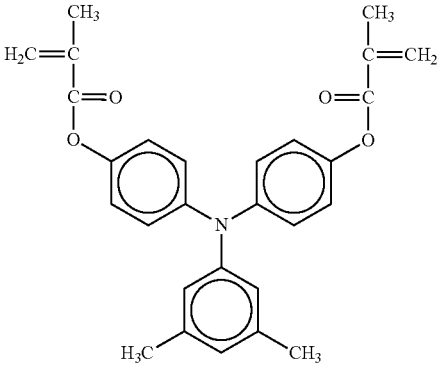
No.37
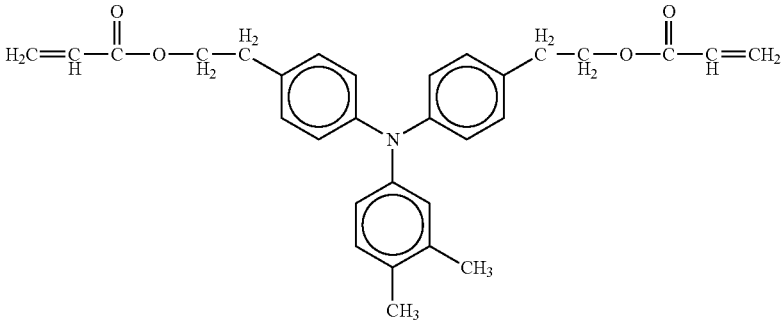
No.38
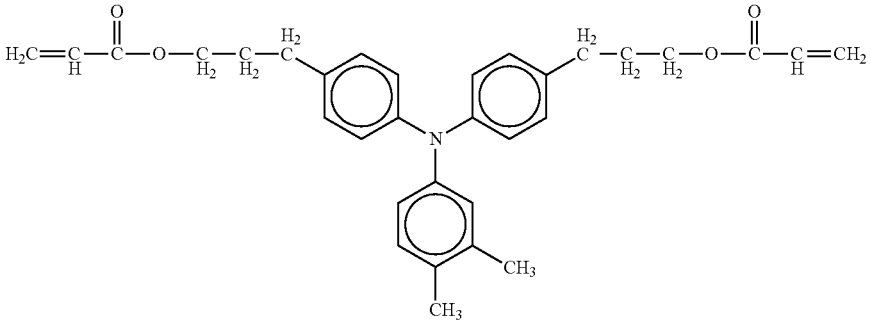
No.39
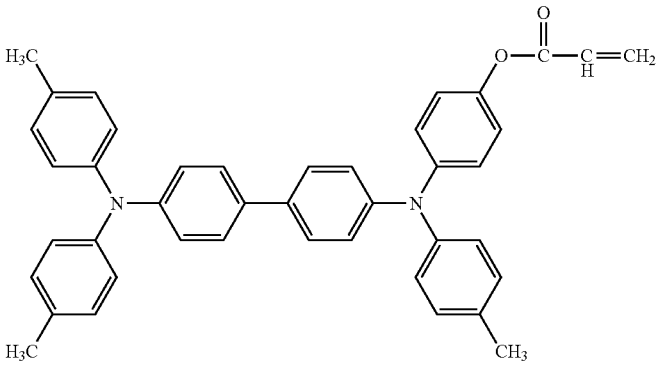

In addition, the content of the radical polymerizable monomer having a charge transport structure is from 20 to 80% by weight and preferably from 30 to 70% by weight based on the total weight of the cross-linked charge transport layer.

A content of the radical polymerizable monomer having a charge transport structure that is excessively small tends not to sustain the charge transport power of the cross-linked type charge transport layer, which leads to deterioration of electric characteristics with regard to sensitivity, residual voltage, etc. over repetitive use.

A content of the radical polymerizable monomer having a charge transport structure that is excessively large means reduction of the content of the radical polymeriable monomer or oligomer having no charge transport structure, thereby reducing the cross linking density, which prevents demonstration of a high abrasion resistance. Desired electric characteristics and anti-abrasion property vary depending on the process used. Therefore, it is difficult to jump to any conclusion but considering the balance of both characteristics, the range of from 30 to 70% by weight is most preferable.

In addition, the mass ratio of the first component is preferably from 0.1 to 10% based on the total content of the first component, the second component, and the third component. When the mass ratio is too small, the releasing property tends to deteriorate. This is thought to be because the layer separation becomes insufficient so that fine concave-convex structure is hardly formed. In addition, when the mass ratio is too large, the residual voltage tends to slightly increase. This is thought to be because the charge transport property slightly deteriorates.

Initiator

The cross-linked charge transport layer for use in the present disclosure is formed of the following three components.

First Component: Copolymer having a cyclic structure and/or the structure represented by the chemical structure 1 as a repeating unit Second Component Radical polymerizable monomer and/or oligomer having no charge transport structure Third Component One or more kinds of radical polymerizable compound having a charge transport structure The cross-linked type charge transport layer is formed by curing these components simultaneously with at least one of heat, light, or ionizing radiation. When heat and/or light is used to from the cross-linked type charge transport layer, a polymerization initiator is optionally contained in the cross-linked type charge transport layer to efficiently conduct the cross-linking reaction. Cross-linking reaction by ionizing radiation can be conducted without using a polymerization initiator. However, heat energy and/or photo energy can be imparted preferably in combination with a polymerization initiator as post-processing to cure residual un-cured composition remaining after irradiation of ionizing radiation.

Specific examples of the thermal polymerization initiators include, but are not limited to, a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, and lauroyl peroxide, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; titanocene based photopolymerization initiators such as bis(cyclopentadienyl)-di-chloro-titanium, bis (cyclopentadienyl)-di-phenyl-titanium, bis(cyclopentadienyl)-bis(2,3,4,5,6-pentafluorophenyl)titanium, and bis (cyclopentadienyl)-bis(2,6-difluoro-3-pyrrole-1-yl) phenyltitanium; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound.

In addition, a compound having an acceleration effect on photopolymerization can be used alone or in combination with the photopolymerization initiator. Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone. These polymerization initiators can be used alone or in combination.

The content of such a polymerization initiator is from 0.5 to 40 parts by weight and preferably from 1 to 20 parts by weight based on 100 parts by weight of the compound having a radical polymerization property.

Addition of Filler

The cross-linked type charge transport layer for use in the present disclosure may contain filler particulates to improve abrasion resistance, stabilize layer separation, and impart functions.

The filler-containing cross-linked type charge transport layer has a high cross-linking density so that the abrasion resistance at the resin portion is better than a filler-containing non-cross-linked type charge transport layer. Therefore, the non-uniform abrasion described above is reduced.

In addition, the filler particulates dispersed in the resin are captured in cured resin cross-linked matrix. The cured resin cross-linked matrix holds the fillers strongly, thereby preventing detachment of the fillers.

Therefore, a filler-containing cross-linked type charge transport layer has excellent abrasion resistance. Furthermore, the filler is considered to stably cause the layer separation. For example, the following filler particulates can be used. Specific examples of the organic filler material include, but are not limited to, powder of fluorine resin such as polytetrafuloroethylene, silicone resin powder, and carbon particulates. The carbon particulates represent particles having a structure mainly formed of carbon. Specific examples of such particles include, but are not limited to, amorphous carbon, diamond, graphite, fullerene, Zeppelin, carbon nanotube, and carbon nanophorn. Among these structures, diamond form carbon having hydrogen, or particulates having amorphous carbon structures are suitable in terms of mechanical and chemical durability. The diamond form carbon having hydrogen or amorphous carbon particles represent particulates in which structures having similarity such as the diamond structure having an $sp^3$ orbit, graphite structure having an $sp^2$ orbit, and an amorphous carbon structure are present in mixture. The diamond form carbon or amorphous carbon particulates may include hydrogen, oxygen, nitrogen, fluorine, boron, phosphorous, chloride, bromine, iodine, and others.

Specific examples of inorganic fillers include, but are not limited to, powder of metal such as copper, tin, aluminum and indium, metal oxides such as tin oxide, zinc oxide, titanium oxide, indium oxide, antimony oxide, and bismuth oxide, and inorganic material such as potassium titanate. Among these, the inorganic material is suitable in terms of hardness of the filler particulates. The metal oxides are particularly suitable, and silicon oxide, aluminum oxide and titanium oxide are more suitable. In addition, particulates such as colloidal silica, and colloidal aluminum are preferably used.

In addition, the average primary particle diameter of the filler particulates is preferably from 0.01 to 0.09 μm and more preferably from 0.1 to 0.5 μm in terms of optical transmittance and durability of the surface layer.

Filler particulates that have an excessively small average primary particle diameter tend to degrade abrasion resistance and dispersion property. Filler particulates that have an excessively large average primary particle diameter tend to accelerate sedimentation property of the filler in a liquid dispersion or cause filming of toner.

Abrasion resistance is improved as the filler material density in the cross-linked type charge transport layer increases. However, a filler material density that is too high tends to raise a residual voltage and degrade the transmission factor of writing light for the surface layer, which may cause side-effects. Therefore, the filler material density is generally not greater than 50% by weight, and preferably not greater than 30% by weight based on all the solid portion. Furthermore, these filler particulates can be subject to surface treatment with at least one surface treatment agent, which is preferable in terms of the dispersion property of the filler particulates. When the filler is poorly dispersed in the surface (protective) layer, the following problems may occur. These are: (1) the residual potential of a resultant image bearing member increases; (2) the transparency of a resultant protective layer decreases; (3) coating defects occur in a resultant surface (protective) layer; and, (4) the abrasion resistance of the surface (protective) layer deteriorates. These possibly develop into greater problems with regard to the durability of a resultant image bearing member, and the quality of the images produced thereby.

Suitable surface treatment agents include known surface treatment agents. Among these, surface treatment agents which do not degrade the insulation property of a filler are preferred. For example, titanate coupling agents, aluminum coupling agents, zircoaluminate coupling agents, higher fatty acids, combinational use of these agents with a silane coupling agent, and $Al_2O_3$, $TiO_2$, $ZrO_2$, silicones, aluminum stearate, and combinational use thereof, are preferable in terms of the dispersion property of filler particulates and prevention of image flow. Treatment on filler particulates by a silane coupling agent has an adverse impact with regard to production of blurred images. However, a combinational use of the surface treatment agent specified above and a silane coupling agent may lessen this adverse impact. The content of a surface treatment agent depends on the average primary particle diameter of the filler, but is preferably from 3 to 30% by weight, and more preferably from 5 to 20% by weight based on the weight of the treated filler. A content of the surface treatment agent that is too small tends not to improve the dispersion property of the filler. In contrast, a content of the surface treatment agent that is too large tends to significantly increase the residual potential of the image bearing member. These filler particulate materials can be used alone or in combination.

Other Additives

Furthermore, the liquid application for use in formation of the cross-linked type charge transport layer for use in the present disclosure optionally includes additives such as various kinds of plasticizers (for relaxing internal stress or improving adhesiveness), a leveling agent, a charge transport material having a low molecular weight having no radical reaction property. Known additives can be used as these additives. A typical resin such as dibutylphthalate and dioctyl phthalate can be used as the plasticizer. The content thereof is not greater than 20 parts by weight and preferably not greater than 10 parts by weight based on 100 parts by weight of the total solid portion of the liquid application.

Silicone oils such as dimethyl silicone oil, methyl phenyl silicone oil and a polymer or an oligomer having a perfluoroalkyl group in its side chain can be used as the leveling agent. The content thereof is suitably not greater than 3 parts by weight based on 100 parts by weight of the total solid portion of the liquid application.

Method of Forming Layer

The cross-linked type charge transport layer is formed by applying a liquid application containing the following three components to the charge transport layer described above followed by curing.

First Component:

Copolymer having a cyclic structure and/or the structure represented by the chemical structure 1 as a repeating unit Second Component Radical polymerizable monomer and/or oligomer having no charge transport structure Third Component One or more kinds of radical polymerizable compound having a charge transport structure Radical Polymerizable Compound Having Charge Transport Structure When a liquid radical polymerizable monomer or oligomer is used, other components are possibly dissolved in the liquid before application of the liquid to obtain a liquid application. Optionally, the liquid application is diluted by a suitable solvent before coating. There is no specific limit to the selection of the solvent and any known solvent is suitably used. Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosove and cellosolve acetate. These solvents can be used alone or in combination.

There is no specific limit to the selection of the application method used during formation of the cross-linked type charge transport layer and any known application method can be suitably used. The application method can be suitably selected considering the viscosity, desired thickness of the cross-linked type charge transport layer, etc. A dip coating method, a spray coating method, a bead coating method, a ring coating method, etc., can be used in application of the liquid application.

In the present disclosure, the liquid application is applied and energy is provided from outside to cure the cross-linked type charge transport layer. Energy using heat, light, or ionizing radiation can be used as the energy provided from outside. However, use of ionizing radiation may cause degrade characteristics of electrophotography accompanied by deterioration of the constitution materials of the image bearing member due to energy penetration depth and energy intensity. Therefore, heat or light energy is preferably used to cure the cross-linked type charge transport layer. In addition, use of light energy is more preferable in that the amount of the solvent and the energy used for cross-linking are reduced and the strength of the cross-linked layer increases. Furthermore, a combinational use of theses energies is effective to cross-linking.

Specific examples of the heat energy include, but are not limited to, gas or vapor of air, nitrogen, etc., various kinds of media, infra red, and electromagnetic wave. The heat energy is applied from the application side or the substrate side. The heating temperature is preferably from 100 to 170° C.

When the heating temperature is too low, the reaction speed tends to be slow, thereby reducing the productivity and causing non-reacted materials to remain in the layer. When the heating temperature is too high, the contraction of the layer due to cross-linking tends to be worse, rough surface or cracking tend to appear on the surface, and peeling-off easily occurs at the interface with the adjacent layer. In addition, when the volatile component in the photosensitive layer disappears to the outside, desired electric characteristics are not obtained, which is not preferable. When a resin that is markedly contracted is used, it is suitable to preliminarily conduct cross-linking reaction at a temperature lower than 100° C. followed by another cross-linking reaction at a temperature of 100° C. or higher.

Light sources such as an ultra high pressure mercury lamp, a high pressure mercury lamp, a low pressure mercury lamp, a carbon-arc lamp, a Xenon arc metal halide lamp can be used to provide the light energy. Preferably, selection of the light source is made considering the absorption characteristics of the radical polymerizable monomer or oligomer having no charge transport structure, the radical polymerizable compound having a charge transport structure (preferably having one functional group), and the photopolymerization initiator to be used in combination. The emission illuminance of the used light source is from 50 to 2,000 mW/cm$^2$ based on a wavelength of 365 nm. In addition, if the illuminance close to the maximum emission wavelength can be measured, it is preferable to conduct irradiation in the illuminance range specified above. When the illuminance is too small, it tends to take a long time to complete curing, which is not preferable in terms of productivity. When the illuminance is too high, the contraction of the layer due to curing tends to be worse, rough surface or cracking tend to appear on the surface, and peeling-off easily occurs at the interface with the adjacent layer.

Ionizing radiation ray has ionization effect on materials. Specific examples thereof include, but are not limited to, direct ionization radiation ray such as alpha ray and electron beams and indirect ionization irradiation ray such as X ray and neutron ray. Although there is no specific limit to the selection of the ionizing radiation ray for use in the present disclosure, electron beam is preferable considering the impact on human body. Specific examples of the electron beam irradiators include, but are not limited to, various kinds of electron beam accelerators such as Cockcroft-Walton accelerators, Van De Graaff accelerators, resonance transformer accelerators, insulation core transformer type accelerators, straight line type accelerators, Dynamitron type accelerators, and high frequency type accelerators. The irradiation amount of the electron beam is determined based on the materials and the thickness of the cross-linked type charge transport layer. It is preferable to irradiate with electrons having an energy of from 100 to 1,000 keV and preferably from 100 to 300 keV in an amount of from about 0.1 to about 30 Mrad. When the irradiation amount is too small, the electron beam tends not to reach the inside of the cross-linked type charge transport layer, thereby causing bad curing in the deep layer. When the irradiation amount is too large, the electron beam easily reaches the charge transport layer and the charge generation layer, thereby having an impact on the constitution material of each layer, which is not preferable.

During irradiation of UV or ionizing radiation ray, the temperature of the cross-linked type charge transport layer tends to rise because of the impact of the heat ray produced by the light source. If the surface temperature of the image bearing member rises excessively, contraction during curing of the cross-linked type charge transport layer easily occurs, curing inhibition may occur because low molecular components in the adjacent layer move to the cross-linked type charge transport layer, and the electric characteristics of the image bearing member tends to deteriorate, which is not preferable. Therefore, the surface temperature of the image bearing member during irradiation of UV is 100° C. or lower and preferably 80° C. or lower. As methods of cooling down the surface, inclusion of a cooling agent and cooling down inside the image bearing member by using air and/or liquid are suitable.

Heat can be applied to the cross-linked type charge transport layer after curing. For example, residual solvent remains inside the layer in a large amount, which may cause deterioration of the electric characteristics and time degradation. Therefore, removal of the residual solvent by heating after curing is preferable.

The thickness of the cross-linked type surface layer is preferably from 1 to 15 μm and more preferably from 3 to 10 μm in terms of protection of the photosensitive layer. When the cross-linked type surface layer is too thin, the photosensitive layer may not be protected from the mechanical abrasion caused by the contacting members of the image bearing member or vicinity discharging by a charger, etc. or the surface of the layer tends to become rough because leveling hardly occurs during formation of the layer. When the cross-linked type surface layer is too thick, the total thickness of the photosensitive layer tends to be thick and charges diffuse, resulting in degradation of the image represent ability. If the thickness of the cross-linked type charge transport layer is thicker than that of the charge transport layer, the voltage at the bright portion tends to rise, which is not preferable. In the present disclosure, the following relationship 1 is preferably satisfied to reduce such an impact, where T1 (μm) represents the thickness of the charge transport layer and T2 (μm) represents the thickness of the cross-linked type charge transport layer.

$$T1 > T2 \times 2 \qquad \text{Relationship 1}$$

Adhesive Layer

An adhesive layer is optionally provided to layer to prevent peeling off between the cross-linked charge transport layer and the charge transport layer caused by bad adhesion.

The radical polymerizable monomer described above or non-cross-linked polymers can be used for the adhesive layer. Specific examples of the non-cross-linked polymers include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, polyacrylamides, polyvinyl benzale, polyester, phenoxy resin, copolymer of vinylchloride and vinyl acetate, polyvinyl acetate, polyphenylene oxide, polyvinylpyridine, cellulose based resin, casein, polyvinyl alcohol, and polyvinyl pyrolidone. In addition, these radical polymerizable monomers described above and the non-cross-linked polymers can be used alone or in combination. Furthermore, the radical polymerizable monomer and the non-cross-linked polymer can be used as a mixture if sufficient adhesiveness is obtained. The charge transport materials described above can be also used alone or in combination. Furthermore, optionally an additive can be used in order to improve the adhesiveness.

The adhesive layer can be formed by dissolving and dispersing a compound having a predetermined prescription in a solvent such as tetrahydrofuran, dioxane, dichloroethane, and cyclohexane to obtain a liquid application and applying the liquid application to the charge transport layer by a dip coating method, a spray coating method, a bead coating method, and a ring coating method. The thickness of the adhesive layer is suitably from about 0.1 to about 5 μm and preferably from about 0.1 to about 3 μm.

Undercoating Layer

In the image bearing member of the present disclosure, an undercoating layer can be provided between the electroconductive substrate and the charge generation layer. Typically, such an undercoating layer is mainly made of a resin. Considering that a charge generation layer is applied in liquid to such an undercoating layer, a resin that is hardly soluble in a known organic solvent is preferable.

Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, fine powder pigments of metal oxide, such as titanium oxides, silica, alumina, zirconium oxides, tin oxides and indium oxides can be added to the undercoating layer to prevent moire and reduce the residual voltage.

The undercoating layer described above can be formed by using a suitable solvent and a suitable coating method as described for the photosensitive layer. Silane coupling agents, titanium coupling agents, and chromium coupling agents can be used in the undercoating layer. Furthermore, the undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method. Any other known methods can be also available.

The layer thickness of such an undercoating layer is suitably from 0 to 5 μm.

Blocking Layer

In addition, a blocking layer (intermediate layer) can be provided between the electorconductive substrate and the undercoating layer or the undercoating layer and the charge generation layer. The blocking layer is provided to reduce the infusion of positive holes from the electroconductive substrate and the main purpose of the blocking layer is to prevent the background fouling. Generally, the blocking layer is mainly formed of a binder resin. Specific examples of the resins include, but are not limited to, polyamide, alcohol soluble polyamide (soluble nylon), water soluble polyvinylbutyral, polyvinyl butyral, and polyvinyl alcohol. The method described above and known application methods are employed as the method of forming the blocking layer. The thickness of the blocking layer is suitably from 0.05 to 2 μm.

The two-layer structure of the blocking layer and the undercoating layer drastically increases the effect on reduction of the background fouling but has an adverse impact with regard to a rise in the residual voltage. Therefore, the composition and the thickness of the blocking layer and the undercoating layer are carefully determined.

Structure of Image Forming Apparatus

Next, the image forming apparatus is described in detail with reference to the accompanying drawings.

The image forming apparatus of the present disclosure uses an image bearing member (photoreceptor) having the cross-linked type charge transport layer described above. The image forming apparatus include, but are not limited to, processes (devices) of: charging the photoreceptor; irradiating the photoreceptor with light to form a latent electrostatic image; developing the latent image with toner; transferring the toner image to an image carrying body (transfer medium); fixing the toner image; and cleaning the surface of the photoreceptor. The image forming apparatus that directly transfers the latent electrostatic image to the transfer medium does not necessarily have all the devices described above provided around the photoreceptor.

FIG. 2 is a schematic diagram illustrating an example of the image forming apparatus. A charger 3 is used as a device to uniformly charge a photoreceptor 1. Specific examples of the charger 3 include, but are not limited to, a corotron device, a scorotron device, a solid discharging element, a needle electrode device, a roller charger, and an electroconductive brush device, and any known system can be used. Next, an image irradiation portion 5 irradiates the uniformly charged photoreceptor 1 to form a latent electrostatic image thereon. Typical illumination materials, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the image irradiation portion 5. Various kinds of optical filters, for example, a sharp cut filter, a band-pass filter, a near infrared filter, a dichroic filter, a coherent filter and a color conversion filter, can be used to irradiate an image bearing member with light having only a particular wavelength.

Next, a development unit 6 develops and visualizes the latent electrostatic image formed on the photoreceptor 1. As the development method, there are a one-component developing method and a two-component development method using a dry toner, and a wet-developing method using a wet toner. When the photoreceptor 1 is positively (or negatively) charged and irradiated, a positive (or negative) latent electrostatic image is formed on the photoreceptor 1. When the latent electrostatic image is developed with a negatively (or positively) charged toner (volt-detecting fine particles), a positive image is formed. When the latent electrostatic image is developed using a positively (or negatively) charged toner, a negative image is formed.

A transfer charger 10 transfers the toner image visualized on the photoreceptor 1 to a transfer medium 9. A pre-transfer charger 7 can be used to improve the transferring.

An electrostatic transfer system using a transfer charger or a bias roller, a mechanical transfer system using an adhesive transfer method, a pressure transfer method, etc., and a magnetic transfer system can be used. The charger 3 described above can be used in the electrostatic transfer system.

A separation charger 11 and a separation claw 12 are used to separate the transfer medium 9 from the photoreceptor 1. Other separation methods that can be used are, for example, electrostatic sucking induction separation, side edge belt separation, front edge grip conveyance and curvature separation. The charger 3 described above can be used as the separation charger 11.

A fur brush 14 and/or a cleaning blade 15 are used to remove toner remaining on the photoreceptor 1 after transfer. A pre-cleaning charger 13 can be used for more efficient cleaning performance. A web system and a magnet brush system can be also used as the cleaning method. These systems can be employed alone or in combination. A discharging unit can be optionally used to remove the latent electrostatic image on the photoreceptor 1. As the discharging unit, a discharging lamp 2 or a discharging charger can be used. The irradiation light source and the charger 3 mentioned above can be used. In FIG. 2, the reference numeral 8 represents a registration roller 8.

In addition, for the processes that are performed not in the vicinity of the photoreceptor 1, i.e., reading an original, sheet-feeding, fixing, and paper-discharging, known devices and methods in the art can be used.

The image forming apparatus of the present disclosure employs a system which includes two or more image formation elements, each having at least a charger, an irradiator, a development device, a transfer device, and an image bearing member (photoreceptor).

In addition, the present invention relates to an image forming apparatus and a process cartridge that use the image bearing member of the present disclosure in the image formation unit as described above.

The image formation unit may be fixed in and incorporated into a photocopier, a facsimile machine, or a printer, or may form a process cartridge that is detachably attachable to such devices. FIG. 3 is a diagram illustrating an example of the process cartridge.

The process cartridge for use in an image forming apparatus is a device (or part) that integrates a photoreceptor (image bearing member) 101 therein, includes at least one device selected from a charger 102, a development device 104, a transfer device 106, a cleaning device 107 and a discharger (not shown), and is detachably mounted to the main body of an image forming apparatus.

The image formation process by the apparatus illustrated in FIG. 3 is described next. While the photoreceptor 101 rotates in the direction indicated by an arrow in FIG. 5, a latent electrostatic image corresponding to the exposure image is formed on the surface of the photoreceptor 101 through charging and irradiating the surface thereof by the charging device 102 and an irradiation device 103. This latent electrostatic image is developed with toner by the development device 104, and the toner image is transferred to a transferring medium 105 by the transfer device 106. Then, the surface of the photoreceptor 101 is cleaned after the image transfer by a cleaning device 107 and discharged by a discharger (not shown) to be ready for the next image formation cycle.

Next, there is described the image forming apparatus of the present disclosure that employs a system which includes two or more image formation elements, each having a charger, an irradiator, a development device, and an image bearing member (photoreceptor).

The image formation unit is formed of an image bearing member (photoreceptor) and other devices provided around the image bearing member such as a charger, a development unit, a cleaner, etc. In the case of a color image forming apparatus using multiple color toners, the number of the image formation units in the color image forming apparatus corresponds to the number of color toners. In addition, each individual image formation unit can be fixed or set to be replaceable in an image forming apparatus.

FIG. 4 is a schematic diagram illustrating a tandem system full color image forming apparatus having multiple image formation units. The following variation examples are also within the scope of the present invention.

In FIG. 4, the image bearing drum members 1C, 1M, 1Y, and 1K rotate in the direction indicated by an arrow and around the image bearing drum members 1C, 1M, 1Y, and 1K, at least chargers 2C, 2M, 2Y, and 2K, development devices 4C, 4M, 4Y, and 4K, and cleaning devices 5C, 5M, 5Y, and 5K are arranged relative to the rotation direction of the image bearing members. The chargers 2C, 2M, 2Y, and 2K are charging members constituting charging devices that uniformly charge the surface of the image bearing drum members 1C, 1M, 1Y, and 1K.

An irradiation device (not shown) emits laser beams 3C, 3M, 3Y, and 3K to irradiate the image bearing drum members with 1C, 1M, 1Y, and 1K from the gap between the charger 2C, 2M, 2Y, and 2K and the development devices 4C, 4M, 4Y, and 4K to form latent electrostatic images on the image bearing drum members 1C, 1M, 1Y, and 1K. Four image formation units 6C, 6M, 6Y, and 6K including the image bearing drum members 1C, 1M, 1Y, and 1K are arranged along a transfer belt 10 functioning as a transfer medium conveyor device. The transfer belt 10 is in contact with the image bearing drum members 1C, 1M, 1Y, and 1K between the development device 4C, 4M, 4Y, and 4K and the corresponding cleaning devices 5C, 5M, 5Y, and 5K of each image formation units 6C, 6M, 6Y, and 6K. Transfer brushes 11C, 11M, 11Y, and 11K that apply a transfer bias are provided on the side of the transfer belt 10 reverse to the side on which the image bearing members 1C, 1M, 1Y, and 1K are in contact. The transfer belt 10 is in contact with the image bearing members 1C, 1M, 1Y, and 1K between the development device 4C, 4M, 4Y, and 4K and the cleaning devices 5C, 5M, 5Y, and 5K of each development component 6C, 6M, 6Y, and 6K. Transfer brushes 11C, 11M, 11Y, and 11K that apply a transfer bias are provided on the side of the transfer belt 10 reverse to the side thereof on which the image bearing members 1C, 1M, 1Y, and 1K are in contact. Each image formation units 6C, 6M, 6Y, and 6K is of the same structure except that toners contained in the development devices 4C, 4M, 4Y, and 4K have different colors from each other.

The color image forming apparatus having the structure illustrated in FIG. 4 produces images as follows. In the image formation units 6C, 6M, 6Y, and 6K, the image bearing drum members 1C, 1M, 1Y, and 1K are charged by the chargers 2C, 2M, 2Y, and 2K that rotate in the direction indicated by an arrow (the same direction as the rotation direction of the image bearing drum members 1C, 1M, 1Y, and 1K) and irradiated with the laser beams 3C, 3M, 3Y, and 3K by the irradiation device (not shown) situated inside the image bearing members 1C, 1M, 1Y, and 1K to produce latent electrostatic images corresponding to an image of each color.

Then, the latent electrostatic images are developed by the development devices 4C, 4M, 4Y, and 4K to form toner images. The development devices 4C, 4M, 4Y, and 4K develop the latent electrostatic images with toner of C (cyan), M (magenta), Y (yellow), and K (black), respectively. Respective toner images formed on the four image bearing drum members 1C, 1M, 1Y, and 1K are overlapped on a transfer medium 7.

The transfer medium 7 is sent out from a tray by a feeding roller 8, temporarily held at a pair of registration rollers 9 and fed to the transfer belt 10 in synchronization with image formation on the image bearing members 1C, 1M, 1Y, and 1K. The transfer medium 7 held on the transfer belt 10 is transferred to the contact point (transfer portion) with the image bearing drum members 1C, 1M, 1Y, and 1K where each color toner image is transferred.

The toner images on the image bearing members 1C, 1M, 1Y, and 1K are transferred to the transfer medium 7 by an electric field formed by a potential difference between the transfer bias applied to the transfer brushes 11C, 11M, 11Y, and 11K and the voltage of the image bearing members 1C, 1M, 1Y, and 1K. The transfer medium 7 on which four color toner images are overlapped through the four transfer portions are conveyed to a fixing device 12 where the toner is fixed followed by discharging of the transfer medium 7 to a discharging portion (not shown). In addition, toner which has not been transferred to the image bearing embers 1C, 1M, 1Y, and 1K and remains thereon are collected by the cleaning devices 5C, 5M, 5Y, and 5K. The image formation elements are arranged in the sequence of C (cyan), M (magenta), Y (yellow), and K (black) from the upstream to the downstream relative to the transfer direction of the transfer medium, but are not limited that sequence. The sequence of the color is arbitrarily determined.

In addition, when a document of only black color is output, a mechanism that suspends the image formation elements 6C, 6M, and 6Y) other than the black color is particularly suitable for the present disclosure. The chargers 2C, 2M, 2Y, and 2K are in contact with the image bearing members 1C, 1M, 1Y, and 1K in FIG. 4. Alternatively, the charging mechanism as illustrated in FIG. 4 may have a suitable gap of from about 10 to about 200 μm between the chargers 2C, 2M, 2Y, and 2K and the image bearing drum members 1C, 1M, 1Y, and 1K, thereby reducing the abrasion of both and toner filming to the chargers 2C, 2M, 2Y, and 2K.

The image bearing member described in the present disclosure has excellent releasing property, thereby lessening the burden on the portions related to cleaning. As a result, the cleaning portion has a long working life. In addition, this contributes to reduction in size of the cleaning portion. Furthermore, since the toner transfer ration is high, the amount of waste toner decreases, which leads to effective use of toner.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

First, synthesis of the charge generation material (titanyl phthalocyanine crystal) is described.

Synthesis Example 1

Synthesis of Titanylphthalocyanine Crystal

The method of synthesizing titanyl phthlocyanine crystal for use in the present disclosure is described below. Titanyl phthalocyanine is synthesized according to JP-2004-83859-A.

That is, 292 parts of 1,3-diiminoisoindoline and 1,800 parts of sulfolane are mixed and 204 parts of titanium tetrabutoxido is dropped thereto in nitrogen atmosphere.

Thereafter, the temperature is gradually raised to 180° C., and the resultant is stirred to conduct reaction for 5 hours while the reaction temperature is maintained in a range of from 170 to 180° C. After the reaction is complete, the resultant is left to be cooled down and the precipitation is filtered. The filtered resultant is washed with chloroform until the color of the obtained powder becomes blue. Next, the resultant powder is washed with methanol several times. Further, the resultant is washed with hot water of 80° C. several times and dried to obtain a coarse titanyl phthalocyanine. The obtained coarse titanyl phthalocyanine is dissolved in strong sulfuric acid the amount of which is 20 times as much as that of the titanyl phthalocyanine. The resultant is dropped to iced water the amount of which is 100 times as much as the resultant. The precipitated crystal is filtrated and water-washing is repeated with deionized water having a pH of 7.0 and a specific electric conductivity of 1.0 μS/cm until the washing water is neutral to obtain a wet cake (water paste) of titanyl phthalocyanine dye. The pH value of the deionized water and the specific electric conductivity after washing was 6.8 and 2.6 μS/cm, respectively.

40 parts of the thus obtained wet cake (water paste) is put in 200 parts of tetrahydrofuran and vigorously kept being stirred with HOMOMIXER (MARKII f model, manufactured by KENIS, Ltd.) at 2,000 rpm at room temperature until the color of the paste changed from navy blue to light blue (20 minutes after initiation of stirring), immediately followed by filtration with a reduced pressure. The crystals on the filtration device are washed with tetrahydrofuran to produce a wet cake of the pigment. The wet cake is then dried for 2 days at 70° C. under a reduced pressure (5 mmHg) to produce 8.5 parts of a titanyl phthalocyanine crystal. The solid portion density of the wet cake was 15 weight %. The weight ratio of the solvent for crystal conversion to the wet cake is 33. No halogenated material is used in the raw material of Synthesis Example 1. The thus obtained titanyl phthalocyanine powder is measured using X ray diffraction spectrum under the following conditions. The thus obtained titanyl phthalocyanine powder has a CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 7.3°±0.2° and 9.4°±0.2° and no peak at 26.3±0.2°. The results are shown in FIG. 5.

Measuring Conditions of X Ray Diffraction Spectrum

X ray tube: Cu
Voltage: 50 kV
Current: 30 mA
Scanning speed: 2°/min
Scanning range: 3 to 40°
Time constant: 2 seconds Liquid Application for Charge Generation Layer The titanyl phthalocyanine crystal and 2-butanone solution where polyvinyl butyral is dissolved are put in a marketed bead mill dispersion device using PSZ balls having a diameter of 0.5 mm. Dispersion is conducted for 30 minutes at 1,200 rpm to prepare a liquid application for a charge generation layer.

| | |
|---|---|
| Synthesis of Titanylphthalocyanine Crystal | 10 parts |
| Polyvinylbutyral (BX-1, manufactured by Sekisui Chemical Co., Ltd.) | |
| 2-butanone | 280 parts |

Synthesis Example 2

Synthesis of a compound having one functional group with a charge transport structure for use in the cross-linked type charge transport layer described later in manufacturing examples of an image bearing member is described next.

Synthesis Example of Compound Having One Functional Group with Charge Transport Structure The compound having one functional group with a charge transport structure for use in the present disclosure can be synthesized by, for example, the method described in JP-3164426-A. A specific example is described below.

(1) Synthesis of Hydroxy Group Substituted Tri-Aryl Amine Compound (Represented by Chemical Structure B)

240 parts of sulfolane are added to 113.85 parts (0.3 mol) of methoxy group substituted triaryl amine compound represented by the Chemical structure A and 138 parts (0.92 mol) of sodium iodide. The mixture is heated to 60° C. in nitrogen air stream. 99 g (0.91 mol) of trimethyl chlorosilane is dropped to the liquid in one hour and the resultant is stirred at about 60° C. for 4.5 hours to complete the reaction.

About 1,500 parts of toluene is added to the reaction liquid. Subsequent to cooling down to room temperature, the liquid is repeatedly washed with water and sodium carbide aqueous solution. Thereafter, the solvent is removed from the toluene solution. The toluene solution is purified with column chromatography treatment {absorption medium (silica gel), developing solvent (toluene:ethyl acetate=20:1)}.

Cyclohexane is added to the obtained light yellow oil to precipitate crystal.

88.1 parts (yield ratio=80.4%) of the white crystal represented by the Chemical structure B is thus obtained.

Melting point: 64.0 to 66.0° C.

TABLE 1

| Element Analysis Value (%) | | | |
|---|---|---|---|
| | C | H | N |
| Measured value | 85.06 | 6.41 | 3.73 |
| Calculated value | 85.44 | 6.34 | 3.83 |

Chemical Structure A

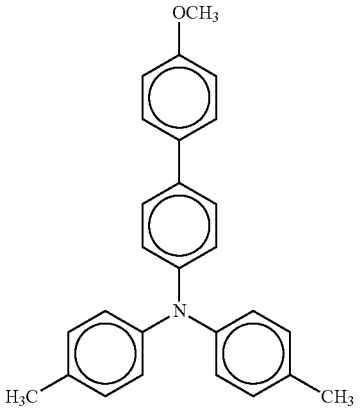

-continued

Chemical Structure B

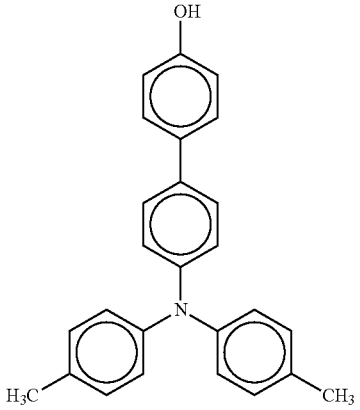

(2) Triaryl Amino Group Substituted Acrylate Compound (Illustrated Chemical Compound No. 7)

82.9 g (0.227 mol) of the hydroxyl group substituted triaryl amine compound (Chemical structure B) obtained in (1) is dissolved in 400 ml of tetrahydrofuran and sodium hydroxide aqueous solution (NaOH: 12.4 parts, water: 100 ml) is dropped thereto in a nitrogen atmosphere. The solution is cooled down to 5° C. and 25.2 parts (0.272 mol) of chloride acrylate is dropped thereto in 40 minutes. Thereafter, the solution is stirred for 3 hours at 5° C., and the reaction is terminated. The resultant reaction liquid is poured into water and extracted by toluene. The extracted liquid is repeatedly washed with sodium acid carbonate and water. Thereafter, the solvent is removed from the toluene aqueous solution and purified by column chromatography treatment (absorption medium: silica gel, development solvent: toluene). n-hexane is added to the obtained colorless oil to precipitate crystal. 80.73 parts (yield ratio: 84.8%) of white crystal of the Illustrated Chemical Compound No. 7 is thus obtained.

Melting point: 117.5 to 119.0° C.

TABLE 2

| Element Analysis Value (%) | | | |
|---|---|---|---|
| | C | H | N |
| Measured value | 83.13 | 6.01 | 3.16 |
| Calculated value | 83.02 | 6.00 | 3.33 |

To obtain a structure represented by Chemical structure 1, a radical polymerizable compound is synthesized.

Chemical structure 1

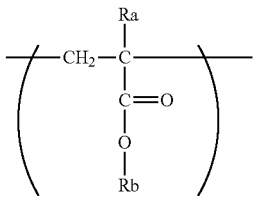

(1)

In the Chemical structure 1, Ra represents hydrogen atom or methyl group. Rb represents a straight-chained saturated aliphatic hydrocarbon group having 8 to 34 carbon atoms.

Synthesis Example 1

5 parts of paratoluene sulfonic acid as a catalyst, 150 parts of acrylic acid, 600 parts of 1-heptanol as a straight chained saturated aliphatic alcohol having seven carbon atoms, 0.3 parts of a polymerization inhibitor, and 550 parts of cyclohexane as a dehydration solvent are set in a flask. The mixture is stirred in a nitrogen atmosphere and heated to 85° C. and produced water is removed while refluxing the liquid. The mixture is subject to sampling and analyzed by gas chromatography. The reaction terminates when the remaining amount of alcohol is 1% by weight or less.

After the reaction, the obtained reaction mixture is washed with 100 parts by weight of water to remove non-reacted remaining acrylic acid and paratoluene sulfonic acid as a catalyst. Thereafter, the resultant is washed with 5% by weight sodium hydroxide solution to further remove non-reacted remaining acrylc acid. Next, to remove remaining alkali in the system, the reaction mixture obtained after the treatment described above is washed with water again. After the mixture is confirmed to be around neutral, the mixture is heated to 70° C. with a reduced pressure to remove cyclohexane. Thus, 650 parts by weight of the radical polymerizable compound having a straight-chained saturated aliphatic hydrocarbon group having seven carbon atoms is obtained. This is referred to as LC-1. Similarly, other radical polymerizable compounds are synthesized using various kinds of alcohols. The used alcohols and the synthesis results are shown in Table 3.

TABLE 3

Radical Polymerizable Compound Synthesis Results

| Contained radical poly-merizable compound | Alcohol | Amount of alcohol (parts by weight) | Weight of product (parts by weight) | Acid | Amount of acid (parts by weight) |
|---|---|---|---|---|---|
| LC-1 | 1-heptanol | 190 | 200 | Acrylic acid | 150 |
| LC-2 | 1-penta triacontanol | 930 | 990 | Acrylic acid | 150 |
| LC-3 | 1-octanol | 210 | 230 | Acrylic acid | 150 |
| LC-4 | 1-tetra triacontanol | 910 | 960 | Acrylic acid | 150 |
| LC-5 | 1-tetra decanol | 370 | 400 | Acrylic acid | 150 |
| LC-6 | 1-penta decanol | 400 | 430 | Acrylic acid | 150 |
| LC-7 | 1-triacontanol | 800 | 850 | Acrylic acid | 150 |
| LC-8 | 1-penta triacontanol | 830 | 880 | Acrylic acid | 150 |
| LC-9 | 1-hexa decanol | 430 | 450 | Acrylic acid | 150 |
| LC-10 | 1-octa decanol | 480 | 510 | Acrylic acid | 150 |
| LC-11 | 1-hexacosanol | 640 | 680 | Acrylic acid | 150 |
| LC-12 | 1-octa cusanol | 750 | 790 | Acrylic acid | 150 |
| LC-13 | 1-hexa decanol | 430 | 450 | Methacrylic acid | 320 |
| LC-14 | 1-octa decanol | 480 | 510 | Methacrylic acid | 320 |
| LC-15 | 1-hexacosanol | 640 | 680 | Methacrylic acid | 320 |
| LC-16 | 1-octa cusanol | 750 | 790 | Methacrylic acid | 320 |

Examples 1 to 63, Comparative Examples 1 to 5, Examples 101 to 152, and Comparative Examples 101 to 105

The liquid application for undercoating layer, the liquid application for charge generation layer, the liquid application for charge transport layer, and the liquid application for cross-linked type charge transport layer having the following components are sequentially applied to an aluminum cylinder having a diameter of 100 mm as an electroconductive substrate and dried to form an undercoating layer having a thickness of about 3.5 μm, a charge generation layer having a thickness of about 0.2 μm, a charge transport layer having a thickness of about 23 μm, and a cross-linked type charge transport layer having a thickness of about 5 μm. Thus, a laminate image bearing member is manufactured. Subsequent to application and drying by finger touching for respective layers, the undercoating layer is dried at 130° C., the charge generation layer is dried at 95° C., the charge transport layer is dried at 120° C., and the cross-linked type charge transport layer is dried at 120° C. for 20 minutes.

The cross-linked type charge transport layer is cross-linked by applying the liquid application for cross-linked type charge transport layer to a laminate image bearing member having a the electroconductive substrate, the undercoating layer, the charge generation layer, and the charge transport layer followed by irradiation by a UV lamp (kind of valve: H valve, manufactured by Fusion UV Systems Japan KK.) under the condition of a lamp power output of 200 W/cm, an illuminance of 450 mW/cm$^2$, and an irradiation time of 30 seconds. After drying for 20 minutes at 130° C., an image bearing member having the electroconductive substrate, an image bearing member formed of the undercoating layer, the charge generation layer, the charge transport layer, and the cross-linked type charge transport layer is obtained. Laminate image bearing members of Examples 129 to 132 are manufactured in the same manner as described above using an aluminum cylinder having a diameter of 60 mm. The weight average molecular weight is obtained by using a size exclusion chromatography analysis (GPC) and calculated in polystyrene conversion. SC-8010 System, manufactured by Tosoh Corporation, is used. Measuring conditions are as follows:

Column: Shodex KF-8000+KF-805L×2

Elute: THF

Temperature: Column high temperature tank

Current Speed: 1.0 ml/min

Infusion Amount: 100 μl

Preliminary Process: Filtering flotage (rubbish) with a 0.45 μm filter.

Detector: differential refractometer (R1)

Liquid Application for Undercoating Layer

| | |
|---|---|
| Titanium moxide (CR-EL, average primary particle diameter: about 0.25 μm, manufactured by ISHIHARA SANGYO KAISHA, LTD) | 50 parts |
| Alkyd resin (Beckolite 6401-50, solid portion: 50%, manufactured by Dainippon Ink and Chemicals, Inc.) | 14 parts |
| Melamine resin (L-145-60, solid portion: 60%, manufactured by Dainippon Ink and Chemicals, Inc.) | 8 parts |
| 2-butanone | 70 parts |

Liquid Application for Charge Transport Layer

| | |
|---|---|
| Bisphenol Z polycarbonate | 10 parts |
| Panlite TS-2050, manufactured by TEIJIN CHEMICALS LTD) | |
| Charge transport material | 7 parts |
| Tetrahydrofuran | 68 parts |
| Tetrahydrofuran solution of 1% Silicone oil | |
| (KF-50-1CS, manufactured by Shin-Ertsu Chemical Co., Ltd.) | |

The charge transport material is selected from the compounds represented by the following chemical structures. The selected charge transport materials are shown in Table 8.

Liquid Application for Cross-Linked Type Charge Transport Layer

| | |
|---|---|
| First component | 0.1 parts |
| Second component | 9.9 parts |
| Third component | 20 parts |
| Photo polymerization initiator | 2 parts |
| (1-hydroxy-cyclohexyl-phenyl-ketone) | |
| (IRGACURE 184, manufactured by | |
| Chiba Specialty Chemicals)} | |
| Tetrahydrofuran | 200 parts |

CTM-1

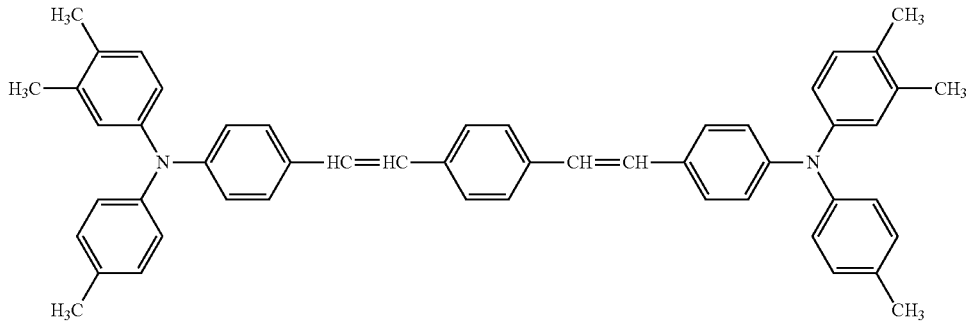

CTM-2

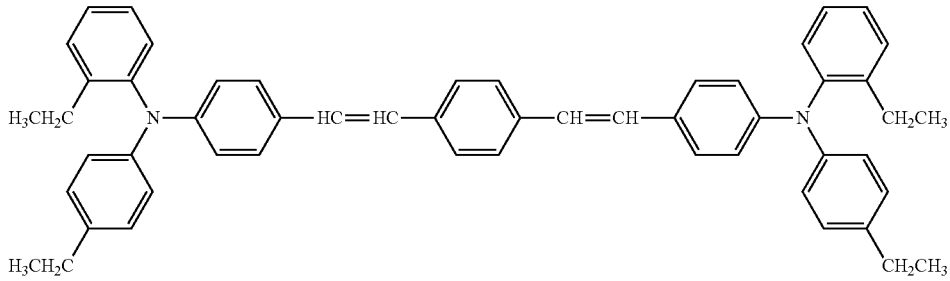

CTM-3

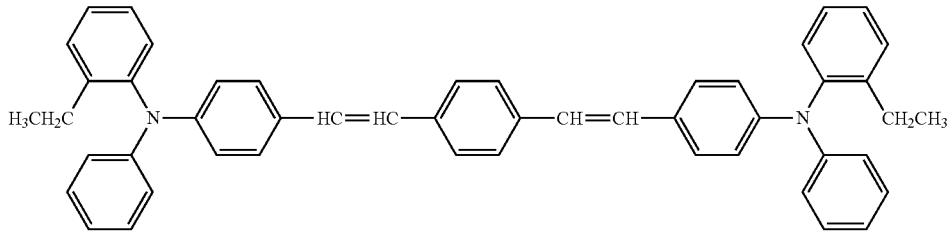

CTM-4

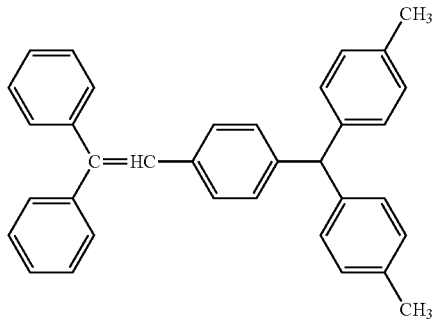

The first component, the second component, and the third component are selected from the following compounds. The selected materials are shown in Table 4.

First Component Material

CP-1

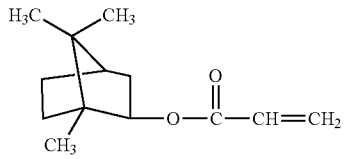

Isobornyl methacrylate (IBXA, manufactured by Osaka Chemical Industry Co., Ltd.)

CP-2

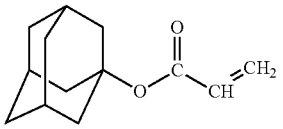

Adamanthyl acrylate

CP-3

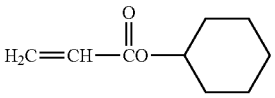

Cyclohexyl acrylate (Biscoat # 155, manufactured by Osaka Chemical Industry Co., Ltd.)

CP-4

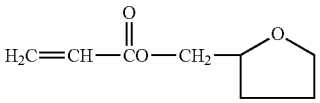

Tetrahydrofurfuryl acryalte (Biscoat # 150)

CP-5

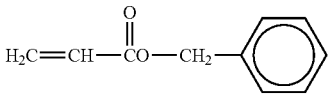

Benzyl acryalte (Biscoat # 160)

CPM-1

Methyl methacrylate (Liteester M, manufactured by KYOEISHA CHEMICAL Co., LTD)

CPM-2

2-Ethyl hexylacrylate (manufactured by NIPPON SHOKUBAI CO., LTD.)

CPM-3

Butyl acrylate (manufactured by NIPPON SHOKUBAI CO., LTD.)

CPM-4

Methacrylic acid (Liteester A)

Adamantyl acrylate is synthesized by the method described in JP-2001-106650-A. That is, 86.4 g (513 mmol) of 1,3-adamantane diol containing sodium in an amount of 0.05% by weight, 400 ml of toluene, 400 ml of n-octane, 108 g (1,500 mmol) of acrylic acid, 1.23 g of strong sulfuric acid, and 0.37 g p-methoxyphenol are placed in a separable flask equipped with a stirrer, a thermometer, a Dean-Stark water separator, a Dimroth condenser, an air introduction tube, and a separating valve provided on the bottom side. Reaction is conducted for five hours in a reflux state at 112° C. while inspiring a small amount of air to the flask. During the reaction, produced water is removed by using the Dean-Stark water separator. The reaction liquid is cooled down to room temperature followed by filtration of insoluble matters. 840 g of 5% by weight sodium hydroxide solution is admixed and separated. Thereafter, the organic phase is washed with 400 ml of water six times. The organic phase is condensed with a reduced pressure, filtered, and dried to obtain 83.8 g of adamantyl acrylate of white powder.

Manufacturing Example of Copolymer

Manufacturing of First Component No. 1 to 24 and 29 to 34

10.0 g (0.045 mol) of isbornyl methacrylate, 0.242 g (0.003 mol) of methylmethacrylate, 0.518 g (0.003 mol) of 2-ethylhexyl acrylate, 0.484 g (0.006 mol) of methacrylic acid, and 10.0 g of propylene glycol monomethyl ether are mixed.

The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 0.484 g of tertiary butylperoxy-2-ethylhexate and 15.0 g of propylene glycol monomethyl ether is dropped to the liquid mixture obtained as described above to react for 30 minutes. Thus, a copolymer having a weight average molecular weight of 7,500 is obtained. This is determined as First Component No. 3.

Copolymers of the first components no. 1 to 2, 4 to 24, and 29 to 34 are obtained in the same manner as in manufacturing of First Component no. 3. The used materials and molar ratios are shown in Table 4 and the amount thereof and the weight average molecular weight are shown in Table 7 "None" in Tables 4 and 7 means that the corresponding material is not used.

Manufacturing of First Component No. 25 to 28

Copolymers of the first components no. 25 to 28 are obtained in the same condition as that for Copolymer 3. The used materials and molar ratios are shown in Table 4 and the amount thereof and the weight average molecular weight are shown in Table 7 "None" in Tables 4 and 7 means that the corresponding material is not used.

CP1/2, CP2/3, CP1/3, and CP1/2/3 in Table 4 mean at least two kinds of components are selected for use from CP-1, CP-2, and CP-3, which are compounds having cyclic structures.

The prescription and the amount of the material 1 of the first component no. 25 to 28 are shown in Tables 5 and 6.

Synthesis of Non-Saturated Double Bond Containing Copolymer Manufacturing of First Component No. 35

17.786 g (0.08 mol) of radical polymerizable compound of isbornyl methacrylate (CP-1) shown in Table 3, 0.430 g (0.005 mol) of methylmethacrylate, 0.921 g (0.005 mol) of 2-ethylhexyl acrylate, 0.861 g (0.01 mol) of methacrylic acid, and 26.601 g of propylene glycol monomethyl ether are mixed. The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.287 g of tertiary butylperoxy-2-ethylhexate and 39.902 g of propylene glycol monomethyl ether are dropped to the liquid mixture obtained as described above to react for 30 minutes.

To this reaction liquid, 0.013 g of propylene glycol monomethyl ether solution containing 0.201 g of tetrabutyl ammonium bromide and 0.08 g of hydroquinone is added. Thereafter, a solution of 3.46 g of glycidyl methacrylate and 0.005 g of propylene glycol monomethyl ether is dropped to the liquid mixture in about one hour while bubbling by air followed by five-hour reaction to obtain the first component no. 35.

Manufacturing of First Component No. 36

The unsaturated double bond containing copolymer of first compound no. 36 is manufactured in the same manner as in that for first compound no. 35 except that 16.502 g (0.08 mol) of adamantyl acrylate (CP-2) is used instead of 17.786 g (0.08 mol) of isbornyl methacrylate (CP-1).

Manufacturing of First Component No. 37

The unsaturated double bond containing copolymer of first compound no. 37 is manufactured in the same manner as in that for first compound no. 35 except that 12.336 g (0.08 mol) of cyclohexyl acrylate (CP-3) is used instead of 17.786 g (0.08 mol) of isbornyl methacrylate (CP-1).

TABLE 5

| | Material 1 | | | Material 1 molar ratio | | |
|---|---|---|---|---|---|---|
| | Material 1-1 | Material 1-2 | Material 1-3 | Material 1-1 | Material 1-2 | Material 1-3 |
| 25 | CP-1 | CP-2 | None | 0.4 | 0.4 | 0 |
| 26 | CP-2 | CP-3 | None | 0.4 | 0.4 | 0 |
| 27 | CP-1 | CP-3 | None | 0.4 | 0.4 | 0 |
| 28 | CP-1 | CP-2 | CP-3 | 0.27 | 0.27 | 0.27 |

TABLE 6

| | Material 1 (mol) | | | Material 1 (g) | | |
|---|---|---|---|---|---|---|
| | Material 1-1 | Material 1-2 | Material 1-3 | Material 1-1 | Material 1-2 | Material 1-3 |
| 25 | 0.0233 | 0.0233 | 0.000 | 5.187 | 4.813 | 0.000 |
| 26 | 0.0277 | 0.0277 | 0.000 | 5.722 | 4.278 | 0.000 |
| 27 | 0.0266 | 0.0266 | 0.000 | 5.905 | 4.095 | 0.000 |
| 28 | 0.0172 | 0.0172 | 0.0172 | 3.815 | 3.539 | 2.646 |

TABLE 4

| First comp. no. | Material 1 | Molar ratio of material 1 | Material 2 | Molar ratio of material 2 | Material 3 | Molar ratio of material 3 | Material 4 | Molar ratio of material 4 |
|---|---|---|---|---|---|---|---|---|
| 1 | CP-1 | 0.8 | CPM-1 | 0.1 | None | 0 | CPM-4 | 0.1 |
| 2 | CP-1 | 0.8 | CPM-2 | 0.1 | None | 0 | CPM-4 | 0.1 |
| 3 | CP-1 | 0.8 | CPM-1 | 0.05 | CPM-2 | 0.05 | CPM-4 | 0.1 |
| 4 | CP-1 | 0.8 | CPM-1 | 0.05 | CPM-3 | 0.05 | CPM-4 | 0.1 |
| 5 | CP-1 | 0.3 | CPM-1 | 0.3 | CPM-2 | 0.3 | CPM-4 | 0.1 |
| 6 | CP-1 | 0.29 | CPM-1 | 0.305 | CPM-2 | 0.305 | CPM-4 | 0.1 |
| 7 | CP-1 | 0.9 | CPM-1 | 0.01 | CPM-2 | 0.01 | CPM-4 | 0.08 |
| 8 | CP-1 | 0.91 | CPM-1 | 0.005 | CPM-2 | 0.005 | CPM-4 | 0.08 |
| 9 | CP-2 | 0.8 | CPM-1 | 0.1 | None | 0 | CPM-4 | 0.1 |
| 10 | CP-2 | 0.8 | CPM-2 | 0.1 | None | 0 | CPM-4 | 0.1 |
| 11 | CP-2 | 0.8 | CPM-1 | 0.05 | CPM-2 | 0.05 | CPM-4 | 0.1 |
| 12 | CP-2 | 0.8 | CPM-1 | 0.05 | CPM-3 | 0.05 | CPM-4 | 0.1 |
| 13 | CP-2 | 0.3 | CPM-1 | 0.3 | CPM-2 | 0.3 | CPM-4 | 0.1 |
| 14 | CP-2 | 0.29 | CPM-1 | 0.305 | CPM-2 | 0.305 | CPM-4 | 0.1 |
| 15 | CP-2 | 0.90 | CPM-1 | 0.01 | CPM-2 | 0.01 | CPM-4 | 0.08 |
| 16 | CP-2 | 0.91 | CPM-1 | 0.005 | CPM-2 | 0.005 | CPM-4 | 0.08 |
| 17 | CP-3 | 0.8 | CPM-1 | 0.1 | None | 0 | CPM-4 | 0.1 |
| 18 | CP-3 | 0.8 | CPM-2 | 0.1 | None | 0 | CPM-4 | 0.1 |
| 19 | CP-3 | 0.8 | CPM-1 | 0.05 | CPM-2 | 0.05 | CPM-4 | 0.1 |
| 20 | CP-3 | 0.8 | CPM-1 | 0.05 | CPM-3 | 0.05 | CPM-4 | 0.1 |
| 21 | CP-3 | 0.3 | CPM-1 | 0.3 | CPM-2 | 0.3 | CPM-4 | 0.1 |
| 22 | CP-3 | 0.29 | CPM-1 | 0.305 | CPM-2 | 0.305 | CPM-4 | 0.1 |
| 23 | CP-3 | 0.9 | CPM-1 | 0.01 | CPM-2 | 0.01 | CPM-4 | 0.08 |
| 24 | CP-3 | 0.91 | CPM-1 | 0.005 | CPM-2 | 0.005 | CPM-4 | 0.08 |
| 25 | CP1/2 | 0.8 | CPM-1 | 0.05 | CPM-2 | 0.05 | CPM-4 | 0.1 |
| 26 | CP2/3 | 0.8 | CPM-1 | 0.05 | CPM-2 | 0.05 | CPM-4 | 0.1 |
| 27 | CP1/3 | 0.8 | CPM-1 | 0.05 | CPM-2 | 0.05 | CPM-4 | 0.1 |
| 28 | CP1/2/3 | 0.8 | CPM-1 | 0.05 | CPM-2 | 0.05 | CPM-4 | 0.1 |
| 29 | CP-4 | 0.2 | CPM-1 | 0.35 | CPM-2 | 0.35 | CPM-4 | 0.1 |
| 30 | CP-5 | 0.2 | CPM-1 | 0.35 | CPM-2 | 0.35 | CPM-4 | 0.1 |
| 31 | CP-1 | 0.2 | CPM-1 | 0.35 | CPM-2 | 0.35 | CPM-4 | 0.1 |
| 32 | CP-2 | 0.2 | CPM-1 | 0.35 | CPM-2 | 0.35 | CPM-4 | 0.1 |
| 33 | CP-3 | 0.2 | CPM-1 | 0.35 | CPM-2 | 0.35 | CPM-4 | 0.1 |
| 34 | None | 0 | CPM-1 | 0.45 | CPM-2 | 0.45 | CPM-4 | 0.1 |
| 35 | CP-1 | 0.8 | CPM-1 | 0.05 | CPM-2 | 0.05 | CPM-4 | 0.1 |
| 36 | CP-2 | 0.8 | CPM-1 | 0.05 | CPM-2 | 0.05 | CPM-4 | 0.1 |
| 37 | CP-3 | 0.8 | CPM-1 | 0.05 | CPM-2 | 0.05 | CPM-4 | 0.1 |

TABLE 7

| 1st comp. no. | Material 1 (g) | Molar ratio of material 1 (mol) | Material 2 (g) | Molar ratio of material 2 (mol) | Material 3 (g) | Molar ratio of material 3 (mol) | Material 4 (g) | Molar ratio of material 4 (mol) | Co-polymer molecular weight |
|---|---|---|---|---|---|---|---|---|---|
| 1 | 10 | 0.045 | 0.484 | 0.006 | 0.000 | 0.000 | 0.484 | 0.006 | 7000 |
| 2 | 10 | 0.045 | 1.036 | 0.006 | 0.000 | 0.000 | 0.484 | 0.006 | 8750 |
| 3 | 10 | 0.045 | 0.242 | 0.003 | 0.518 | 0.003 | 0.484 | 0.006 | 7500 |
| 4 | 10 | 0.045 | 0.242 | 0.003 | 0.360 | 0.003 | 0.484 | 0.006 | 7250 |
| 5 | 10 | 0.045 | 3.872 | 0.045 | 8.289 | 0.045 | 1.291 | 0.015 | 6250 |
| 6 | 10 | 0.045 | 4.073 | 0.047 | 8.717 | 0.047 | 1.335 | 0.016 | 6250 |
| 7 | 10 | 0.045 | 0.043 | 0.000 | 0.092 | 0.000 | 0.334 | 0.004 | 10000 |
| 8 | 10 | 0.045 | 0.021 | 0.000 | 0.046 | 0.000 | 0.340 | 0.004 | 10000 |
| 9 | 10 | 0.048 | 0.522 | 0.006 | 0.000 | 0.000 | 0.522 | 0.006 | 6300 |
| 10 | 10 | 0.048 | 1.117 | 0.006 | 0.000 | 0.000 | 0.522 | 0.006 | 7875 |
| 11 | 10 | 0.048 | 0.261 | 0.003 | 0.558 | 0.003 | 0.522 | 0.006 | 6750 |
| 12 | 10 | 0.048 | 0.261 | 0.003 | 0.388 | 0.003 | 0.522 | 0.006 | 6525 |
| 13 | 10 | 0.048 | 4.173 | 0.048 | 8.933 | 0.048 | 1.391 | 0.016 | 5625 |
| 14 | 10 | 0.048 | 4.389 | 0.051 | 9.395 | 0.051 | 1.439 | 0.017 | 5625 |
| 15 | 10 | 0.048 | 0.046 | 0.001 | 0.099 | 0.001 | 0.371 | 0.004 | 9000 |
| 16 | 10 | 0.048 | 0.023 | 0.000 | 0.049 | 0.000 | 0.367 | 0.004 | 9000 |
| 17 | 10 | 0.065 | 0.698 | 0.008 | 0.000 | 0.000 | 0.698 | 0.008 | 5600 |
| 18 | 10 | 0.065 | 1.494 | 0.008 | 0.000 | 0.000 | 0.698 | 0.008 | 7000 |
| 19 | 10 | 0.065 | 0.349 | 0.004 | 0.747 | 0.004 | 0.698 | 0.008 | 6000 |
| 20 | 10 | 0.065 | 0.349 | 0.004 | 0.519 | 0.004 | 0.698 | 0.008 | 5800 |
| 21 | 10 | 0.065 | 5.583 | 0.065 | 11.950 | 0.065 | 1.861 | 0.022 | 5000 |
| 22 | 10 | 0.065 | 5.872 | 0.068 | 12.568 | 0.068 | 1.925 | 0.022 | 5000 |
| 23 | 10 | 0.065 | 0.062 | 0.001 | 0.133 | 0.001 | 0.496 | 0.006 | 8000 |
| 24 | 10 | 0.051 | 0.277 | 0.003 | 0.593 | 0.003 | 0.554 | 0.006 | 7500 |
| 25 | 10 | 0.065 | 0.031 | 0.000 | 0.066 | 0.000 | 0.491 | 0.006 | 8000 |
| 26 | 10 | 0.047 | 0.251 | 0.003 | 0.537 | 0.003 | 0.502 | 0.006 | 7500 |
| 27 | 10 | 0.055 | 0.299 | 0.003 | 0.639 | 0.003 | 0.597 | 0.007 | 7750 |
| 28 | 10 | 0.053 | 0.286 | 0.003 | 0.612 | 0.003 | 0.572 | 0.007 | 7750 |
| 29 | 10 | 0.064 | 9.646 | 0.112 | 20.647 | 0.112 | 2.756 | 0.032 | 5000 |
| 30 | 10 | 0.062 | 9.290 | 0.108 | 19.884 | 0.108 | 2.654 | 0.031 | 5000 |
| 31 | 10 | 0.045 | 6.777 | 0.079 | 14.505 | 0.079 | 1.936 | 0.022 | 6250 |
| 32 | 10 | 0.048 | 7.304 | 0.085 | 15.633 | 0.085 | 2.087 | 0.024 | 5625 |
| 33 | 10 | 0.065 | 9.770 | 0.113 | 20.913 | 0.113 | 2.792 | 0.032 | 5000 |
| 34 | 0 | 0.000 | 2.178 | 0.025 | 4.662 | 0.025 | 0.484 | 0.006 | 7500 |
| 35 | 17.786 | 0.080 | 0.430 | 0.005 | 0.921 | 0.05 | 0.861 | 0.010 | 7500 |
| 36 | 16.502 | 0.080 | 0.430 | 0.005 | 0.921 | 0.05 | 0.861 | 0.010 | 6750 |
| 37 | 12.336 | 0.080 | 0.430 | 0.005 | 0.921 | 0.05 | 0.861 | 0.010 | 6000 |

Second Component Material

Trimethylol Propane Triacrylate (KAYARAD TMPTA, manufactured by Nippon Kayaku Corporation) (AM-1)

Molecular weight: 296

Number of functional groups: three Molecular weight/number of functional groups=99

Pentaerythritol Triacrylate (AM-2)

(PETIA, manufactured by DAICEL-CYTEC Company LTD.)

1.6-hexane diol diacrylate (manufactured by Wako Pure Chemical Industries, Ltd.) (AM-3)

Molecular weight: 226

Number of functional groups: two

Molecular weight/number of functional groups=113

Dipentaerythritol Caprolactone Modified Hexaacrylate (KAYARAD DPCA-120, manufactured by Nippon Kayaku Corporation) (AM-4)

Molecular weight: 1947

Number of functional groups: six

Molecular weight/number of functional groups=325

Photo Polymerization Initiator 1-hydroxy-cyclohexy-phenyl-ketone (IRGACURE 184, manufactured by Chiba Specialty Chemicals)} I-184

Third Component Material

Chemical Compounds C

AD-1

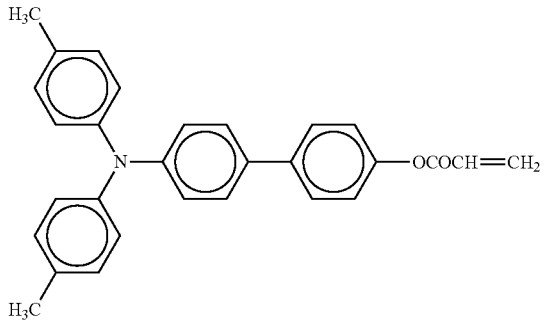

AD-2

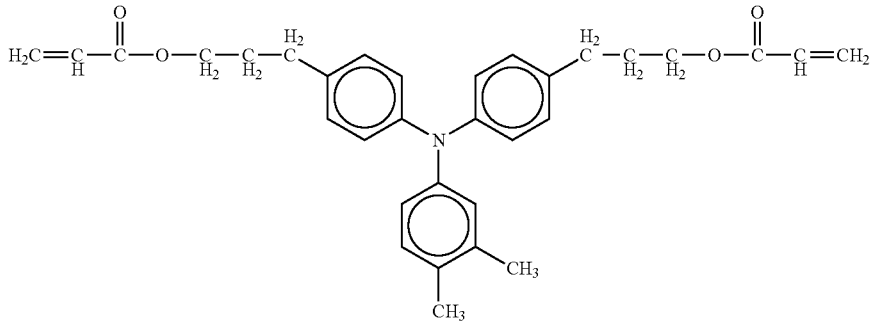

AD-3

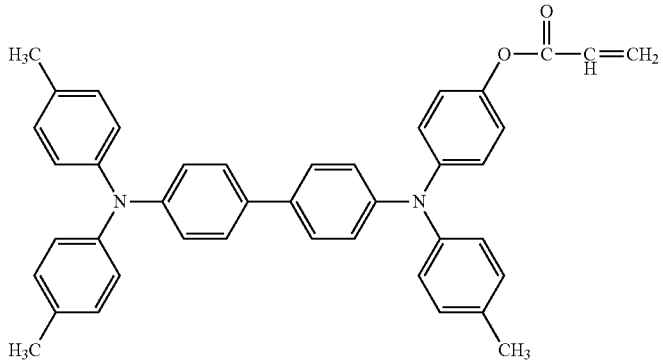

Filler

Alumina (Average primary particle diameter: 0.3 μm, SUMICORUNDUM AA-03, manufactured by Sumitomo Chemical Co., Ltd.) F-1

Silica

Hydrophobized Silica Powder

Product name: KMPX-100, Average primary particle diameter: 0.1 μm, manufactured by Shin-Etsu Chemical Co., Ltd.) F-2

Particles Formed of Acryl Modified Polyorganosiloxane Compound (Chaline R-170S, manufactured by Nissin Chemical Industry Co., Ltd.) F-3

The liquid application for cross-liked type charge transport layer containing the filler described above is as follows:

| | |
|---|---|
| First component | 0.1 parts |
| Second component | 9.9 parts |
| Third component | 20 parts |
| Filler | 4 parts |
| Photo polymerization initiator (1-hydroxy-cyclohexyl-phenyl-ketone) (IRGACURE 184, manufactured by Chiba Specialty Chemicals)} | 2 parts |
| Tetrahydrofuran | 219 parts |

Prescriptions of the image bearing members for use in Examples are shown in Table 8.

TABLE 8

| Ex. | Cross-linked type charge transport layer 1st comp. | 2nd comp. | 2nd comp. | 3rd comp. | Poly. init. | Filler | Charge trans. layer Charge trans. mat. |
|---|---|---|---|---|---|---|---|
| 1 | 1 | AM-1 | AM-4 | AD-1 | I-184 | F-2 | CTM-1 |
| 2 | 2 | AM-1 | AM-4 | AD-1 | I-184 | F-2 | CTM-1 |
| 3 | 3 | AM-1 | AM-4 | AD-1 | I-184 | F-2 | CTM-1 |
| 4 | 4 | AM-1 | AM-4 | AD-1 | I-184 | F-2 | CTM-1 |
| 5 | 5 | AM-1 | AM-4 | AD-1 | I-184 | F-2 | CTM-1 |
| 6 | 6 | AM-1 | AM-4 | AD-1 | I-184 | F-2 | CTM-1 |
| 7 | 7 | AM-1 | AM-4 | AD-1 | I-184 | F-2 | CTM-1 |
| 8 | 8 | AM-1 | AM-4 | AD-1 | I-184 | F-2 | CTM-1 |
| 9 | 9 | AM-1 | AM-4 | AD-1 | I-184 | F-2 | CTM-1 |
| 10 | 10 | AM-1 | AM-4 | AD-1 | I-184 | F-2 | CTM-1 |
| 11 | 11 | AM-1 | AM-4 | AD-1 | I-184 | F-2 | CTM-1 |
| 12 | 12 | AM-1 | AM-4 | AD-1 | I-184 | F-2 | CTM-1 |
| 13 | 13 | AM-1 | AM-4 | AD-1 | I-184 | F-2 | CTM-1 |
| 14 | 14 | AM-1 | AM-4 | AD-1 | I-184 | F-2 | CTM-1 |
| 15 | 15 | AM-1 | AM-4 | AD-1 | I-184 | F-2 | CTM-1 |
| 16 | 16 | AM-1 | AM-4 | AD-1 | I-184 | F-2 | CTM-1 |
| 17 | 17 | AM-1 | AM-4 | AD-1 | I-184 | F-2 | CTM-1 |
| 18 | 18 | AM-1 | AM-4 | AD-1 | I-184 | F-2 | CTM-1 |
| 19 | 19 | AM-1 | AM-4 | AD-1 | I-184 | F-2 | CTM-1 |
| 20 | 20 | AM-1 | AM-4 | AD-1 | I-184 | F-2 | CTM-1 |
| 21 | 21 | AM-1 | AM-4 | AD-1 | I-184 | F-2 | CTM-1 |
| 22 | 22 | AM-1 | AM-4 | AD-1 | I-184 | F-2 | CTM-1 |
| 23 | 23 | AM-1 | AM-4 | AD-1 | I-184 | F-2 | CTM-1 |
| 24 | 24 | AM-1 | AM-4 | AD-1 | I-184 | F-2 | CTM-1 |
| 25 | 25 | AM-1 | AM-4 | AD-1 | I-184 | F-2 | CTM-1 |
| 26 | 26 | AM-1 | AM-4 | AD-1 | I-184 | F-2 | CTM-1 |
| 27 | 27 | AM-1 | AM-4 | AD-1 | I-184 | F-2 | CTM-1 |
| 28 | 28 | AM-1 | AM-4 | AD-1 | I-184 | F-2 | CTM-1 |
| 29 | 3 | AM-1 | AM-4 | AD-1 | I-184 | F-3 | CTM-1 |
| 30 | 3 | AM-1 | AM-4 | AD-1 | I-184 | F-1 | CTM-1 |
| 31 | 3 | AM-1 | AM-4 | AD-2 | I-184 | F-2 | CTM-1 |
| 32 | 3 | AM-1 | AM-4 | AD-3 | I-184 | F-2 | CTM-1 |
| 33 | 3 | AM-1 | AM-4 | AD-1 | I-184 | F-2 | CTM-1 |
| 34 | 3 | AM-1 | AM-4 | AD-1 | I-184 | F-2 | CTM-1 |
| 35 | 11 | AM-1 | AM-4 | AD-1 | I-184 | F-3 | CTM-1 |
| 36 | 11 | AM-1 | AM-4 | AD-1 | I-184 | F-1 | CTM-1 |
| 37 | 11 | AM-1 | AM-4 | AD-2 | I-184 | F-2 | CTM-1 |
| 38 | 11 | AM-1 | AM-4 | AD-3 | I-184 | F-2 | CTM-1 |
| 39 | 11 | AM-1 | AM-4 | AD-1 | I-184 | F-2 | CTM-2 |
| 40 | 11 | AM-1 | AM-4 | AD-1 | I-184 | F-2 | CTM-3 |
| 41 | 19 | AM-1 | AM-4 | AD-1 | I-184 | F-3 | CTM-1 |
| 42 | 19 | AM-1 | AM-4 | AD-1 | I-184 | F-1 | CTM-1 |
| 43 | 19 | AM-1 | AM-4 | AD-2 | I-184 | F-2 | CTM-1 |
| 44 | 19 | AM-1 | AM-4 | AD-3 | I-184 | F-2 | CTM-1 |
| 45 | 19 | AM-1 | AM-4 | AD-1 | I-184 | F-2 | CTM-2 |
| 46 | 19 | AM-1 | AM-4 | AD-1 | I-184 | F-2 | CTM-3 |
| 47 | 29 | AM-1 | AM-4 | AD-1 | I-184 | NONE | CTM-4 |
| 48 | 30 | AM-1 | AM-4 | AD-1 | I-184 | NONE | CTM-4 |
| 49 | 31 | AM-1 | AM-4 | AD-1 | I-184 | NONE | CTM-4 |
| 50 | 32 | AM-1 | AM-4 | AD-1 | I-184 | NONE | CTM-4 |
| 51 | 33 | AM-1 | AM-4 | AD-1 | I-184 | NONE | CTM-4 |
| 52 | 3 | AM-1 | AM-4 | AD-1 | I-184 | NONE | CTM-4 |
| 53 | 11 | AM-1 | AM-4 | AD-1 | I-184 | NONE | CTM-4 |
| 54 | 19 | AM-1 | AM-4 | AD-1 | I-184 | NONE | CTM-4 |
| 55 | 3 | AM-1 | AM-4 | AD-1 | I-184 | NONE | CTM-1 |
| 56 | 11 | AM-1 | AM-4 | AD-1 | I-184 | NONE | CTM-1 |
| 57 | 19 | AM-1 | AM-4 | AD-1 | I-184 | NONE | CTM-1 |
| 58 | 35 | AM-1 | AM-1 | AD-1 | I-184 | F-2 | CTM-1 |
| 59 | 36 | AM-1 | AM-1 | AD-1 | I-184 | F-2 | CTM-1 |
| 60 | 37 | AM-1 | AM-1 | AD-1 | I-184 | F-2 | CTM-1 |
| 61 | 1 | AM-1 | AM-4 | AD-1 | I-184 | F-2 | CTM-1 |
| 62 | 2 | AM-1 | AM-4 | AD-1 | I-184 | F-2 | CTM-1 |
| 63 | 3 | AM-1 | AM-4 | AD-1 | I-184 | F-2 | CTM-1 |

Prescriptions of the image bearing members for use in Comparative Examples are shown in Table 9.

TABLE 9

| Com. Ex. | 1st comp. | 2nd comp. | 2nd comp. | 3rd comp. | Pol. init. | Filler | Charge trans. material |
|---|---|---|---|---|---|---|---|
| 1 | 34 | AM-1 | AM-4 | AD-1 | I-184 | NONE | CTM-4 |
| 2 | 3 | AM-1 | AM-4 | None | I-184 | NONE | CTM-4 |
| 3 | 3 | none | none | AD-1 | I-184 | NONE | CTM-4 |
| 4 | None | None | None | None | I-184 | NONE | CTM-4 |
| 5 | none | AM-1 | AM-4 | AD-1 | I-184 | NONE | CTM-4 |

Manufacturing of First Component No. 101

29.649 g (0.1 mol) of the radical polymerizable compound LC-9 shown in Table 3 is mixed with 29.000 g of propylene glycol monomtheylether (PGMME). The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.424 g of tertiary butyl peroxy-2-ethylhexate (referred to as "I") and 44.138 g of propylene glycol monomethyl ether is dropped to the liquid mixture obtained as described above to react for 30 minutes. Thus, a copolymer having a weight average molecular weight of 5,500 is obtained. This is determined as First Component No. 101.

Manufacturing of First Component No. 102 to 122 and 127 to 128

Copolymers of the first components are obtained in the same reaction conditions as those for first component no. 1. The used materials are shown in Table 10. "None" in Tables 4 and 7 means that the corresponding material is not used. The mol number of the used materials is shown in Table 11. The addition amount (parts by weight) required to manufacture copolymers and the weight average molecular weight of the manufactured first component are shown in Table 12.

The first components no. 123 to 126 are subject to the following treatment to introduce an unsaturated double bond.

Synthesis of Non-Saturated Double Bond Containing Copolymer Manufacturing of First Component No. 123

23.719 g (0.08 mol) of the radical polymerizable compound LC-9 shown in Table 3 is mixed with 2.223 g (0.01 mol) of isbornyl methacrylate, 0.861 g (0.01 mol) of methacrylic acid, and 26.601 g of propylene glycol monomtheylether (PGMME). The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.287 g of tertiary butylperoxy-2-ethylhexate and 39.902 g of propylene glycol monomethyl ether is dropped to the liquid mixture obtained as described above to react for 30 minutes. To this reaction liquid, 0.013 g of propylene glycol monomethyl ether solution containing 0.201 g of tetrabutyl ammonium bromide and 0.08 g of hydroquinone is added. Thereafter, a solution of 3.46 g of glycidyl methacrylate and 0.005 g of propylene glycol monomethyl ether is dropped to the liquid mixture in about one hour while bubbling by air followed by five-hour reaction.

Manufacturing of First Component No. 124

25.963 g (0.08 mol) of the radical polymerizable compound LC-10 shown in Table 3 is mixed with 2.223 g (0.01 mol) of isbornyl methacrylate, 0.861 g (0.01 mol) of methacrylic acid, and 28.828 g of propylene glycol monomtheylether (PGMME). The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.395 g of tertiary butylperoxy-2-ethylhexate and 43.242 g of propylene glycol monomethyl ether is dropped to the liquid mixture obtained as described above to react for 30 minutes.

To this reaction liquid, 0.014 g of propylene glycol monomethyl ether solution containing 0.218 g of tetrabutyl ammonium bromide and 0.08 g of hydroquinone is added. Thereafter, a solution of 3.749 g of glycidyl methacrylate and 0.005 g of propylene glycol monomethyl ether is dropped to the liquid mixture in about one hour while bubbling by air followed by five-hour reaction.

Manufacturing of First Component No. 125

32.696 g (0.08 mol) of the radical polymerizable compound LC-11 shown in Table 3 is mixed with 2.223 g (0.01 mol) of isbornyl methacrylate, 0.861 g (0.01 mol) of methacrylic acid, and 35.510 g of propylene glycol monomtheylether (PGMME). The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.719 g of tertiary butylperoxy-2-ethylhexate and 53.265 g of propylene glycol monomethyl ether is dropped to the liquid mixture obtained as described above to react for 30 minutes. To this reaction liquid, 0.017 g of propylene glycol monomethyl ether solution containing 0.268 g of tetrabutyl ammonium bromide and 0.01 g of hydroquinone is added. Thereafter, a solution of 4.618 g of glycidyl methacrylate and 0.007 g of propylene glycol monomethyl ether is dropped to the liquid mixture in about one hour while bubbling by air followed by five-hour reaction.

Manufacturing of First Component No. 126

37.185 g (0.08 mol) of the radical polymerizable compound LC-12 shown in Table 3 is mixed with 2.223 g (0.01 mol) of isbornyl methacrylate, 0.861 g (0.01 mol) of methacrylic acid, and 39.965 g of propylene glycol monomtheylether (PGMME). The liquid mixture is placed in a flask and subject to bubbling by nitrogen at room temperature for 30 minutes. Next, the liquid mixture is gradually heated to 105° C. and caused to react for 3 hours. Thereafter, a liquid mixture of 1.934 g of tertiary butylperoxy-2-ethylhexate and 59.948 g of propylene glycol monomethyl ether is dropped to the liquid mixture obtained as described above to react for 30 minutes. To this reaction liquid, 0.019 g of propylene glycol monomethyl ether solution containing 0.302 g of tetrabutyl ammonium bromide and 0.011 g of hydroquinone is added. Thereafter, a solution of 5.918 g of glycidyl methacrylate and 0.008 g of propylene glycol monomethyl ether is dropped to the liquid mixture in about one hour while bubbling by air followed by five-hour reaction.

TABLE 10

(First component no. 101 to 128)

| First component no. | Material 1 | Material 2 | Material 3 |
|---|---|---|---|
| 101 | LC-9 | none | None |
| 102 | LC-10 | none | none |
| 103 | LC-3 | none | CPM-4 |
| 104 | LC-4 | none | CPM-4 |
| 105 | LC-5 | none | CPM-4 |
| 106 | LC-8 | none | CPM-4 |
| 107 | LC-6 | none | CPM-4 |
| 108 | LC-7 | none | CPM-4 |
| 109 | LC-10 | CP-4 | CPM-4 |
| 110 | LC-10 | CP-4 | CPM-4 |
| 111 | LC-10 | CP-4 | CPM-4 |

TABLE 10-continued (First component no. 101 to 128)

| First component no. | Material 1 | Material 2 | Material 3 |
|---|---|---|---|
| 112 | LC-10 | CP-4 | CPM-4 |
| 113 | LC-10 | CP-1 | CPM-4 |
| 114 | LC-10 | CP-2 | CPM-4 |
| 115 | LC-10 | CP-3 | CPM-4 |
| 116 | LC-9 | CP-1 | CPM-4 |
| 117 | LC-11 | CP-1 | CPM-4 |
| 118 | LC-12 | CP-1 | CPM-4 |
| 119 | LC-13 | CP-1 | CPM-4 |
| 120 | LC-14 | CP-1 | CPM-4 |
| 121 | LC-15 | CP-1 | CPM-4 |
| 122 | LC-16 | CP-1 | CPM-4 |
| 123 | LC-9 | CP-1 | CPM-4 |
| 124 | LC-10 | CP-1 | CPM-4 |
| 125 | LC-11 | CP-1 | CPM-4 |
| 126 | LC-12 | CP-1 | CPM-4 |
| 127 | LC-1 | None | CPM-4 |
| 128 | LC-2 | none | CPM-4 |

TABLE 11

(First component no. 101 to 128)

| First component no. | Straight chain (mol) Material 1 (mol) | Cyclic (mol) Material 2 (mol) | Acid (mol) Material 3 (mol) |
|---|---|---|---|
| 101 | 0.1 | 0 | 0 |
| 102 | 0.1 | 0 | 0 |
| 103 | 0.091 | 0 | 0.009 |
| 104 | 0.091 | 0 | 0.009 |
| 105 | 0.091 | 0 | 0.009 |
| 106 | 0.091 | 0 | 0.009 |
| 107 | 0.091 | 0 | 0.009 |
| 108 | 0.091 | 0 | 0.009 |
| 109 | 0.029 | 0.062 | 0.009 |
| 110 | 0.091 | 0.001 | 0.008 |
| 111 | 0.03 | 0.06 | 0.01 |
| 112 | 0.09 | 0.002 | 0.008 |
| 113 | 0.08 | 0.01 | 0.01 |
| 114 | 0.08 | 0.01 | 0.01 |
| 115 | 0.08 | 0.01 | 0.01 |
| 116 | 0.08 | 0.01 | 0.01 |
| 117 | 0.08 | 0.01 | 0.01 |
| 118 | 0.08 | 0.01 | 0.01 |
| 119 | 0.08 | 0.01 | 0.01 |
| 120 | 0.08 | 0.01 | 0.01 |
| 121 | 0.08 | 0.01 | 0.01 |
| 122 | 0.08 | 0.01 | 0.01 |
| 123 | 0.08 | 0.01 | 0.01 |
| 124 | 0.08 | 0.01 | 0.01 |
| 125 | 0.08 | 0.01 | 0.01 |
| 126 | 0.08 | 0.01 | 0.01 |
| 127 | 0.08 | 0.01 | 0.01 |
| 128 | 0.08 | 0.01 | 0.01 |

TABLE 12

(First component no. 101 to 128)

| 1st comp. no. | Stght chain (g) Amt. of mat. 1 | Cyclic (g) Amt. of mat. 2 | Acid (g) Amt. of mat. 3 | Amt. of PGMME | Amount of "I" | "I" diluted PGGME | Molecular weight of copolymer Molecular weight of 1st comp. |
|---|---|---|---|---|---|---|---|
| 101 | 29.649 | 0.000 | 0.000 | 29.000 | 1.424 | 44.138 | 5500 |
| 102 | 32.454 | 0.000 | 0.000 | 32.209 | 1.559 | 48.314 | 5900 |
| 103 | 13.769 | 0.000 | 0.775 | 17.411 | 0.843 | 26.117 | 2500 |
| 104 | 49.956 | 0.000 | 0.775 | 50.348 | 2.437 | 75.523 | 10600 |
| 105 | 24.427 | 0.000 | 0.775 | 25.012 | 1.211 | 37.518 | 4400 |
| 106 | 46.127 | 0.000 | 0.775 | 46.548 | 2.253 | 69.822 | 9700 |
| 107 | 25.704 | 0.000 | 0.775 | 26.279 | 1.272 | 39.418 | 4700 |
| 108 | 44.850 | 0.000 | 0.775 | 45.281 | 2.192 | 67.921 | 9400 |
| 109 | 9.412 | 9.863 | 0.775 | 19.720 | 0.954 | 29.580 | 5600 |
| 110 | 29.533 | 0.156 | 0.689 | 30.149 | 1.459 | 45.223 | 5600 |
| 111 | 9.736 | 9.371 | 0.861 | 19.817 | 0.959 | 29.726 | 5600 |
| 112 | 29.209 | 0.312 | 0.689 | 29.982 | 1.451 | 44.973 | 5600 |
| 113 | 25.963 | 2.223 | 0.861 | 28.828 | 1.395 | 43.242 | 5600 |
| 114 | 25.963 | 2.063 | 0.861 | 28.669 | 1.388 | 43.004 | 5600 |
| 115 | 25.963 | 1.542 | 0.861 | 28.152 | 1.363 | 42.228 | 5600 |
| 116 | 23.719 | 2.223 | 0.861 | 26.601 | 1.287 | 39.902 | 5000 |
| 117 | 32.696 | 2.223 | 0.861 | 35.510 | 1.719 | 53.265 | 7500 |
| 118 | 37.185 | 2.223 | 0.861 | 39.965 | 1.934 | 59.948 | 8800 |
| 119 | 24.842 | 2.223 | 0.861 | 27.715 | 1.341 | 41.573 | 5000 |
| 120 | 27.086 | 2.223 | 0.861 | 29.942 | 1.449 | 44.913 | 5600 |
| 121 | 33.818 | 2.223 | 0.861 | 36.624 | 1.773 | 54.936 | 7500 |
| 122 | 38.307 | 2.223 | 0.861 | 41.079 | 1.988 | 61.619 | 8800 |
| 123 | 23.719 | 2.223 | 0.861 | 26.601 | 1.287 | 39.902 | 5000 |
| 124 | 25.963 | 2.223 | 0.861 | 28.828 | 1.395 | 43.242 | 5600 |
| 125 | 32.696 | 2.223 | 0.861 | 35.510 | 1.719 | 53.265 | 7500 |
| 126 | 37.185 | 2.223 | 0.861 | 39.965 | 1.934 | 59.948 | 8800 |
| 127 | 13.620 | 2.223 | 0.861 | 16.578 | 0.802 | 24.867 | 2200 |
| 128 | 45.040 | 2.223 | 0.861 | 47.761 | 2.312 | 71.642 | 10900 |

Second Component Material

Trimethylol Propane Triacrylate (KAYARAD TMPTA, manufactured by Nippon Kayaku Corporation) (AM-1)

Molecular weight: 296

Number of functional groups: three

Molecular weight/number of functional groups=99

Dipentaerythritol Caprolactone Modified Hexaacrylate (KAYARAD DPCA-120, manufactured by Nippon Kayaku Corporation) (AM-4)

KAYARAD DPCS-120, manufactured by Nippon Kayaku Corporation

Molecular weight: 1947

Number of functional groups: six

Molecular weight/number of functional groups=325

Photo Polymerization Initiator 1-hydroxy-cyclohexy-phenyl-ketone (IRGACURE 184, manufactured by Chiba Specialty Chemicals)} I-184

Third Component Material

Chemical structure 18

AD-1

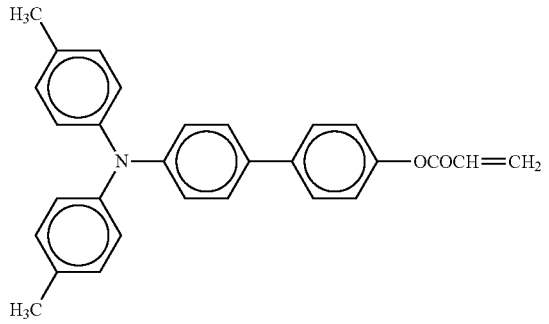

-continued

AD-2

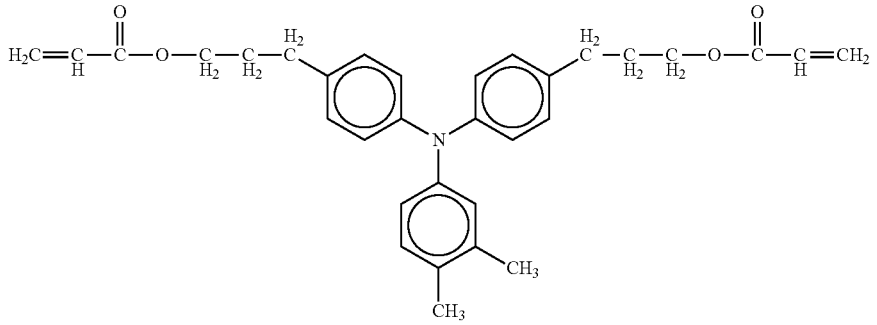

AD-3

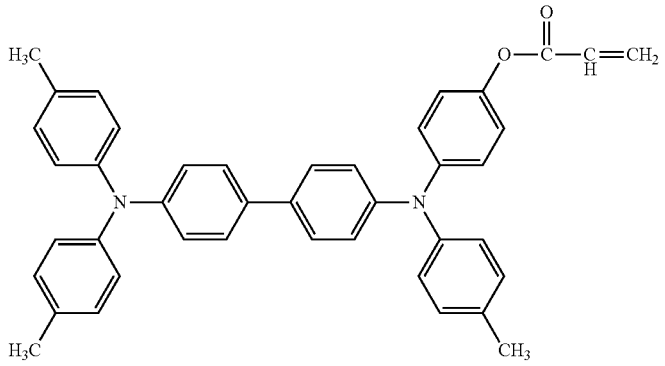

Filler

Alumina (Average primary particle diameter: 0.3 μm, SUMICORUNDUM AA-03, manufactured by Sumitomo Chemical Co., Ltd.) F-1

Silica

Hydrophobized Silica Powder

Product name: KMPX-100, Average primary particle diameter: 0.1 μm, manufactured by Shin-Etsu Chemical Co., Ltd.) F-2

Particles Formed of Acryl Modified Polyorganosiloxane Compound (Chaline R-170S, manufactured by Nissin Chemical Industry Co., Ltd.) F-3

The liquid application for cross-liked type charge transport layer containing the filler described above is as follows:

| | |
|---|---|
| First component | 0.1 parts |
| Second component | 9.9 parts |
| Third component | 20 parts |
| Filler | 4 parts |
| Photo polymerization initiator (1-hydroxy-cyclohexyl-phenyl-ketone) (IRGACURE 184, manufactured by Chiba Specialty Chemicals)} | 2 parts |
| Tetrahydrofuran | 219 parts |

Prescriptions of the image bearing members for use in Examples are shown in Table 13. Prescriptions of the image bearing members for use in Comparative Examples are shown in Table 14.

TABLE 13

(Examples 101 to 152, First component no. 101 to 126)

| Example | 1st comp. no. | 2nd comp. no. | 2nd comp. no. | 3rd comp. no. | Init. | Filler | Charge trans. mat. |
|---|---|---|---|---|---|---|---|
| 101 | 16 | AM-1 | AM-4 | AD-1 | I-184 | F-1 | CTM-1 |
| 102 | 16 | AM-1 | AM-4 | AD-1 | I-184 | F-2 | CTM-1 |
| 103 | 16 | AM-1 | AM-4 | AD-1 | I-184 | F-3 | CTM-1 |
| 104 | 15 | AM-1 | AM-4 | AD-1 | I-184 | F-1 | CTM-1 |
| 105 | 15 | AM-1 | AM-4 | AD-1 | I-184 | F-2 | CTM-1 |
| 106 | 15 | AM-1 | AM-4 | AD-1 | I-184 | F-3 | CTM-1 |
| 107 | 17 | AM-1 | AM-4 | AD-1 | I-184 | F-1 | CTM-1 |
| 108 | 17 | AM-1 | AM-4 | AD-1 | I-184 | F-2 | CTM-1 |
| 109 | 17 | AM-1 | AM-4 | AD-1 | I-184 | F-3 | CTM-1 |
| 110 | 18 | AM-1 | AM-4 | AD-1 | I-184 | F-1 | CTM-1 |
| 111 | 18 | AM-1 | AM-4 | AD-1 | I-184 | F-2 | CTM-1 |
| 112 | 18 | AM-1 | AM-4 | AD-1 | I-184 | F-3 | CTM-1 |
| 113 | 19 | AM-1 | AM-4 | AD-1 | I-184 | F-1 | CTM-1 |
| 114 | 19 | AM-1 | AM-4 | AD-1 | I-184 | F-2 | CTM-1 |
| 115 | 19 | AM-1 | AM-4 | AD-1 | I-184 | F-3 | CTM-1 |
| 116 | 20 | AM-1 | AM-4 | AD-1 | I-184 | F-1 | CTM-1 |
| 117 | 20 | AM-1 | AM-4 | AD-1 | I-184 | F-2 | CTM-1 |
| 118 | 20 | AM-1 | AM-4 | AD-1 | I-184 | F-3 | CTM-1 |
| 119 | 21 | AM-1 | AM-4 | AD-1 | I-184 | F-1 | CTM-1 |
| 120 | 21 | AM-1 | AM-4 | AD-1 | I-184 | F-2 | CTM-1 |
| 121 | 21 | AM-1 | AM-4 | AD-1 | I-184 | F-3 | CTM-1 |
| 122 | 22 | AM-1 | AM-4 | AD-1 | I-184 | F-1 | CTM-1 |
| 123 | 22 | AM-1 | AM-4 | AD-1 | I-184 | F-2 | CTM-1 |
| 124 | 22 | AM-1 | AM-4 | AD-1 | I-184 | F-3 | CTM-1 |
| 125 | 23 | AM-1 | AM-4 | AD-1 | I-184 | F-2 | CTM-1 |
| 126 | 24 | AM-1 | AM-4 | AD-1 | I-184 | F-2 | CTM-1 |
| 127 | 25 | AM-1 | AM-4 | AD-1 | I-184 | F-2 | CTM-1 |
| 128 | 26 | AM-1 | AM-4 | AD-1 | I-184 | F-2 | CTM-1 |
| 129 | 23 | AM-1 | AM-4 | AD-1 | I-184 | F-2 | CTM-1 |
| 130 | 24 | AM-1 | AM-4 | AD-1 | I-184 | F-2 | CTM-1 |
| 131 | 25 | AM-1 | AM-4 | AD-1 | I-184 | F-2 | CTM-1 |
| 132 | 26 | AM-1 | AM-4 | AD-1 | I-184 | F-2 | CTM-1 |
| 133 | 1 | AM-1 | AM-4 | AD-1 | I-184 | none | CTM-4 |
| 134 | 2 | AM-1 | AM-4 | AD-1 | I-184 | none | CTM-4 |
| 135 | 3 | AM-1 | AM-4 | AD-1 | I-184 | none | CTM-4 |

TABLE 13-continued (Examples 101 to 152, First component no. 101 to 126)

| Example | 1st comp. no. | 2nd comp. no. | 2nd comp. no. | 3rd comp. no. | Init. | Filler | Charge trans. mat. |
|---|---|---|---|---|---|---|---|
| 136 | 4 | AM-1 | AM-4 | AD-1 | I-184 | none | CTM-4 |
| 137 | 5 | AM-1 | AM-4 | AD-1 | I-184 | none | CTM-4 |
| 138 | 6 | AM-1 | AM-4 | AD-1 | I-184 | none | CTM-4 |
| 139 | 7 | AM-1 | AM-4 | AD-1 | I-184 | none | CTM-4 |
| 140 | 8 | AM-1 | AM-4 | AD-1 | I-184 | none | CTM-3 |
| 141 | 9 | AM-1 | AM-4 | AD-1 | I-184 | none | CTM-1 |
| 142 | 10 | AM-1 | AM-4 | AD-1 | I-184 | none | CTM-1 |
| 143 | 11 | AM-1 | AM-4 | AD-1 | I-184 | none | CTM-1 |
| 144 | 12 | AM-1 | AM-4 | AD-1 | I-184 | none | CTM-1 |
| 145 | 13 | AM-1 | AM-4 | AD-1 | I-184 | none | CTM-2 |
| 146 | 14 | AM-1 | AM-4 | AD-1 | I-184 | none | CTM-3 |
| 147 | 15 | AM-1 | AM-4 | AD-1 | I-184 | none | CTM-4 |
| 148 | 15 | AM-1 | AM-4 | AD-1 | I-184 | none | CTM-1 |
| 149 | 15 | AM-1 | AM-4 | AD-1 | I-184 | none | CTM-2 |
| 150 | 15 | AM-1 | AM-4 | AD-1 | I-184 | none | CTM-3 |
| 151 | 15 | AM-1 | AM-4 | AD-2 | I-184 | none | CTM-1 |
| 152 | 15 | AM-1 | AM-4 | AD-3 | I-184 | none | CTM-1 |

TABLE 14

(Comparative Examples 101 to 105, First component no. 115, 127, and 128)

| Com. Example | 1st comp. no. | 2nd comp. no. | 2nd comp. no. | 3rd comp. no. | Init. | Filler | Charge trans. mat. |
|---|---|---|---|---|---|---|---|
| 1 | 27 | AM-1 | AM-4 | AD-1 | I-184 | none | CTM-1 |
| 2 | 28 | AM-1 | AM-4 | AD-1 | I-184 | none | CTM-1 |
| 3 | none | AM-1 | AM-4 | AD-1 | I-184 | none | CTM-1 |
| 4 | 15 | AM-1 | AM-4 | none | I-184 | none | CTM-1 |
| 5 | 15 | none | none | AD-1 | I-184 | none | CTM-1 |

Machine Test

Abrasion amount and transfer ratio are measured and the image quality is evaluated. A machine remodeled based on image Neo753 is used for the test. In the machine running test, the image bearing member described above is installed in a process cartridge. The process cartridge is installed in the remodeled machine. A run length is 500,000 at most (A4, MY PAPER, manufactured by NBS Ricoh Co., Ltd., charging voltage: −700 V at start). The used chart is Chart no. 8 (6%) of the Imaging Society of Japan. The machine running test is conducted in the same manner for Examples 61 to 63 and 129 to 132 using the remodeled machine.

Transfer Ratio

Transfer ratio is calculated using the following relationship:

Transfer ratio=1−(ratio of toner remaining after transfer)

=1−{(toner remaining after transfer *M/A*)/(toner before transfer *M/A*)}

The developed chart on the image bearing member is transferred and the machine is stopped when the recording (transfer) medium is on the transfer belt. Pay attention to the black solid portion of the chart and peel off the toner remaining on the image bearing member after transfer of the black solid portion with an adhesive tape to obtain the amount of the toner remaining on the image bearing member after transfer. The coefficient is calculated based on plots of the image density of the remaining toner and the amount of toner and M/A (mg/cm$^2$, mass of toner attached to image bearing member per unit of area) is calculated using the image density of the remaining toner. In addition, the amount of toner on the image bearing member before transfer is measured to calculate M/A of the toner before transfer. A chart formed of multiple solid charts each of which has an image area of 2 cm$^2$ is used as the transfer ratio evaluation chart.

Measuring of Abrasion Amount

Take out the image bearing member after a run length of 500,000 sheets and measure the abrasion amount from the difference in the thickness of the image bearing member between before and after the machine running test. The thickness of the layer is measured by an eddy current layer thickness measuring meter (Fischer Scope MMS, manufactured by Fischer Instruments K.K.).

Image Quality Evaluation

Test Chart no. 3 of the Imaging Society of Japan is output before starting the machine test and after the output of 500,000 sheets to evaluate the image quality. Evaluation is made according to the following criteria.

E (Excellent): Image quality hardly deteriorates

G (Good): Image quality slightly deteriorates but causes no practical problem judging from observation by naked eyes F (Fair): Image quality deteriorates to a degree that deterioration is apparent at observation by naked eyes B (Bad): Image quality seriously deteriorates The test results are shown in Tables 15 to 18.

TABLE 15

| Example | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 1 | 98.5 | 98.2 | 0.5 | E | E |
| 2 | 98.1 | 97.8 | 0.4 | E | E |
| 3 | 98.2 | 97.9 | 0.4 | E | E |
| 4 | 98.5 | 98.2 | 0.5 | E | E |
| 5 | 94.3 | 94.0 | 0.4 | E | E |
| 6 | 92.5 | 92.2 | 0.3 | E | G |
| 7 | 95.5 | 95.2 | 0.4 | E | E |
| 8 | 95.5 | 95.2 | 0.8 | E | E |
| 9 | 98.5 | 98.2 | 0.3 | E | E |
| 10 | 97.8 | 97.5 | 0.4 | E | E |
| 11 | 98.4 | 98.1 | 0.2 | E | E |
| 12 | 98.6 | 98.3 | 0.1 | E | E |
| 13 | 96.5 | 96.2 | 0.4 | E | E |
| 14 | 92.3 | 92.0 | 0.5 | E | G |
| 15 | 96.8 | 96.5 | 0.3 | E | E |
| 16 | 96.0 | 95.7 | 1.0 | E | E |
| 17 | 98.7 | 98.4 | 0.5 | E | E |
| 18 | 99.1 | 98.8 | 0.3 | E | E |
| 19 | 98.0 | 97.7 | 0.4 | E | E |
| 20 | 97.5 | 97.2 | 0.5 | E | E |
| 21 | 95.4 | 95.1 | 0.3 | E | E |
| 22 | 93.3 | 93.0 | 0.6 | E | G |
| 23 | 94.5 | 94.2 | 0.4 | E | E |
| 24 | 95.2 | 94.9 | 0.9 | E | E |
| 25 | 98.4 | 98.1 | 0.3 | E | E |
| 26 | 99.0 | 98.7 | 0.4 | E | E |
| 27 | 97.9 | 97.6 | 0.3 | E | E |
| 28 | 97.5 | 97.2 | 0.5 | E | E |
| 29 | 97.5 | 97.2 | 0.4 | E | E |
| 30 | 98.1 | 97.8 | 0.5 | E | E |
| 31 | 97.8 | 97.5 | 0.3 | E | E |
| 32 | 98.4 | 98.1 | 0.4 | E | E |
| 33 | 98.9 | 98.6 | 0.5 | E | E |
| 34 | 97.8 | 97.5 | 0.4 | E | E |
| 35 | 97.1 | 96.8 | 0.3 | E | E |
| 36 | 97.6 | 97.3 | 0.2 | E | E |
| 37 | 98.7 | 98.4 | 0.3 | E | E |
| 38 | 98.6 | 98.3 | 0.4 | E | E |
| 39 | 99.1 | 98.8 | 0.2 | E | E |
| 40 | 97.8 | 97.5 | 0.3 | E | E |
| 41 | 98.6 | 98.3 | 0.4 | E | E |
| 42 | 98.7 | 98.4 | 0.3 | E | E |

TABLE 15-continued

| Example | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 43 | 99.0 | 98.7 | 0.2 | E | E |
| 44 | 98.1 | 97.8 | 0.5 | E | E |
| 45 | 99.3 | 99.0 | 0.5 | E | E |
| 46 | 97.3 | 97.3 | 0.5 | E | E |
| 47 | 91.9 | 91.6 | 1.1 | E | G |
| 48 | 94.1 | 93.4 | 1 | E | G |
| 49 | 94.5 | 93.8 | 0.8 | E | G |
| 50 | 94.6 | 93.9 | 0.7 | E | G |
| 51 | 94.6 | 93.9 | 0.9 | E | G |
| 52 | 97.4 | 97.1 | 0.6 | E | G |
| 53 | 97.5 | 97.2 | 0.8 | E | G |
| 54 | 97.6 | 97.3 | 0.7 | E | G |
| 55 | 98.0 | 97.7 | 0.6 | E | E |
| 56 | 97.6 | 97.3 | 0.8 | E | E |
| 57 | 98.1 | 97.8 | 0.7 | E | E |
| 58 | 97.7 | 97.4 | 0.2 | E | E |
| 59 | 98.8 | 98.5 | 0.3 | E | E |
| 60 | 99.1 | 98.8 | 0.1 | E | E |
| 61 | 97.0 | 97.7 | 0.4 | E | E |
| 62 | 96.6 | 97.3 | 0.3 | E | E |
| 63 | 96.7 | 97.4 | 0.3 | E | E |

TABLE 16

| Comp. Ex. | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 1 | 88.7 | 83.4 | 1.3 | E | B |
| 2 | — | — | — | — | — |
| 3 | 91.2 | 87.6 | 1.7 | E | G |
| 4 | 91.6 | 87.7 | 3.4 | E | E |
| 5 | 92.3 | 89.5 | 1 | E | B |

TABLE 17

Examples 101 to 152

| Ex. | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 101 | 98.5 | 98.2 | 0.6 | E | E |
| 102 | 98.1 | 97.8 | 0.5 | E | E |
| 103 | 98.2 | 97.9 | 0.3 | E | E |
| 104 | 98.5 | 98.2 | 0.4 | E | E |
| 105 | 98.5 | 98.2 | 0.3 | E | E |
| 106 | 97.8 | 97.5 | 0.5 | E | E |
| 107 | 98.4 | 98.1 | 0.4 | E | E |
| 108 | 98.6 | 98.3 | 0.4 | E | E |
| 109 | 98.7 | 98.4 | 0.5 | E | E |
| 110 | 99.1 | 98.8 | 0.4 | E | E |
| 111 | 98.0 | 97.7 | 0.4 | E | E |
| 112 | 97.5 | 97.2 | 0.5 | E | E |
| 113 | 98.4 | 98.1 | 0.3 | E | E |
| 114 | 99.0 | 98.7 | 0.4 | E | E |
| 115 | 97.9 | 97.6 | 0.3 | E | E |
| 116 | 97.5 | 97.2 | 0.3 | E | E |
| 117 | 97.5 | 97.2 | 0.3 | E | E |
| 118 | 98.1 | 97.8 | 0.2 | E | E |
| 119 | 97.8 | 97.5 | 0.3 | E | E |
| 120 | 98.4 | 98.1 | 0.4 | E | E |

TABLE 17-continued

Examples 101 to 152

| Ex. | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 121 | 98.9 | 98.6 | 0.2 | E | E |
| 122 | 97.8 | 97.5 | 0.3 | E | E |
| 123 | 97.1 | 96.8 | 0.4 | E | E |
| 124 | 97.6 | 97.3 | 0.3 | E | E |
| 125 | 98.7 | 98.4 | 0.2 | E | E |
| 126 | 98.6 | 98.3 | 0.1 | E | E |
| 127 | 99.1 | 98.8 | 0.2 | E | E |
| 128 | 97.8 | 97.5 | 0.2 | E | E |
| 129 | 98.6 | 98.3 | 0.2 | E | E |
| 130 | 98.7 | 98.4 | 0.1 | E | E |
| 131 | 99.0 | 98.7 | 0.2 | E | E |
| 132 | 98.1 | 97.8 | 0.2 | E | E |
| 133 | 93.1 | 92.8 | 1.2 | E | G |
| 134 | 93.5 | 93.2 | 1.1 | E | G |
| 135 | 91.7 | 91.4 | 1.4 | E | G |
| 136 | 91.8 | 91.5 | 1 | E | G |
| 137 | 94.0 | 93.7 | 1.3 | E | G |
| 138 | 94.1 | 93.8 | 1.4 | E | G |
| 139 | 95.6 | 95.3 | 1.2 | E | G |
| 140 | 96.1 | 95.8 | 0.7 | E | G |
| 141 | 94.2 | 93.9 | 0.8 | E | G |
| 142 | 94.3 | 94.0 | 0.7 | E | G |
| 143 | 95.5 | 95.2 | 0.9 | E | G |
| 144 | 97.7 | 97.4 | 0.6 | E | G |
| 145 | 98.0 | 97.7 | 0.8 | E | G |
| 146 | 99.0 | 98.7 | 0.7 | E | G |
| 147 | 97.9 | 97.6 | 0.6 | E | G |
| 148 | 98.4 | 98.1 | 0.8 | E | E |
| 149 | 97.8 | 97.5 | 0.7 | E | E |
| 150 | 98.1 | 97.8 | 0.6 | E | E |
| 151 | 97.6 | 97.3 | 0.7 | E | E |
| 152 | 97.9 | 97.6 | 0.8 | E | E |

TABLE 18

Comparative Example 105

| Comp. Ex. | Initial Transfer ratio (%) | After 500,000 sheets Transfer ratio (%) | After 500,000 sheets Amount of abrasion (μm) | Initial Image evaluation | After the test Image evaluation |
|---|---|---|---|---|---|
| 101 | 89.5 | 89.2 | 1.1 | E | F |
| 102 | 90.1 | 89.8 | 1.2 | E | F |
| 103 | 92.1 | 91.8 | 1.4 | E | F |
| 104 | Not performed | Not performed | Not performed | B | Not performed |
| 105 | No layer formed | | | | |

In Comparative Examples 1 and 5, foreign objects are confirmed to be on the image bearing member after outputting 500,000 sheets. Since the image density is extremely thin at the initial stage in Comparative Example 2, the transfer ratio is not measured or the machine running test is not conducted.

As seen in the results shown in Tables, the image baring members of Examples have excellent releasing property and abrasion resistance (durability) which contain the cross-linked type charge transport layer structure units deriving from the first component of a copolymer having a cyclic structure, the second component of one or more kinds of radical polymerizable compounds without a charge transport structure selected from a group consisting of monomers or oligomers, and the third component of radical polymerizable compound having one or more kinds of charge transport structures.

Judging from the comparison between Examples 47 and 48, the image bearing members of the present disclosure in which the cyclic structure contained in the first component is formed of bonding of carbon atoms and the number of carbon atoms forming the cyclic structure is six or more are found to have more excellent releasing property.

As seen in the results of Examples 49, 50, and 51, the image bearing members thereof, which contain the first component having a cyclic structure of at least one of adamantane ring, norbornane ring, and cyclohexyl ring, have excellent releasing property and abrasion resistance (durability).

As seen in the results of Examples 52, 53, and 54, the image bearing members thereof, which contain the cyclic compound of the copolymer of the first component having a copolymerization ratio of from 0.3 to 0.9, have an extremely excellent property.

As seen in the results of Examples 55, 56, and 57, the image bearing members thereof, which is formed of the charge transport layer containing at least one kind of distyryl benzene derivatives, have an excellent image stability.

As seen in the results of Examples 5 to 8, 13 to 16, and 21 to 24, the image bearing members thereof, which contain the cyclic compound of the copolymer of the first component having a copolymerization ratio of from 0.3 to 0.9, have a high transfer ratio. As seen in the results of Examples 1 to 46, the image bearing members thereof, which is formed of the cross-linked type charge transport layer containing the filler, have a high transfer ratio and an excellent abrasion resistance (durability) and hardly produce abnormal images.

That is, the image bearing members in the present disclosure are confirmed to have a good combination of mechanical durability and releasing property.

In Comparative Examples 101, 102, and 103, foreign objects are confirmed to be present on the image bearing member, thereby having an adverse impact on the image quality.

Since the image density is extremely thin at the initial stage in Comparative Example 104, the transfer ratio is not measured or the machine running test is not conducted.

As seen in Examples, the image bearing member of the present disclosure has a good combination between the releasing property and the mechanical durability.

The results of observing the image bearing members of Examples 3, 55, 102, and 152 with an SPM (D3100, manufactured by BioScope) are shown in FIGS. 6A, 6B, 7A, and 7B. The measuring method is as follows.

Probe: NCHV-10V

Number of Scanning: 256

The image bearing members of the present disclosure have a surface with a fine concavo-convex shape as illustrated in these drawings. This is thought to be caused by layer separation stemming from the compatibility difference among the first component, second component, and third component. Since the image bearing member of the present disclosure is of a minute concavo-convex surface, the image bearing member has an excellent releasing property. In addition, because of this minute concavo-convex surface and the cross-linking structure, the image bearing member has a good combination of the releasing property and the mechanical durability. Furthermore, the releasing property is reinforced by the lubricity ascribable to the structure represented by the Chemical structure 1.

This document claims priority and contains subject matter related to Japanese Patent Applications no. 2009-297541, 2009-297370, and 2010-284070 filed on Dec. 28, 2009, Dec. 28, 2009, and Dec. 21, 2010, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

an electroconductive substrate;

a charge generation layer provided overlying the electroconductive substrate;

a charge transport layer provided overlying the charge generation layer; and a cross-linked type charge transport layer provided overlying the charge transport layer, the cross-linked type charge transport layer comprising a structure unit deriving from a first component, a second component, and a third component, the first component comprising a copolymer having a weight average molecular weight of 2,000 to 100,000, having at least one cyclic structure selected from the group consisting of an adamantane ring and a norbornane ring, and having a structure represented by a Chemical structure 1 as a repeating unit, Chemical structure 1

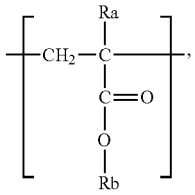

where Ra represents a hydrogen atom or methyl group and Rb represents a straight-chained saturated aliphatic hydrocarbon group having 8 to 34 carbon atoms, the second component comprising at least one of a radical polymerizable monomer and a radical polymerizable oligomer without a charge transport structure, and the third component comprising one or more kinds of radical polymerizable compounds having a charge transport structure.

2. The image bearing member according to claim 1, containing from 30% to 90% by molar conversion of the at least one of the cyclic structure and the structure represented by the Chemical structure 1 in the copolymer of the first component.

3. The image bearing member according to claim 1, wherein the charge transport layer comprises a distyryl benzene derivative represented by a Chemical structure 2

Chemical structure 2

(1)

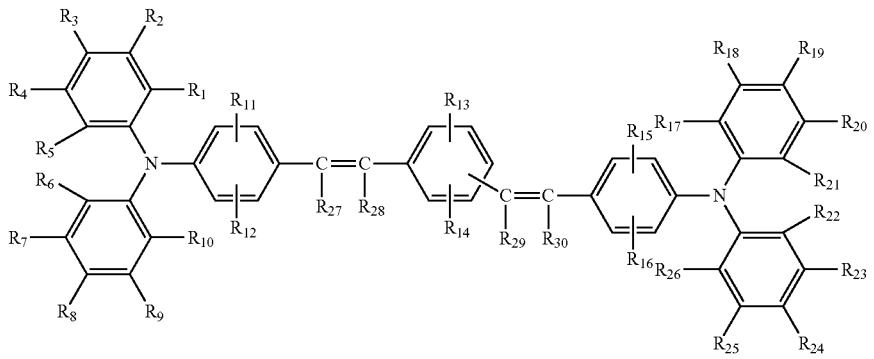

where $R_1$ to $R_{30}$ independently represent a hydrogen atom, an alkyl group having one to four carbon atoms, an alkoxy group having one to four carbon atoms, an aryl group substituted by an alkyl group having one to four carbon atoms or an alkoxy group having one to four carbon atoms, a non-substituted aryl group, and a benzyl group substituted by an alkyl group having one to four carbon atoms or an alkoxy group having one to four carbon atoms.

4. The image bearing member according to claim 1, wherein the cross-linked type charge transport layer comprises at least one type of filler particulates.

5. An image forming apparatus comprising:

the image bearing member of claim 1 that bears a latent electrostatic image;

a charging device that charges the image bearing member;

an irradiator that irradiates the image bearing member to form the latent electrostatic image thereon;

a development device that develops the latent electrostatic image with a development agent comprising toner to obtain a visualized image;

a transfer device that transfers the visualized image to a recording medium; and a cleaning device that cleans a surface of the image bearing member.

6. A process cartridge detachably attachable to an image forming apparatus, comprising:

the image bearing member of claim 1 that bears a latent electrostatic image; and at least one of a charging device that charges the image bearing member, an irradiator that irradiates the image bearing member to form the latent electrostatic image thereon, a development device that develops the latent electrostatic image with a development agent comprising toner to obtain a visualized image, a transfer device that transfers the visualized image to a recording medium, and a cleaning device that cleans a surface of the image bearing member.

7. The image bearing member according to claim 1, wherein the copolymer of the first component has at least one adamantane ring.

8. The image bearing member according to claim 1, wherein the copolymer of the first component has at least one norbomane ring.

9. The image bearing member according to claim 1, wherein the copolymer of the first component has at least one adamantane ring and at least one norbornane ring.

* * * * *